US006053643A

United States Patent [19]

Tanahashi et al.

[11] Patent Number: 6,053,643

[45] Date of Patent: Apr. 25, 2000

[54] SOLID PROCESSING AGENT STORING CONTAINER FOR PHOTOSENSITIVE MATERIAL PROCESSING

[75] Inventors: Kiyokazu Tanahashi; Nobuaki Takahashi; Toshio Kato; Michihide Murase; Hideo Kobayashi; Naoki Shimizu; Osamu Shibazaki; Tomohiro Uchida; Masahiko Taguchi, all of Hino, Japan

[73] Assignee: Konica Corporation, Toyko, Japan

[21] Appl. No.: 09/241,815

[22] Filed: Feb. 1, 1999

[30] Foreign Application Priority Data

| | | | |
|---|---|---|---|
| Feb. 6, 1998 | [JP] | Japan | 10-025850 |
| Feb. 10, 1998 | [JP] | Japan | 10-028470 |
| Feb. 11, 1998 | [JP] | Japan | 10-046196 |
| Apr. 22, 1998 | [JP] | Japan | 10-112268 |
| Jun. 16, 1998 | [JP] | Japan | 10-168381 |
| Jun. 16, 1998 | [JP] | Japan | 10-168382 |

[51] Int. Cl.[7] ..... G03D 3/02

[52] U.S. Cl. ..... 396/626; 396/630; 206/524.1; 430/398

[58] Field of Search ..... 396/620, 626, 396/638; 430/398, 399, 400, 465; 206/524.1

[56] References Cited

U.S. PATENT DOCUMENTS

| | | | |
|---|---|---|---|
| 5,351,103 | 9/1994 | Komatsu et al. | 396/626 |
| 5,489,962 | 2/1996 | Miyazawa et al. | 396/626 |
| 5,771,418 | 6/1998 | Miyazawa et al. | 396/626 |

FOREIGN PATENT DOCUMENTS

| | | |
|---|---|---|
| 7-199443 | 8/1995 | Japan . |
| WO 92/20013 | 11/1992 | WIPO . |

*Primary Examiner*—Alan A. Mathews
*Attorney, Agent, or Firm*—Frishauf, Holtz, Goodman, Langer & Chick, P.C.

[57] ABSTRACT

In a container for storing plural different kinds of photosensitive material processing agents provided with a first storing room having a first opening; a second storing room having a second opening; a third storing room having a third opening; a first flange section to enclose the periphery of the first opening; a second flange section to enclose the periphery of both the second opening and the third opening; and a cover member to cover the first opening, the second opening and the third opening, the second storing room is located between the first storing room and the third storing room and a first distance between the first storing room and the second storing room and is made larger than a second distance between the second storing room and the third storing room.

17 Claims, 32 Drawing Sheets

A-A ENLARGED CROSS SECTION

B-B ENLARGED CROSS SECTION

FIG. 28 ( a )
343A
D
343D
332H
C
D
R
343G
332G
C
343F
332F
332E
332D
C
332C
C
343F
B
332B
343E
B
332A
343N
N
A
L
343G
343H
343B
A
FIG. 28 ( b )
A-A CROSS SECTION
343B
343C
343A
FIG. 28 ( c )
B-B CROSS SECTION
343C
343E
343B
FIG. 28 ( d )
C-C CROSS SECTION
343F
343B
FIG. 28 ( e )
D-D CROSS SECTION
343A
343C
343B

FIG. 30 ( a )
343N
332A
332B
332C
332D
332E
332F
332G
332H
343A
343B
343C
343D
343E
343F
343G
343H
A
B
C
D
P
L
R
FIG. 30 ( b )
A-A CROSS SECTION
FIG. 30 ( c )
B-B CROSS SECTION
FIG. 30 ( d )
C-C CROSS SECTION
FIG. 30 ( e )
D-D CROSS SECTION

SOLID PROCESSING AGENT STORING CONTAINER FOR PHOTOSENSITIVE MATERIAL PROCESSING

BACKGROUND OF THE INVENTION

The present invention relates to a solid processing agent storing container for photosensitive material processing, which is suitable for accommodating therein a solid processing agent for photosensitive material processing, and to a solid processing agent replenishing device in which the storing container is detachably mounted and by which the solid processing agent is replenished to a processing tank.

Silver halide photosensitive materials as photosensitive materials are processed by processing solutions such as the developing solution, bleaching and/or fixing solution, and further, stabilizing solution after being exposed. Generally, the processing is conducted by an automatic processing device, and a system for replenishing the replenishing solution is commonly used so as to keep a degree of activation of each processing solution in processing tanks constant.

Conventionally, this replenishing solution is prepared by dissolving more than 1–2 kinds of part agents which are formed into kits, in a predetermined amount of water. In this method, handling of the part agents is troublesome and takes a long period of time because it is necessary to mix each part agent accurately, dissolve it in water securely, and supply it without fail.

For the above reason, the present inventors have been developed solid processing agents for photosensitive materials, (which are also simply referred to as solid processing agent, hereinafter), in which all processing agent components are solidified for each replenishing solution (processing), as described in Wo publication No. 092/20013.

This solid processing agent is accommodated in a storing container for each processing, as described in Japanese Patent Publication Open to Public Inspection No. 199443/1995, and sold and supplied in the market.

When the above cited solid processing agent is accommodated in the storing container for each processing, in the case where a color negative film is processed as the photosensitive material, 4 storing containers are necessary for development, bleach, fix, and stabilization; in the case where color paper is processed as the photosensitive material, 3 storing containers are necessary for development, bleach and fix, and stabilization, and accordingly, total 7 storing containers are required. Further, in finishing laboratories such as labs, when these processing are carried out, it is necessary to stock more storing containers as spare containers. When the processing agent is accommodated in the storing container for each processing as described above, a large number of storing containers are necessary, cost is increased, and also for a loading operation of the storing container into an automatic developing device, it is necessary to carry out the operation for each processing, therefore, the operability is inefficient.

(*a*) In order to solve the above cited problems, it is considered that plural kinds of solid processing agents are accommodated in one storing container. However, in this case, there is a possibility that powders containing different kinds of solid processing agent components are mixed (so-called contamination occurs), thereby, the processing performance of the solid processing agent is lowered. Further, from its nature, the solid processing agent has hygroscopic property, therefore, sometimes, it absorbs water in the air, and is swelled or dissolved. In that case, such problem occurs that processing performance is lowered, the solid processing agent can not be delivered from the storing container, or it can not be securely supplied into the automatic developing device.

(*b*) Incidentally, the present inventors tried to mold such the storing container by resins, however, when such that storing container is assembled, it is necessary to cover an opening for storing or delivering the solid processing agents with a lid member, and a long period of time is required for the attaching operation.

(*c*) Further, sometimes the solid processing agent accommodated in the storing container is destroyed due to occurrence of vibration or dropping when such the storing container is carried from the factory to each photofinisher.

(*d*) The above cited lid member of the storing container is formed of resin molding and is thin. Accordingly, strain at the molding occurs after molding, and it is considerably difficult to keep its flatness, and it is necessary to suppress the occurrence of the strain by delaying the cycle time during molding in order to cool the product by taking a lot of time, resulting in inefficiency. When a lid having the strain is used, smooth loading into the replenishing device can not be realized, and loading is carried out carefully.

(*e*) In the case where the storing container of the present invention is loaded into the replenishing device, when the operator grasps the storing container with one hand and takes up it, because weight of the storing container is large, there is a danger that it slips down.

When the storing container slips down and hits the instep or the fingertip of the leg, there is a danger of an injury, and further, there is a danger that accommodated solid processing agents are broken or the storing container is damaged due to the shock of dropping. Accordingly, in order to avoid such the situation, when the storing container is handled, it is grasped with both hands and handled carefully, although the operability is not good.

(*f*) When the storing container, which has a plurality of separated storing chambers and in which plural kinds of solid processing agents are accommodated, is left under the normal temperature, the inside pressure of the container is raised by gas generated from a part of accommodated solid processing agents, resulting in that the sealing section of a cover is peeled off. As a result, the generated gas leaks from the peeled-off sealing section and enters into a portion of the storing container in which other solid processing agents are accommodated, and deteriorates the solid processing agents, therefore, it is necessary to preserve it under the temperature lower than the normal temperature, and to preserve it very carefully. Specifically, when the storing container is transported, the low-temperature transportation is required, resulting in an increase of cost.

(*g*) Because the solid processing agent accommodated in the storing container is hygroscopic, air-tightness is required for the storing container. Because the storing container is put in a moisture-proofing barrier bag and hermetically sealed before loaded into the replenishing device, there is no trouble, however, when the storing container is loaded into the replenishing device, the air-tightness is required because it is directly exposed to the air.

(*h*) When the storing container is put under high temperature during transportation, there is sometimes a case in which the adhered portion is loosened due to the increased inside pressure of the container, thereby, a portion of the cap members is separated.

SUMMARY OF THE INVENTION

The above problems can be solved by the following structures.

A container for storing plural different kinds of photosensitive material processing agents, comprises:

a first storing room in which a first processing agent is stored, the fist storing room having a first opening;

a second storing room in which a second processing agent different in kind from the first processing agent is stored, the second storing room having a second opening;

a third storing room in which a third processing agent different in kind from both the first processing agent and the second processing agent is stored, the third storing room having a third opening;

the second storing room located between the first storing room and the third storing room so that a first distance is provided between the first room and the second room and the second distance is provided between the second room and the third room, wherein the first distance is made larger than the second distance;

a first flange section provided so as to enclose the periphery of the first opening;

a second flange section provided so as to enclose the periphery of both the second opening and the third opening; and a cover member to cover the first opening, the second opening and the third opening.

A container for storing plural different kinds of photosensitive material processing agents, comprises:

a first storing room in which a first processing agent is stored, the fist storing room having a first opening;

a second storing room in which a second processing agent different in kind from the first processing agent is stored, the second storing room having a second opening;

an empty room in which no processing agent different is stored, the empty room located between the first storing room and the second storing room and has an opening;

a first flange section provided so as to enclose the periphery of both the first opening and the empty room;

a second flange section provided so as to enclose the periphery of the second opening; and a cover member to cover the first opening and the second opening.

Here, for example in FIG. 4C, the first distance is a distance between the inside wall of the first storing room 121 at the second storing room side and the inside wall of the second storing room 123 at the fist storing room side. The second distance is a distance between the inside wall of the second storing room 123 at the third storing room side and the inside wall of the third storing room 12 at the second storing room side.

With this construction, it becomes possible to prevent the contamination among the different processing agents.

Further, the above cited problems can be solved by the following preferable structures.

(1) A solid processing agent storing container for photosensitive materials comprising: an opening to accommodate or deliver a plurality of kinds of solid processing agents for photosensitive materials; a flange portion provided in a manner extending from around the opening portion; a seal member covering the opening portion and adhered onto the flange portion; an engagement portion to be engaged with the flange portion; and a lid member to cover the opening portion, wherein the seal member is peeled by the movement of the lid member in the opening direction, and wherein a protrusion is provided so as to surround the opening portion, on an adhered portion of the seal member on the flange portion.

According to the invention described in Item (1), when a protrusion is provided so as to surround the opening portion, on an adhered portion of the seal member on the flange portion, the strength of the flange portion is increased, thereby, the storing container is provided with the shock-proof property and the recycle aptitude, and super thin and ultra-thin long wall formation can be realized.

(2) The storing container described in Item (1), in which the height of the protrusion is 0.4–1.2 mm, the width of the protrusion is 0.3–3.0 mm, the angle of the protrusion is 5–30°, the deviation from flatness is not more than 0.3 mm, and the peeling force of the seal member (to polyolefine) is 0.5–5.0 Kg.

According to the invention described in Item (2), when the height of the protrusion of the flange portion is 0.4–1.2 mm, the width of the protrusion of the flange portion is 0.3–3.0 mm, the angle of the protrusion of the flange portion is 5–30°, the deviation from flatness of the flange portion is not more than 0.3 mm, and the peeling force of the seal member on the flange portion (to polyolefine) is 0.5–5.0 Kg, the flange portion can maintain compactness and the property of easy setting, and can have the stable sealing property.

(3) The storing container of Item (1), in which the seal member has the structure of PET/Aluminimum/PE/sealant, Nylon/Aluminimum/PE/sealant, PET/Aluminimum/PET/sealant, or Nylon/Aluminimum/PET/sealant, and the stiffness of the seal material is 10–40 g.

According to the invention described in Item (3), the seal member is one having the excellent anti-pinhole property and moisture-proofing property, and it has no fused portion other than the protrusion, and the excellent conveying property in a machine.

(4) A solid processing agent storing container for photosensitive material processing, comprising: a cylindrical container main body having a flange portion provided in a manner extending around an opening portion to deliver the solid processing agents from a plurality of storing containers in which a plurality of kinds of solid processing agents for photosensitive material processing are accommodated for each kind; a flexible seal member which is adhered onto the flange portion and which covers the opening portion and hermetically seals a plurality of storing containers in which solid processing agents are accommodated for each kind; a lid member to peel the flexible seal member by being engaged with the flange portion and relatively moved, and to open the opening portion; and a cap member which closes the opening portion of the container main body and the opening portion on the opposite side, and is detachable, wherein a convex portion around which the flexible seal material is wound, is provided on the front end surface of the lid member in the movement direction, and a cutout portion to make the movement of the lid member easy, is provided on the rear end surface of the lid member in the movement direction.

According to the invention described in Item (4), the convex portion and the cutout portion to make the movement of the lid member easy, are provided on the front end surface and rear end surface of the lid member in its movement direction, thereby, the lid member can be moved easily.

(5) The storing container described in Item (4), in which the lid member is produced by injection molding processing using a molding die having at least more than 2 resin injection portions, thereby its flatness is maintained.

According to the invention described in Item (5), when the lid member is molded, its flatness is maintained by injection molding processing using a molding die having at least more than 2 resin injection portions, and thereby, it can be easily loaded into the replenishing device.

(6) The storing container described in Item (4), in which at least one pair of protruded portions for grasping are formed on both side surfaces of the container main body, in order to prevent slipping when the container main body is grasped for being loaded into the replenishing device.

According to the invention described in Item (6), when the container is loaded into the replenishing device, by providing a pair of protruded portions on both side surfaces of the upper portion of the cylindrical container main body in order to prevent slipping, the easy grasping and handling property can be obtained.

(7) The storing container described in Item (4), in which at least one cutout portion is provided on a protruded stripe portion for thermal adhesion, which surrounds the periphery of the opening portion of the flange portion and is provided to adhere the flexible seal member onto the flange portion, and the inside of the container main body onto which the flexible seal member is adhered, can be communicated to the outside air through the cutout portion.

According to the invention described in Item (7), when at least more than one cutout portion is provided on the protruded stripe portion for thermal adhesion, which covers the opening portion and is provided for adhering the flexible seal member onto the flange portion, on the opening portion to accommodate or deliver the solid processing agent of the cylindrical container main body in which a plurality of kinds of solid processing agents for photosensitive material processing are accommodated, and the flange portion provided in a manner extending around the opening portion, gas generated in the storing container is exhausted to the outside of the container, and does not enter into divided chambers in which other processing agents are accommodated, thereby, deterioration of the solid processing agent is prevented.

(8) The storing container described in Item (4), in which a concave portion is formed on one of the container main body and the cap member, and a convex portion to engage with the concave portion is formed on another of the two, and by engaging the concave portion with the convex portion, the container main body is detachably engaged with the cap member.

According to the invention described in Item (8), by engaging the container main body with the cap member by an engaging method such as a snap-fit or a similar method to engage the convex portion with the concave portion, even when these members are located at a high temperature place, the cap member is not separated from the main body, thereby, these members can be handled without anxiety.

(9) A solid processing agent storing container for photosensitive material processing, comprising: a cylindrical container main body having a flange portion provided in a manner extending on the periphery of an opening portion to deliver the solid processing agents from a plurality of storing containers in which a plurality of kinds of solid processing agents for photosensitive material processing are accommodated for each kind, a protruded stripe portion for thermal adhesion which surrounds the periphery of the opening portion and is provided for adhering the seal member onto the flange portion, a cutout portion formed on at least one portion of the protruded stripe portion, and at least one protruded portion for grasping which is formed on the grasping portions on both side surfaces to prevent slipping; a flexible seal member which is adhered onto the flange portion and which covers the opening portion and hermetically seals a plurality of storing containers in which solid processing agents are accommodated for each kind; a lid member to peel the flexible seal member when the seal member is moved by the engaging portion engaged with the flange portion, and to open the opening portion; and a cap member which closes the opening portion of the container main body and the opening portion on the opposite side, and is detachably engaged with the opening portions.

According to the invention described in Item (9), the moisture-proofing property of the solid processing agent accommodated in the storing container is increased, and the operability when the storing container is loaded in the replenishing device, is increased.

(10) A solid processing agent replenishing device which is provided with the container main body, the flexible seal member, the lid member, and the cap member described in Item (4); and in which, when the storing container in which the solid processing agent is accommodated, is detachably mounted in the mounting portion of the replenishing device, the lid member is moved, the flexible seal member is opened and the solid processing agent is supplied from the opening portion of the container main body to a receiving opening portion in the replenishing device, and the solid processing agent is delivered from a delivery opening portion of the replenishing device and is replenished to a processing solution tank.

According to Item (10), when the storing container is mounted in the mounting portion of the solid processing agent replenishing device, peeling of the seal member, movement of the lid member, and loading into the mounting portion are made easy, thereby, the solid processing agent replenishing device using the solid processing agent storing container in which, when the storing container is loaded, handling of the storing container is made easy, and the solid processing agent in the storing container is stably stored, and which can be transported without concerning about the temperature at the time of transportation, is provided.

BRIEF DESCRIPTION OF THE DRAWINGS

FIG. 4(*b*) is a side view and FIG. 4(*c*) is an enlarged sectional view taken on line A—A of FIG. 4(*a*).

FIGS. 26(*b*) and 26(*c*) are illustrations showing the supplying sequence of the solid processing agents. FIGS. 26(*e*) and 26(*f*) are illustrations showing other examples of the supplying sequence of the solid processing agents.

DETAILED DESCRIPTION OF THE PREFERRED EMBODIMENT

Referring to the attached drawings, a solid processing agent storing container for photosensitive materials and a solid processing agent replenishing device of the present invention will be described below.

Figure 1:
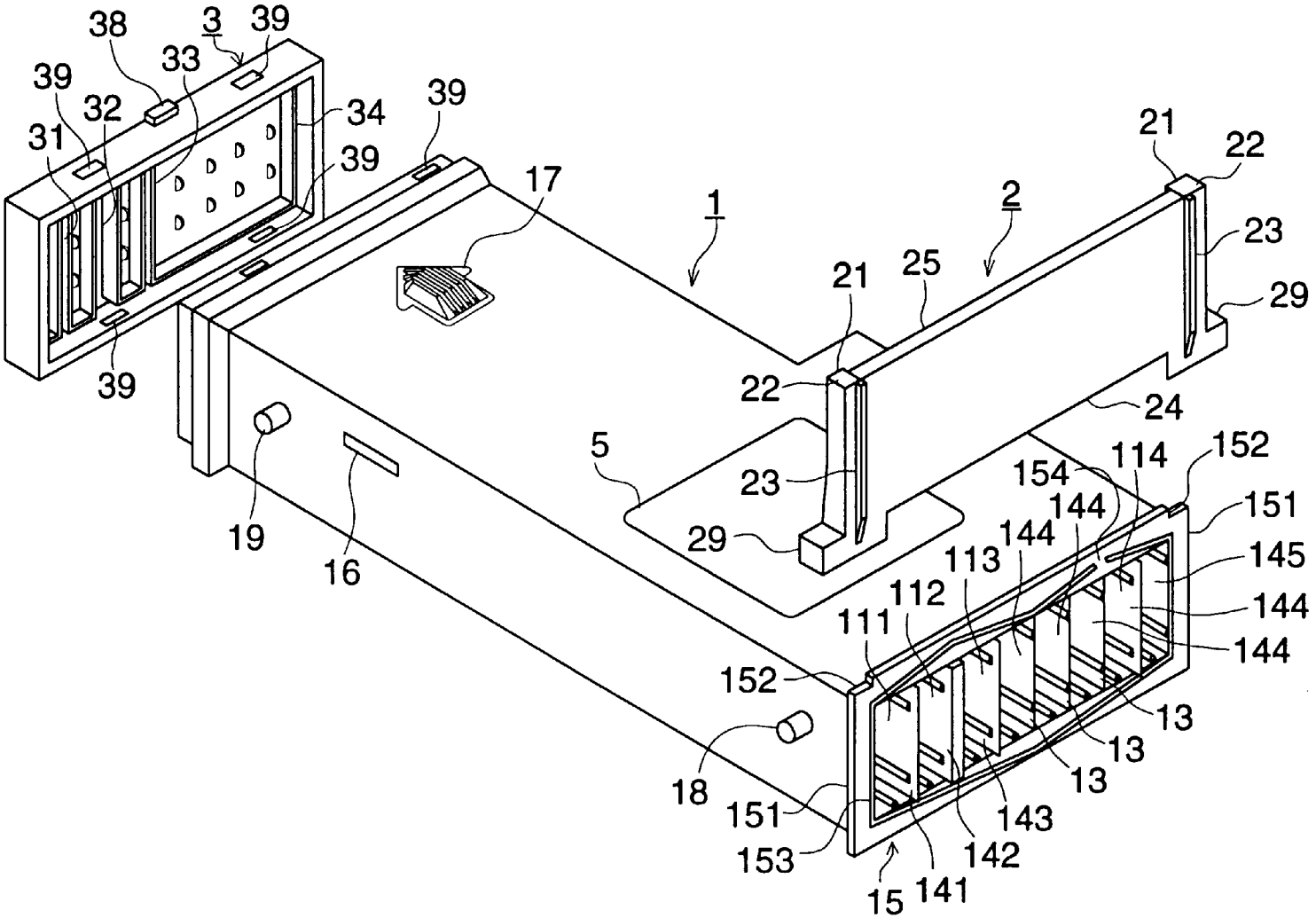
FIG. 1 is a perspective view of each component of the storing container.
Figure 2:
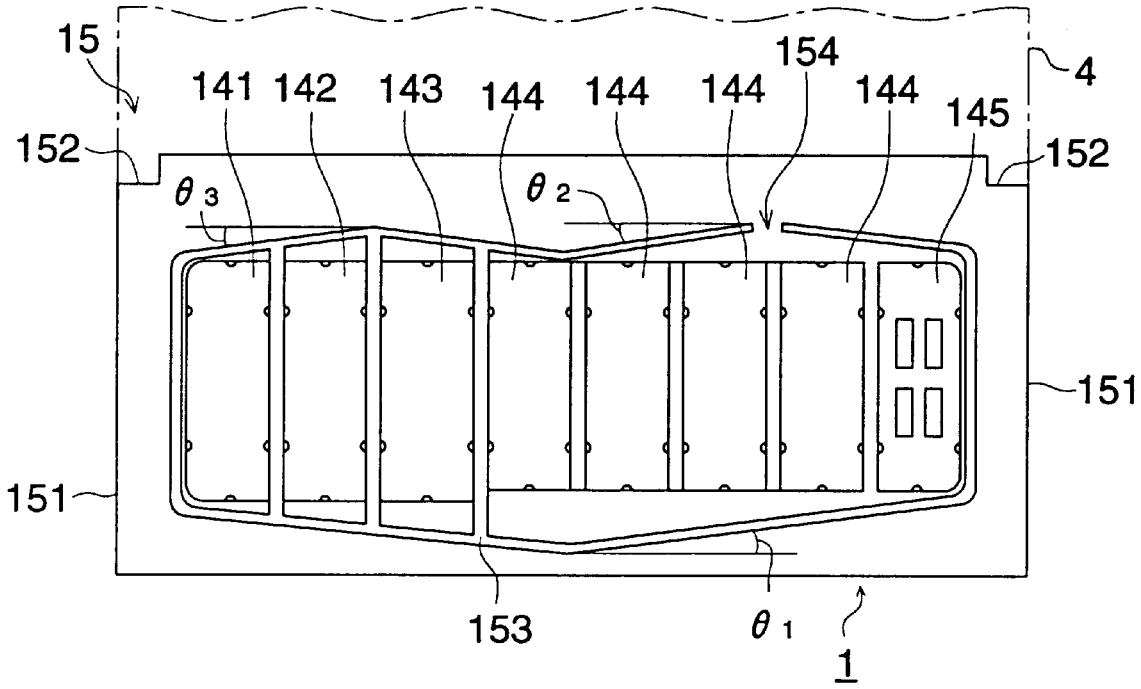
FIG. 2(*a*) is a front view, viewed from a opening portion side, of the storing container, and FIG. 2(*b*) is an enlarged sectional view of a protruded stripe portion of a flange portion.
Figure 2:
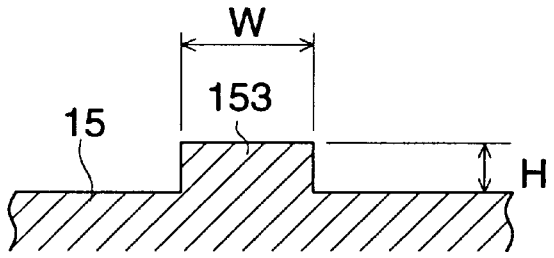
Figure 3:
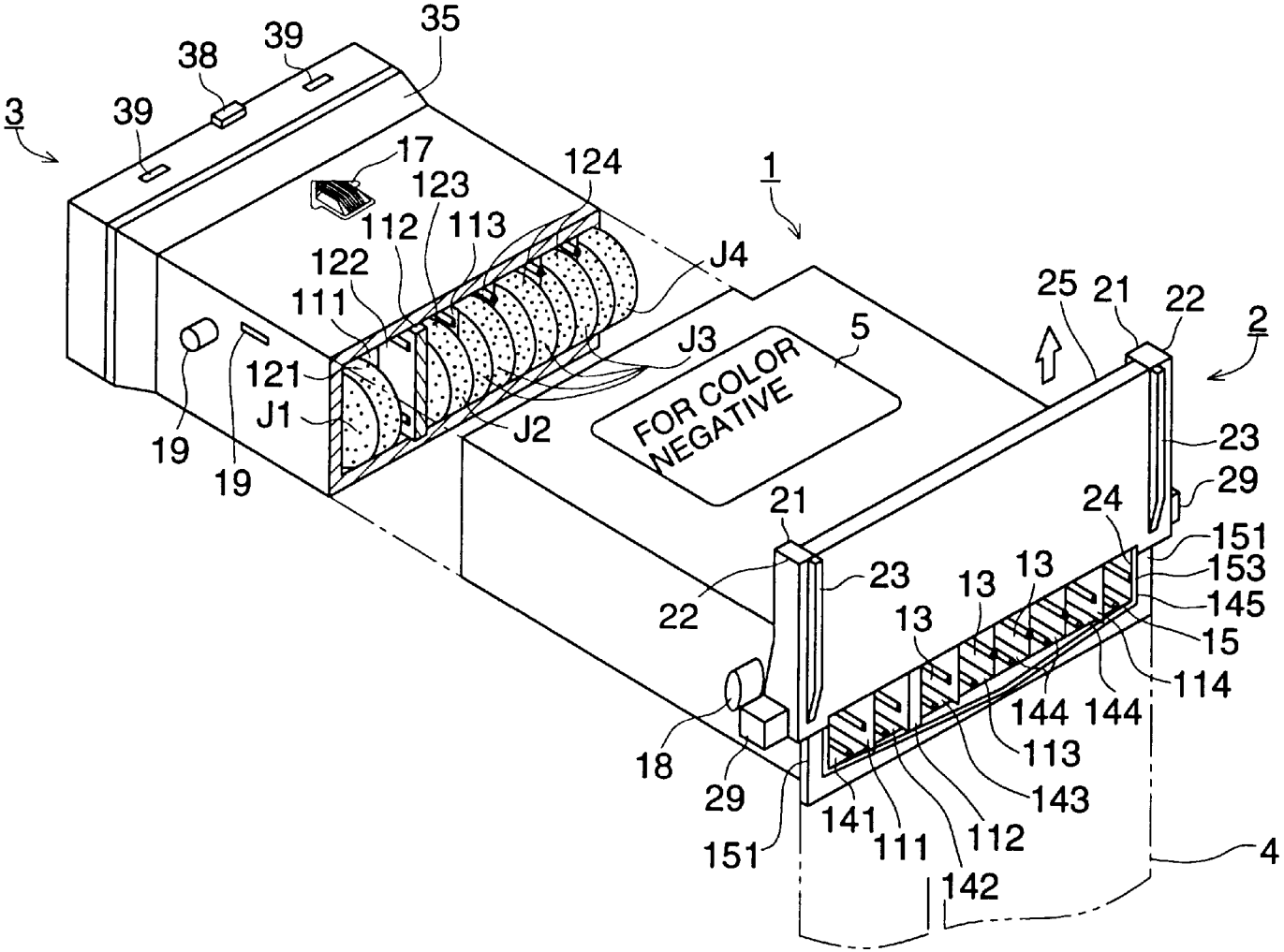
FIG. 3 is a perspective view of the storing container, including a partially broken view.
Figure 4:
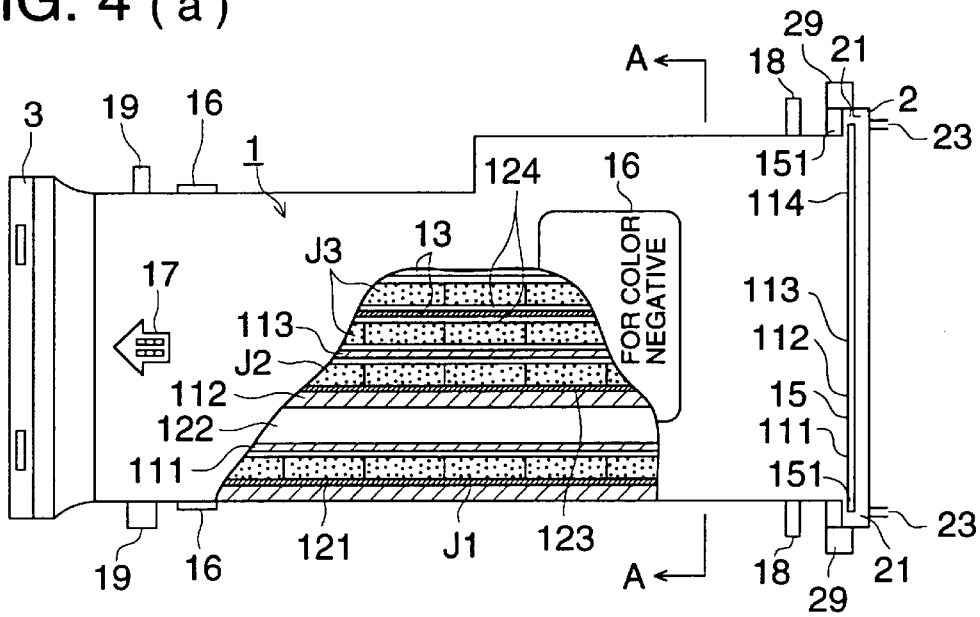
FIG. 4(*a*) is a plan view showing a storing container including a partially broken view.
Figure 4:
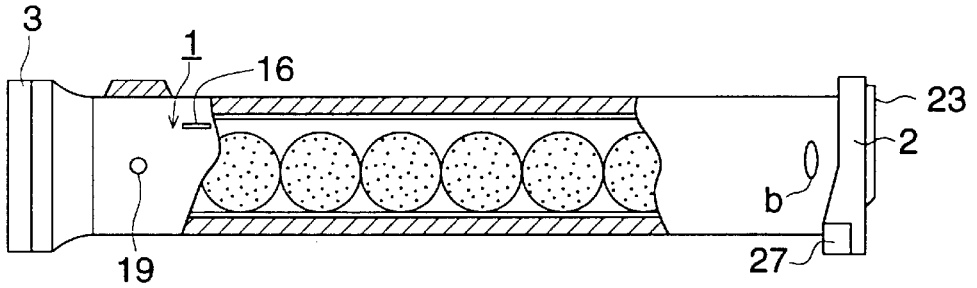
Figure 4:
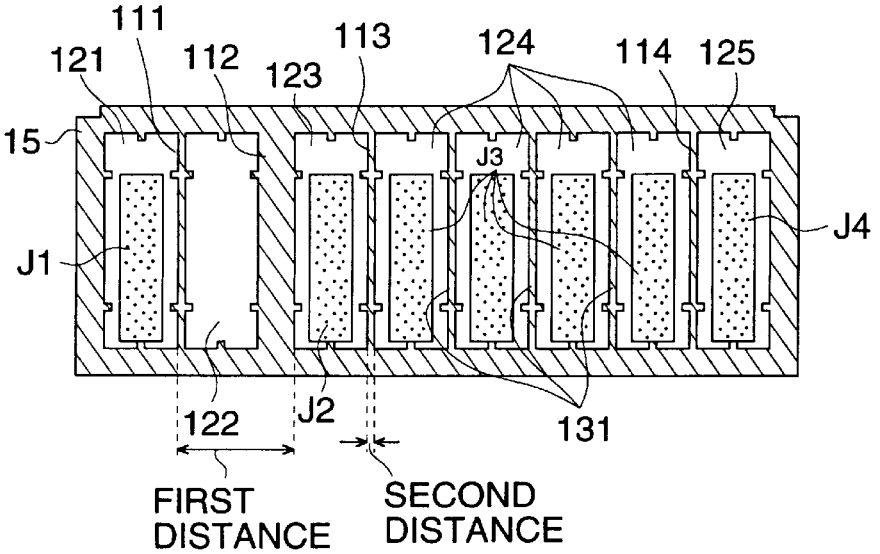
Figure 5:
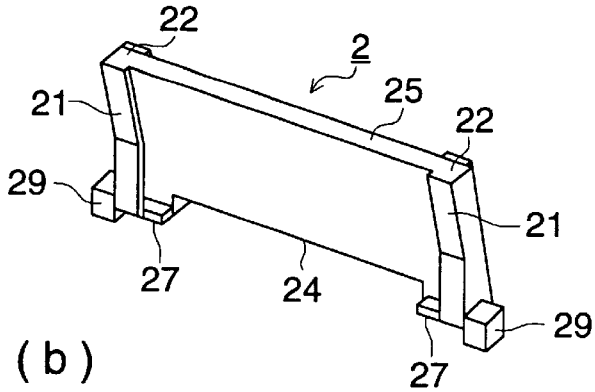
FIG. 5(*a*) is a perspective view of a lid member viewed from a storing chamber side, and FIGS. 5(*b*)–5(*d*) are sectional views typically showing open and close processes of the lid member.
Figure 5:
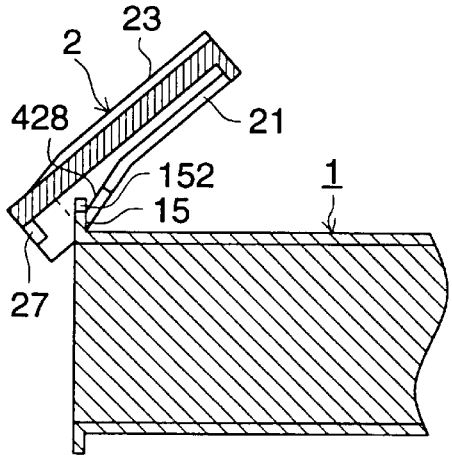
Figure 5:
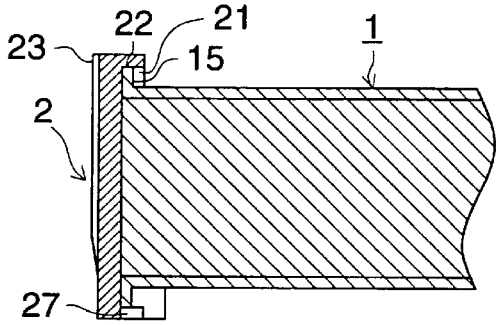
Figure 5:
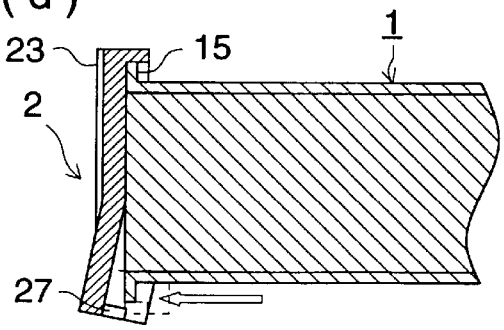
Figure 6:
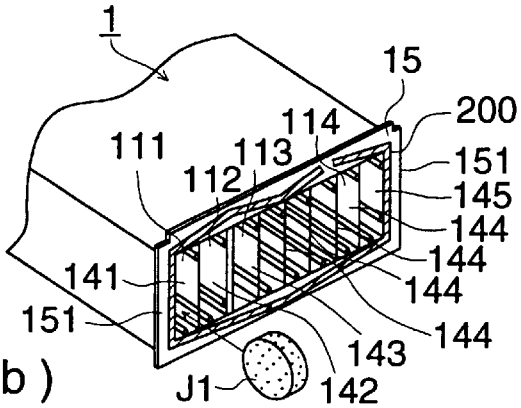
FIGS. 6(*a*)–6(*d*) are perspective views showing accommodating processes of a solid processing agent into the storing container.
Figure 6:
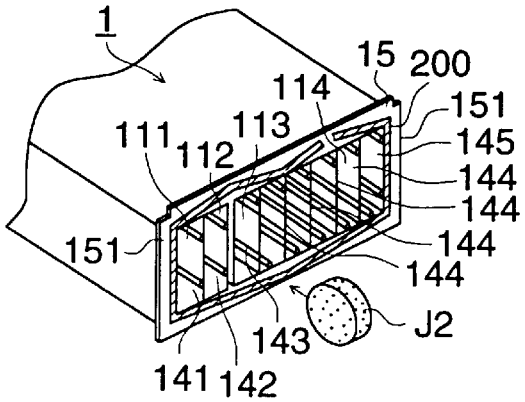
Figure 6:
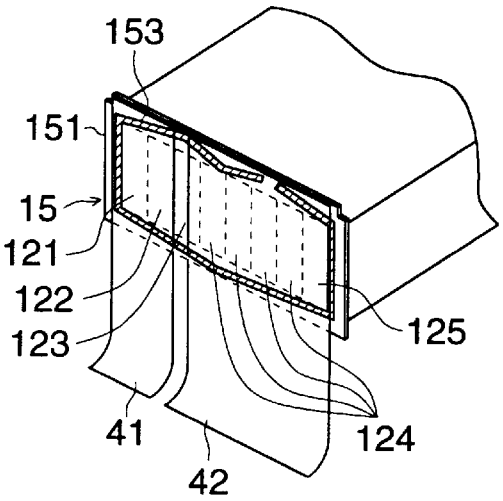
Figure 6:
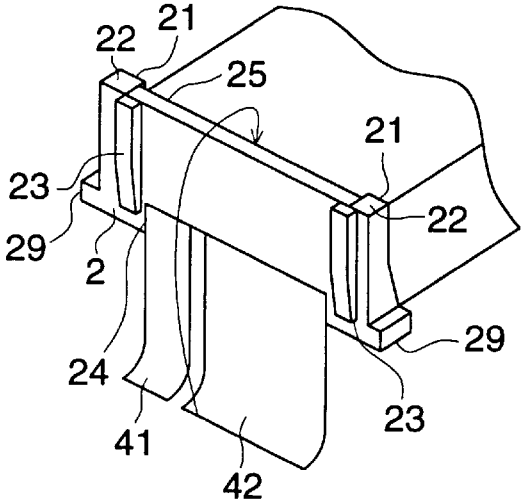
Figure 7:
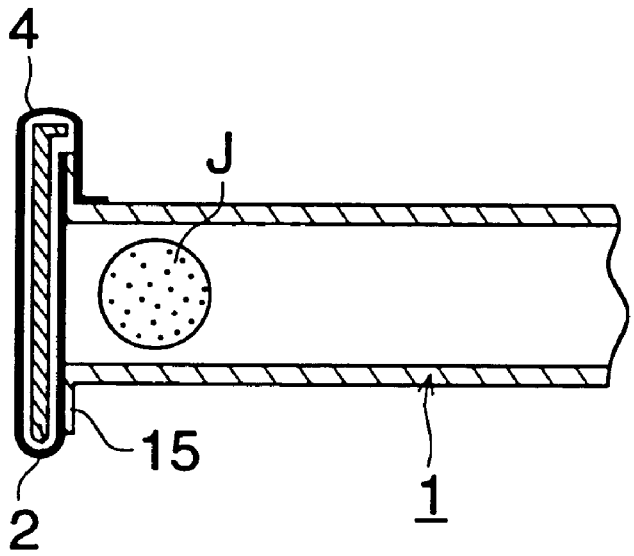
FIGS. 7(*a*) and 7(*b*) are sectional views typically showing open and close processes of the lid member.
Figure 7:
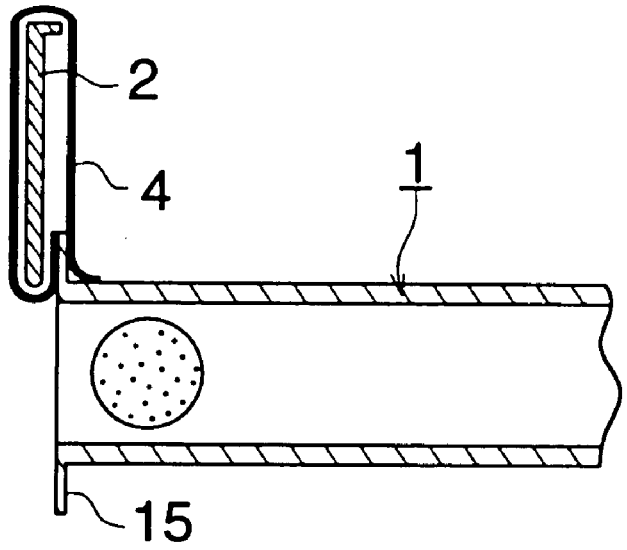

FIG. 1 is a perspective view of respective component parts of the storing container, FIG. 2(*a*) is a front view of the storing container viewed from an opening portion-side, FIG. 2(*b*) is an enlarged sectional view of a protruded stripe portion 153 of a flange portion 15, FIG. 3 is a perspective view of the storing container, including a partially broken view, and FIG. 4 is a view of the storing container, including a partially broken view, in which FIG. 4(*a*) is a plan view, FIG. 4(*b*) is a side view and FIG. 4(*c*) is an enlarged sectional view taken on line A—A of FIG. 4(*a*). FIG. 5(*a*) is a perspective view of a lid member 2 viewed from a storing chamber side, and FIGS. 5(*b*)–5(*d*) are sectional views typically showing open and close processes of the lid member 2. FIGS. 6(*a*)–6(*d*) are perspective views showing accommodating processes of a solid processing agent into the storing container. FIGS. 7(*a*) and 7(*b*) are sectional views typically showing open and close processes of the lid member 2.

Incidentally, the present example relates to a storing container, that is, in the case of color negative film processing, it relates to a storing container to accommodate solid processing agents J1, J2, J3 and J4, which are solidified into processing tablets for each processing of color development, bleaching, fixing, and stabilization. Further, in the present example, the storing container accommodates a quantity of solid processing agents by which color negative film of 100 rolls can be processed (the solid processing agents J1 for color development of 10 tablets, the solid processing agents J2 for bleaching of 10 tablets, the solid processing agents J3 for fixing of 40 tablets, and the solid processing agent J4 for stabilization of 1 tablet are accommodated).

In the case of color paper processing, the present example relates to a storing container to accommodate solid processing agents J'1, J'2, and J'3, which are solidified into processing tablets for each processing of color development, bleaching and fixing, and stabilization.

Further, in the present example, the storing container accommodates a quantity of solid processing agents by which a large number of sheets of color paper (for example, about 2800 sheets of color paper for a size E) can be processed (the solid processing agents J'1 for color development of 10 tablets, the solid processing agents J'2 for bleaching and fixing of 10 tablets, and the solid processing agents J'3 for stabilization of 4 tablets are accommodated).

The storing container has a hollow cylindrical container main body 1 in which the front end side (the side on which a lid member 2 is provided, and the right side in FIG. 4(*a*)) and the rear end side (the side on which a cap member 3 is provided, and the left side in FIG. 4(*a*)) are opened; a lid member (slide-lid) 2 which can cover the front end side of the container main body 1 and can be opened and closed; the cap member 3 to cover the rear end side of the container main body 1; and a flexible seal member 4.

The container main body 1, the lid member 2, and the cap member 3 can be manufactured by an injection molding method using a general molding die, disclosed in Japanese Patent Application No. 149287/1997.

When these container main body 1, lid member 2 and cap member 3 are manufactured by injection molding, as resins to be used in the molding, any resin for injection molding is usable, however, in view of components of the solid processing agents J1–J4 and J'1–J'3, for example, PE (polyethylene), PP (polypropylene), ABS (acrylonitrile-butadiene-styrene), or the like, are used. In the present example, PE or PP is preferably used, and further, because the storing container is formed of thin walls and deep portions, PE and PP materials having high fluidity are preferable.

As the resins having high fluidity, resins prepared by controlling the molecular weight by using metallocene catalyzer are specifically preferable.

Specifically, as PE, material having density of more than 0.951 g/cm$^3$ and the melt flow rate, which is an index of the fluidity, (measured at 216 kgf at 190° C.), of more than 15 g/10 min, is preferable. For example, the following materials are preferable: Sun-tec J-300 (Asahi Chemical Industry), Sun-tec J-310 (Asahi Chemical Industry), Idemitsu Polyethylene 120J (Idemitsu Chemical), Niporon Hard 1000 (Toyo Soda), Niporon Hard 1200 (Toyo Soda), Tiso polyethy (Tiso), Staflene E792 (Nippon Petrochemical Industry), Highzex 1600J (Mitsui Petrochemical Industry), Tonen Polyethylene J6311 (Tonen Petrochemical Industry), and the like.

Further, specifically, as PP, the material having a melt flow rate (measured at 2.16 kgf at 230° C.) of more than 20 g/10 min, is preferable. For example, the following materials are listed: Idemitsu Polypro J-2000G (Idemitsu Petrochemical Industry), Idemitsu Polypro J-3050H (Idemitsu Petrochemical Industry), Idemitsu Polypro J-3083H (Idemitsu Petrochemical Industry), Idemitsu Polypro J-5050H (Idemitsu Petrochemical Industry), Idemitsu Polypro J-3060H (Idemitsu Petrochemical Industry), Ube Polypro J130G (Ube Industries), Ube Polypro J120G (Ube Industries), Ube Polypro J950HK (Ube Industries), Ube Polypro J830HV (Ube Industries), Sumitomo Noblene Z101A (Sumitomo Petrochemical Industry), Sumitomo Noblene AX568 (Sumitomo Petrochemical Industry), Sumitomo Noblene AX574(Sumitomo Petrochemical Industry), Sumitomo Noblene AX674 (Sumitomo Petrochemical Industry), Tiso Polypro K7030 (Tiso), Tiso Polypro K8130 (Tiso), Tonen Polypro J220F (Tonen petrochemical Industry), Tonen Polypro BJ570 (Tonen petrochemical Industry), Tonen Polypro BJ540 (Tonen petrochemical Industry), Tokuyama Polypro MJ170 (Tokuyama Soda), Tokuyama Polypro JSA90 (Tokuyama Soda), Tokuyama Polypro JSA9H (Tokuyama Soda), Mitsui Noblene BJ6H (Mitsui Toatsu Chemical), Mitsui Noblene BJ5H (Mitsui Toatsu Chemical), Mitsui Noblene BJ4H (Mitsui Toatsu Chemical), Nisseki Polypro J170G (Nippon petrochemical Industry), Nisseki Polypro J881M (Nippon petrochemical Industry), and the like.

When above cited resins are used and the lid member 2 is manufactured by injection molding, because the lid member has many thin surface portions, when only one resin injection port (gate) is provided at the time of injection molding, the thickness tends to be uneven, strain remains, and sometimes the surface flatness can not be obtained. In the present invention, in order to avoid this disadvantage, the gate positions are provided at 2 portions on the long side of the lid, thereby, the lid member having the good surface flatness can be obtained.

As a partition member, partition walls 111, 112, 113, and 114 are integrally provided inside the container main body 1, and by these partition walls 111–114 and an external wall of the container main body 1, practically, 5 solid processing agent storing chambers (hereinafter, simply referred to as storing chamber) 121–125 are structured inside the container main body 1. That is, these partition walls 111–114 are plane surface-like, which are continued from the upper surface in the container main body 1 (the surface on the upper side in FIG. 4(*b*)) to the bottom surface (the surface on the lower side in FIG. 4(*b*)), in other words, the upper surface, bottom surface and partition walls 111–114 are connected to each other, thereby, the storing chambers 121–125 are structured so that these chambers do not communicate with each other. Further, the partition walls 111–114 are structured so as to protrude from opening portions 141–145 , which will be described later. Further, the rear end side of the storing chambers 121–124 is opened, however, the opened portion is covered with the cap member 3. Further, the rear end side of the storing chamber 125 is formed such that it is not opened, at the time of resin molding of the container main body 1.

Each of storing chambers 121–125 can accommodate the solid processing agent J in a state of a column.

An example of the solid processing agents accommodated in the storing chambers 121–125 will be described below.

In the case of color film, in 5 storing chambers 121–125, the solid processing agent J1 is accommodated in the storing chamber 121, the solid processing agent J2 is accommodated in the storing chamber 123, the solid processing agent J3 is accommodated in the storing chamber 124 (which is divided into 4 storing chambers), the solid processing agent J4 is accommodated in the storing chamber 125, and the storing chamber 122 does not accommodate the solid processing agent J (hereinafter, the storing chamber 122 is also referred to as the empty chamber).

This is for the following reason: when the component of the solid processing agent J2 for fixing mixes in the solid processing agent J1 for the development, the development performance is badly influenced largely, therefore, some amount of distance is provided between the storing chamber 121 and the storing chamber 123 by providing the empty chamber, thereby, powders containing the component of the solid processing agent J2, generated when the solid processing agent J2 is accommodated or delivered, are prevented from entering into the chamber 121 (so-called contamination is prevented).

In the case of color paper, in 5 storing chambers 121–125, the solid processing agent J'1 is accommodated in the storing chambers 121, 122, the solid processing agent J'2 is accommodated in the storing chamber 124 (which is divided into 4 storing chambers), the solid processing agent J'3 is accommodated in the storing chamber 125, and the storing chamber 123 does not accommodate the solid processing agent (hereinafter, the storing chamber 123 is also referred to as the empty chamber).

This is for the following reason: when the component of the solid processing agent J'2 for bleaching and fixing mixes in the solid processing agent J'1 for the development, the development performance is badly influenced largely, therefore, some amount of distance is provided between the storing chamber 122 and the storing chamber 124 by providing the empty chamber, thereby, powders containing the component of the solid processing agent J'2, generated when the solid processing agent J'2 is accommodated or delivered, are prevented from entering into the storing chambers 121 and 122 (so-called contamination is prevented).

In this connection, in the present example, the storing chambers 121–124 have the length in which 10 tablets of solid processing agents J can be accommodated, in the distance from the front end side to the rear end side of the container main body 1. In this case, 40 tables of solid processing agents for fixing J3, or those for bleaching and fixing J'2, are accommodated in the storing chamber 124, therefore, 3 partition walls 13 are provided so that the inside of the storing chamber 124 is further divided into 4 separated rooms. The partition wall 13 is provided such that it is protruded from the upper surface and the bottom surface in the container main body 1 by the length contactable with the solid processing agent J3 (it is not continuous from the upper surface to the bottom surface). It may be such a partition that the solid processing agent J3 can be accommodated in a form of column. Alternatively, it may also be plate-like, continuous from the upper surface to the bottom surface in the same manner as the partition walls 111–114.

This partition wall 13 is provided such that it does not protrude from the opening portion 144, but the partition wall 13 may also be provided such that it protrudes from the opening portion. Further, the storing chamber 125 may have the length in which the solid processing agent J of one tablet can be accommodated, however, the storing chamber in the present example has the length in which the solid processing agent J of 4 tablets can be accommodated. This is for the reason in which the storing container in the present example is the container which accommodates the solid processing agent J for processing the color negative film, however, in order to use the container also for the storing container for accommodating the solid processing agent J for processing the color paper, the container has the length in which the solid processing agent J of 4 tablets can be accommodated.

Incidentally, the storing chamber 125 may be positioned at any side of the left or the right in the storing container. Further, also in the length of the storing chamber 125, in which the solid processing agent can be accommodated, the number of tablets is not limited to 4.

Further, when the solid processing agent J is hermetically accommodated in the container and transported to photofinishers, or the like, there is a danger that the solid processing agent J is crushed or broken, when walls of the storing chambers in the storing containers, inside surfaces of the cap member, and solid processing agents are hit together by vibrations or similar one. Therefore, in order to prevent the unnecessary movement of the solid processing agents, a vacant space ratio of the storing chamber when the solid processing agents are accommodated in the storing chamber, is determined to be 40–60%.

In this connection, the vacant space ratio is defined herein as follows:

(the overall volume of the solid processing agent accommodated in the storing chamber)/(the capacity of the storing chamber)×100=the vacant space ratio.

Further, in storing chambers 121–125, in order to decrease the contact surface of the solid processing agent J with the inner surfaces of the storing chambers 121–125 so that the solid processing agent j is easily accommodated or delivered, and to prevent the close contact of the accommodated solid processing agent J with the inner surfaces of the storing chambers 121–125, ribs (with no numeric symbol) extending from the front end side of the container main body 1 to the rear end side, are provided respectively on the upper surface, bottom surface, partition walls 111–114 and partition wall 13 in the container main body 1.

Opening portions 141–145 are provided on the front end side of the container main body 1, and the solid processing agent J can be accommodated in the storing chambers 121–125 from the opening portions 141–145, or delivered therefrom. Further, a flat surface-like flange portion 15 is provided around these opening portions 141–145 (the front end side of the container main body 1) such that the flange portion 15 surrounds the opening portions 141–145. Both side end portions 151 of the flange portion 15 is structured such that the side end portions 151 are engaged with the engagement portions 21 of the lid member 2, which will be described later. Further, both sides of the upper end portion of the flange portion 15 have cutout portions 152 which contact with the engagement portions 21 of the lid member 2. Further, the storing chambers 121–124 are structured such that the cap member 3, which will be described later, is engaged with the opened portion of the rear end side thereof.

Further, in the vicinity of the flange portion 15, elliptic column-like protrusions 18 are provided on the left and right sides of the container main body 1 to keep the loading property of the storing container from the replenishing device and the stability of the storing container after the loading.

Further, identifying protruded portions 19 are asymmetrically provided on the left and right sides of the container main body 1 in order to correctly use the solid processing agent for color negative film and the solid processing agent for color paper.

In this connection, the identifying protruded portions 19 may be provided on the cap member 3, or further, may be formed into an engagement type.

Protruded portions for grasping 16 are provided in the vicinity of the identifying protruded portions 19 on the left and right side surfaces of the container main body 1 so that slipping is prevented and the operability is improved when the container main body 1 is grasped by one hand, taken up and handled to load the container main body 1, in which the solid processing agent is loaded, into the replenishing device.

The lid member 2 is a member which can cover the opening portions 141–145, and open and close, by sliding with respect to the opening portions 141–145. Further, the lid member 2 is a member which peels the flexible seal member 4 hermetically sealing the opening portions 141–145 from the opening portions 141–145 by opening the lid member 2. The flexible seal member 4 may be a film-like sheet, however, it may be structured by 2 sheets of separated flexible seal members 41 and 42 as shown in FIGS. 3 and 6.

In order to slide the lid member 2, C-shaped engagement portions 21 which are engaged with the container main body 1 (both side end portions 151 of the flange portion 15), are provided on both side end sides (both end sides in the direction perpendicular to the sliding direction) of the lid member 2. The C-shaped engagement portions 21 are structured such that the gap of C-shape is more increased on the lower end side (the downstream end side with respect to the closing direction) than on the upper end side (the upstream end side with respect to the closing direction).

Further, stoppers 22 are provided on the front end portions (the opposite sides of the periphery of the attached portions of the operation portions 29) of the engagement portions 21.

Further, engagement portions 27 engaged with the lower end surface (with no numeric symbol) of the flange portion 15 are provided so that the lid member 2 is not simply opened (not slid), (refer to FIG. 5). In this connection, operation portions 29 provided on both side surfaces of the lid member 2 are provided so that, when the lid member 2 is slid upward, the engaged condition of the lower end surface of the flange portion 15 with the engagement portions 27 is released, and further, the operation to slide the lid member 2 is conducted.

Further, when the storing container is mounted in the replenishing device, the mounting operation is conducted while the lid member 2 is being slid, and peeling the flexible seal member 4 which hermetically seals the opening portions 141–145, from the opening portions 141–145. In that case, in order to prevent the peeled flexible seal member 4 from being loosened, and thereby, being nipped by the receiving surface of the replenishing device, a cutout portion 24, shown in FIG. 1, is provided on the operation portion 29 side of the lid member 2, and a protruded portion 25 having the same thickness as the flange 15 is provided on the opposite side to portions to which the operation portions 29 are attached, so that a packing member for moisture-proofing 327 (refer to FIG. 15), provided on a replenishing device receiving portion, is not overlapped with the lid member 2.

Ribs 23 are provided in the vicinity of both ends of the surface of the lid member opposite to the surface which comes into contact with opening portions 141–145 of the container main body 1, in order to prevent the flexible seal member 4 from being broken by transportation of the storing container, or the handling operation such as its loading into the replenishing device, or the like.

The cap member 3 covers the opened rear end side of the container main body 1. That is, the cap member is a member to cover the rear end side of the storing chambers 121–124. In the present example, engagement grooves 31–33 engaged with partition walls 111–113 are provided on the inner wall of the cap member 3 opposed to the rear end of the container main body 1 so that powders or small lumps generated from the solid processing agent d accommodated in storing chambers 121–124 do not enter into the storing chambers accommodating other solid processing agents (so-called prevention of the contamination). Further, on the periphery of the inner wall of the cap member 3, an engagement groove 34 to engage with the outer wall (in this case, which is on the rear end side of the container main body 1, and is the periphery of storing chambers 121–124) of the container main body 1 is provided so that dusts, or the like, generated from the solid processing agents J in the storing chambers 121–124, do not go out from the storing container. In this connection, as shown in FIG. 1, by proving protrusions (with no numeric symbols) on the inner surface of the cap member 3 corresponding to respective storing chambers 121–124, the inner surface of the cap member 3 is prevented from closely contacting with the solid processing agent J.

Four recessed portions (claw receiving holes) 39 are formed on both sides of two long sides of the cap member 3, and are engaged with 4 protruded portions (engagement portions with claws) 101 formed on the container main body 1, and snap-fitted.

An identifying portion 38, which is a protruded mark, is provided to correspond to the identifying portion for mark 17 provided on the container main body 1, so that the left and the right are not mistaken when the cap member 3 is engaged with the container main body 1.

Figure 8:
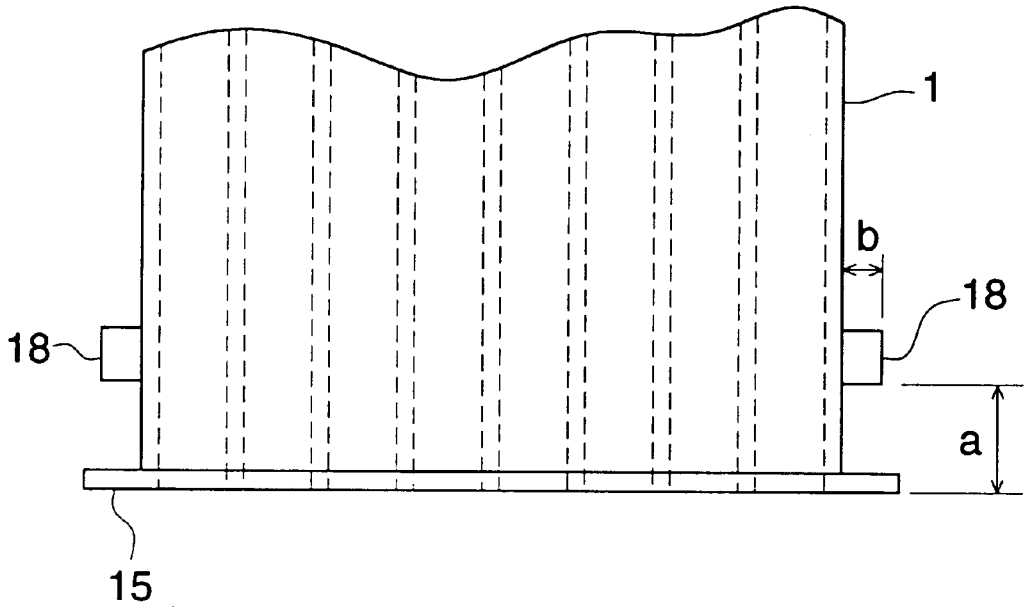
FIG. 8(*a*) is a plan view showing a dimension and an attaching position of an elliptic cylindrical protruded portion provided on the container main body, and FIG. 8(*b*) is a side view thereof.
Figure 8:
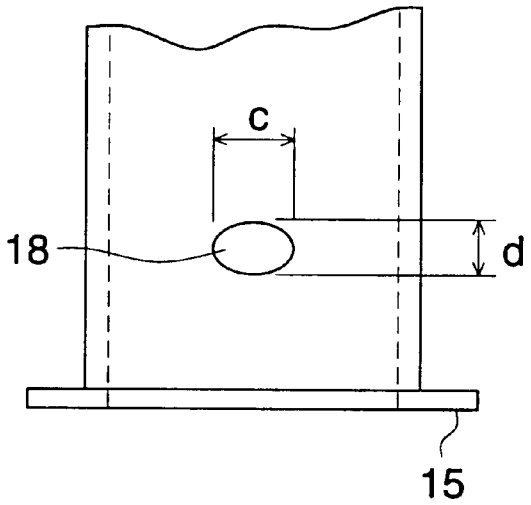

FIG. 8(*a*) is a plan view showing a dimension and an attached position of the elliptic column-like protrusion 18 provided on the container main body 1, and FIG. 8(*b*) is a side view thereof. In FIG. 8, a dimension and an attached position of the elliptic column-like protrusion 18, provided for improvement of the loading property when the storing container of the present invention is loaded into the replenishing device, and for maintaining the stability after the loading, are shown.

In FIG. 8(*a*), "a" shows a distance from the end surface of the flange portion 15 to the side surface of the protrusion 18, and may be 16.5 mm–17.5 mm, which is determined by the relationship with the replenishing device. "b" shows the length of the protrusion 18, and may be within the range of 7.5 mm–9.5 mm, in which, when "b" is not larger than 7.5 mm, the loading property becomes bad, and when it is not smaller than 9.5 mm, the dimension of the replenishing device is larger than needed, which is not preferable. In FIG. 3 (*b*), "c" shows the length in the direction of the long axis of the elliptic column-like protrusion 18, and is set within the range of 4.5 mm–6.5 mm. Further, "d" shows the length in the direction of the short axis of the protrusion 18, and may be within the range of 6.0 mm–8.0 mm. When the length in the direction of the long axis "c" and the length in the direction of the short axis "d" are smaller than the values of the above ranges, the stability is decreased, and when larger than the values of the above ranges, the preparation more than necessary, is needed on the replenishing device side, which is not preferable.

Figure 9:
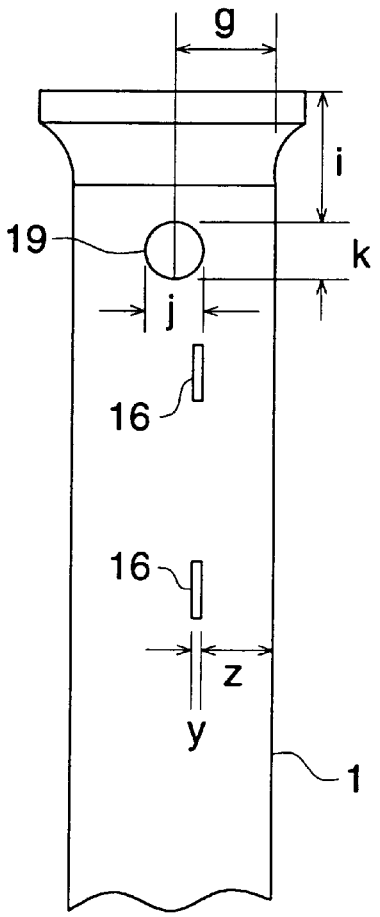
FIG. 9(*b*) is a plan view showing positions of a protruded portion for identification and a convex portion for gripping, attached in the vicinity of a cap member of the container main body, and FIG. 9(*a*) is a side view thereof.
Figure 9:
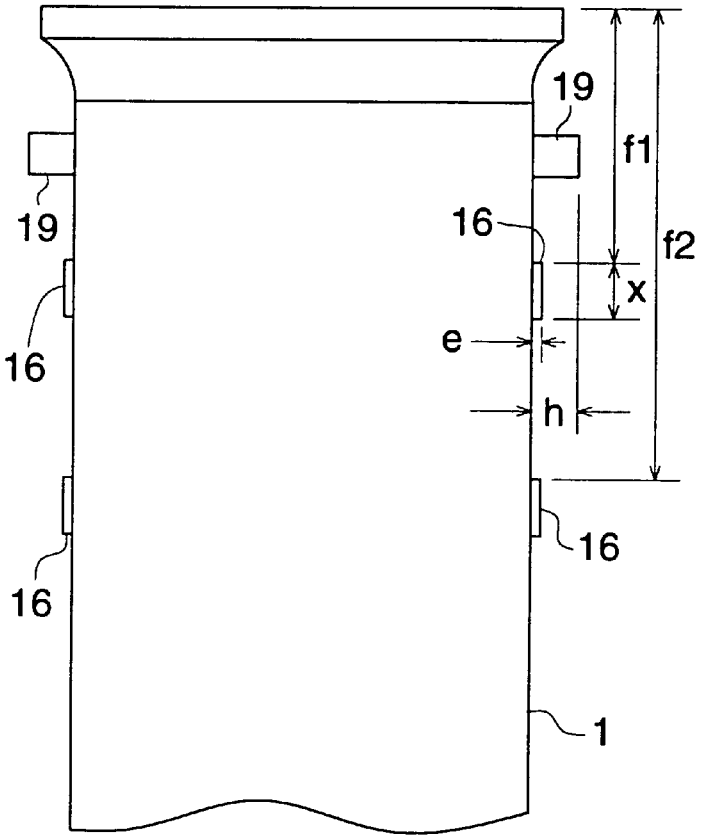

FIG. 9(*a*) is a plan view showing the positions of the identifying protruded portion 19, provided in the vicinity of the cap member 3 of the container main body 1 for identifying the negative film processing agent and the paper processing agent, and the protruded portion for grasping. FIG. 9(*b*) is a side view of the above.

In FIGS. 9(*a*) and 9(*b*), positions of the identifying protruded portion 19 and the protruded portion for grasping 16, provided on the container main body 1, are shown. "h" shown in FIG. 9(*b*) shows the length of the identifying protruded portion 19, and may be within the range of 6 mm–8 mm, and "i" shows the distance from the upper end of the container main body 1, and may be within the range of 23 mm–25 mm.

"j" and "k" shown in FIG. 9(*a*) show diameters of the identifying protruded portion 19, and may be within the range of 4.5 mm–25 mm. When dimensions are smaller than these values, there is a danger that the identifying protruded portion 19 is broken when the storing container is loaded in the replenishing device, and when dimensions are larger than these values, unnecessary preparations are needed on the replenishing device side, which is not preferable.

"g" shown in FIG. 9(*a*) shows the central position of the identifying protruded portion 19, and shows a distance from the center of the identifying protruded portion 19 to the outer wall surface of the container main body 1, and may be within the range of 21 mm–22 mm, which is the position determined by a combination with the replenishing device.

"e" shown in FIG. 9(*b*) shows the height of the protruded portion for grasping 16, and may be within the range of 0.1 mm–1 mm. When it is smaller than the values of that range, the protruded portion for grasping 16 does not perform the function of prevention of the sip when the container main body 1 is grasped, and when it is larger than the values of that range, the protruded portion for grasping 16 will be a hindrance at the time of molding of the container main body 1, and also obstructs the handling operation.

"f1" shows a distance from the upper end surface on the cap member 3 side of the container main body 1 to one end of the first protruded portion for grasping 16, and may be within the range of 60 mm–70 mm. "f2" shows a distance from the upper end surface of the container main body 1 to one end of the second protruded portion for grasping 16, and may be within the range of 140 mm–150 mm. When f1 and f2 are out of these ranges, the balance becomes bad and the operability becomes bad on the contrary, when the container main body 1 is grasped.

"x" shown in FIG. 9(*a*) shows the length of the protruded portion for grasping 16, and may be within the range of 9.0 mm–10.0 mm. "y" shows the width of the protruded portion for grasping 16, and may be within the range of 0.5 mm–1.5 mm. "z" shows the position of the protruded portion for grasping 16, and may be within the range of 13 mm–14 mm from the outer wall surface of the container main body 1.

When x, y, and z are out of the above cited ranges, the balance becomes bad and the operability becomes bad on the contrary, when the storing container is grasped.

In this connection, in order to identify the film processing and the paper processing, it is necessary that the central position of the identifying protruded portion 19 is not changed, and its dimensions on the left and right sides are changed within the range of its values of the dimensions.

Figure 10:
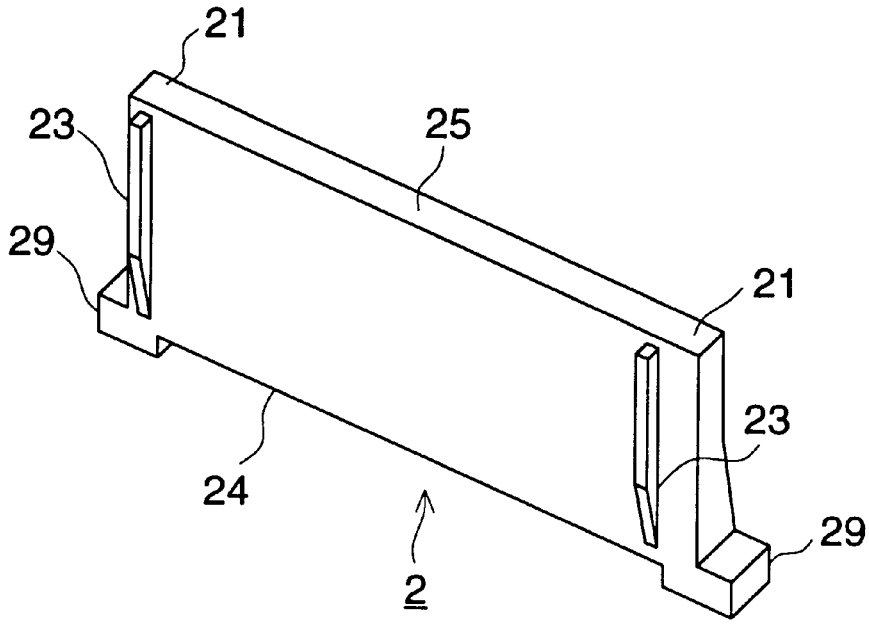
FIG. 10(*a*) is a perspective view, FIG. 10(*b*) is a side view and FIG. 10(*c*) is a front view of the lid member.
Figure 10:
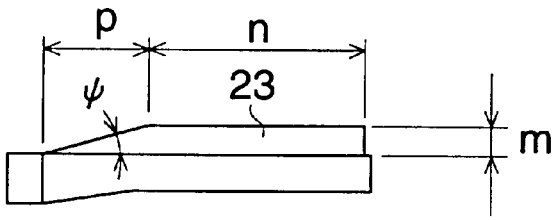
Figure 10:
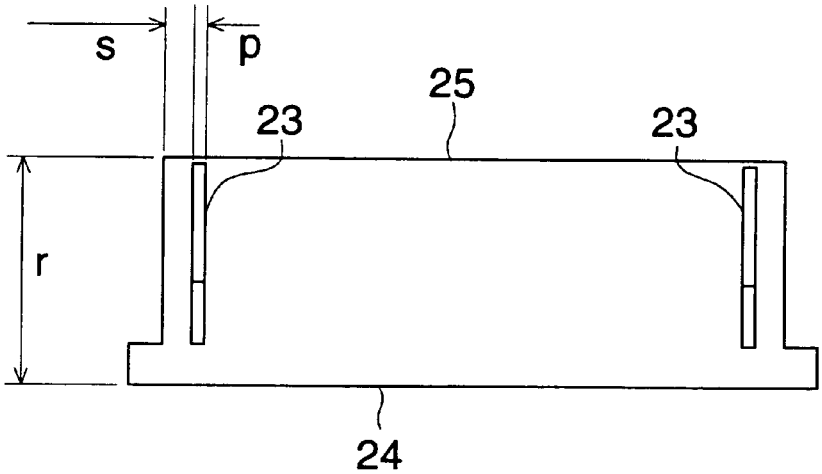

FIG. 10(*a*) is a perspective view of the lid member 2, FIG. 10(*b*) is a its side view and FIG. 10(*c*) is a its front view. FIGS. 10(*b*) and 10(*c*) show the dimension of the rib 23 partially having a slant portion, which is provided on the lid member 2, and the position of the rib 23.

In FIG. 10(*b*), m shows the height of the rib 23, which may be within the range of 0.1 mm–5 mm, n shows the length of a horizontal portion of the rib 23, which may be within the range of 50 mm–60 mm, and p shows the length of a slant portion, which may be within the range of 3 mm–13 mm. An angle $\phi$ shows a slanting angle determined by the relationship between m and p.

In FIG. 10(*c*), q shows the thickness of the rib 23, and may be within the range of 0.1 mm–5 mm.

When the dimension of the rib 23 is smaller than the values of the above cited ranges, the rib 23 is of no use in the protection for the flexible seal member 4, and when the dimension of the rib 23 is larger than the values of the above cited ranges, loading of the storing container into the replenishing device becomes difficult. "s" shows a dimension from the side end surface of the lid member 2 to the end surface of the rib 23 and may be within the range of 0.5 mm–5.0 mm. When the dimension is smaller than that range, a gap exists between the rib 23 and the flexible seal member 42, resulting in a cause for breakage of the flexible seal member 42, which causes the rib 23 to lose the protection function. When the dimension is larger than that range, the width of the flexible seal member 42 is larger than that of the rib 23, and the entire rib 23 is under the flexible seal member 42, which also causes the rib 23 to lose the protection function. That is, it is necessary that the distance between two ribs 23 is approximately equal to the width of the flexible seal member 42.

Next, referring to FIGS. 1 and 2, assembling of the storing chamber and accommodation of the solid processing gent will be described.

(1) Initially, the surface on which an identifying portion 38 as a mark attached onto a long side of the cap member 3 is provided, is made to coincide with an identifying portion 17 as a mark attached onto the container main body 1, and then, the cap member 3 is attached by being engaged with the rear end side of the container main body 1, thereby, the rear end side of the container main body 1, which is opened, is covered.

In this connection, in this case, before the container main body 1 is engaged with the cap member 3 for the attachment, it is necessary that an adhesive agent having long open time, for example, a hot-melt type adhesive agent, is previously coated on the surface with which the attached portion of the container main body 1 and the attached portion of the cap member 3 to the container main body 1 come into contact.

As the hot-melt type adhesive agent having long open time, styrene-isoprene-styrene copolymer resins (trade name Ni-tight HT-474A), etc., are well known. Like this, by adhesion by using the adhesive agent, dusts of powder of the solid processing agent J are perfectly prevented from leaking out from the rear end side of the container main body 1 to the outside, and the moisture-proofing effect of the rear end portion side is obtained.

(2) Next, in the case of color film processing agents, 10 tablets of the solid processing agent J1 for color development are accommodated in the storing chamber 121, 10 tablets of the solid processing agent J2 for bleaching are accommodated in the storing chamber 123, 40 tablets of the solid processing agent J3 for fixing are accommodated in the storing chamber 124 (in this case, every 10 tablets in each separated chamber), and 1 tablet of the solid processing agent J4 for stabilization is accommodated in the storing chamber 125, respectively from opening portions 141, 143, 144, and 145 in each column.

In the case of color paper processing agents, every 10 tablets of the solid processing agent J'1 for color development are accommodated in the storing chamber 121, and in the storing chamber 122, 40 tablets of the solid processing agent J'2 for bleaching and fixing are accommodated in the storing chamber 124, and 4 tablets of the solid processing agent J'3 for stabilization are accommodated in the storing chamber 125, respectively from opening portions 141, 142, 144, and 145 in each column.

Because the solid processing agent J is hygroscopic, when it is accommodated, it is preferable for the solid processing agent J to be accommodated under the condition lower than 55%RH, and further, inactive gases such as nitrogen gas, or the like, can also be supplied. Alternatively, the solid processing agent J may also be coated by a moisture-proofing agent.

Next, the front end portion of the flexible seal member 42 having the length enough to surround the lid member 2 and contact with the lower surface of the flange portion 15, is made to coincide with the edge of the flange portion 15, and thermally adhered to the protruded stripe portions (director for thermal adhesion) 153 of opening portions 141–145 and the periphery of the opening portion, and the opening portions 141–145 are hermetically sealed (refer to FIG. 6(*c*)).

Then, the engagement portion 21 of the lid member 2 is made to engage with the flange portion 15 (both side end portions 151 thereof) of the container main body 1, and the lid member 2 is slid down from above the container main body 1 while being guided thereby, and covers opening portions 141–145. In this connection, when such the lid member 2 is made to slide, it is conducted by operating an operation portions 29 provided on both side surfaces of the lid member 2.

Then, the rear ends of the flexible seal members 41 and 42 are wound such that the lid member 2 is wrapped therein, and are adhered on the lower surface of the flange portion 15 with adhesive double coated tape, or the like, and a loop is formed thereby(refer to FIG. 6(*d*)).

(4) Referring to FIGS. 5(*b*) and 5(*c*), the attaching operation of the lid member 2 will be detailed below. The lid member 2 is placed by pushing onto the upper end side of the flange portion 15 under the condition that the lid member 2 is slant to the surface of the flange portion 15. Then, the lid member 2 is slid downward while being erected and while the engagement portion 21 being engaged with both side end portions 151 of the flange portion 15 and being guided thereby. Specifically, in the present example, the engagement portion 21 is structured such that the C-shaped gap on the lower end side thereof is larger than that on the upper end side, thereby, the attaching operation can be made easier.

Then, when the lid member 2 perfectly covers opening portions 141–145, the engagement portion 27 of the lid member 2 is engaged with the lower end surface of the flange portion 15, thereby, the lid member 2 is in so-called locked condition so that the lid member 2 is erroneously slid upward.

(5) After that, a label 5 showing the name of manufacturer, and the kind of solid processing agent J to be accommodated, is adhered on the storing container in which the solid processing agent J is accommodated (in the present example, on the upper surface side of the outer wall of the container main body 1). The label 5 is made of the same material as that of the container main body 1 (preferably, also as that of the lid member 2 and the cap member 3), by considering the recycle of the storing container. That is, when the container main body 1, which is a member onto which the label 5 is adhered, and the label 5 are formed of the same material, these are not disused as industrial wastes, but can be recycled, and further, when recycled, these can be used without peeling off the label, thereby, the recycle operation can be efficiently conducted.

Next, delivery of the sol id processing agent J from the storing container will be described. In this case, the lid member 2 may be slid upward, however, because the engagement portion 27 is engaged with the lower end surface of the flange portion 15, it can not be slid uprightly. Therefore, as shown in FIG. 5(*d*), the operation member 29 is pushed once toward the front end side (the direction of an arrow), thereby, the lid member 2 is bent, and the engaged condition of the engagement portion 27 with the lower end surface is released.

In this case, the engagement portion 21 is structured such that the C-shaped gap on the lower end side thereof is larger than that on the upper end side, thereby, the releasing operation can be easily carried out. Then, under the condition that the engaged condition of the engagement portion 27 with the lower end surface is released, the operation member 29 is pushed upward, thereby, the lid member 2 is slid upward, then, opening portions 141–145 are released, and the solid processing agents (J1–J4 for color film, J'1–J'3 for color paper) are delivered respectively from the opening portions 141–145.

Incidentally, in the present example, in the case of color film processing agents, the storing chamber 122 in which the solid processing agent is not accommodated, is provided between the storing chamber 123 in which the solid processing agent for bleaching J2 is accommodated, and the storing chamber 121 in which the solid processing agent for color development J1 is accommodated, therefore, the distance between the storing chamber 121 and the storing chamber 123 can be kept long, thereby, contamination can be prevented.

In the case of color paper processing agents, the storing chamber 123 in which the solid processing agent is not accommodated, is provided between the storing chamber 124 in which the solid processing agent for bleaching and fixing J'2 is accommodated, and the storing chambers 121 and 122 in which the solid processing agent for color development J'1 is accommodated, therefore, the distance between the storing chambers 121,122 and the storing chamber 124 can be kept long, thereby, contamination can be prevented.

Further, engagement grooves 31–34 provided on the inner surface of the cap member 3 are engaged with partition walls 111–113, and the outer wall of the container main body 1, and the cap member 3 covers the opened portion on the rear end side of the container main body 1, thereby, contamination from the rear end side of the container main body 1, and further, delivery of the powder dust to the outside can be prevented.

As shown in FIGS. 2, 6 and 7, the solid processing agent delivery opening side of the storing container is structured by opening portions 141–145; a container main body 1 having a flange portion 15 provided in a manner extending from the periphery of the opening portions 141–145; flexible seal members 41 and 42 which cover the opening portions 141–145 and are adhered onto the flange portion 15; and a lid member 2 covering the opening portions 141–145. The storing container is structured such that the flexible seal member 42 is peeled by the movement of the lid member 2 in the direction to be opened.

The protruded stripe portion 153 for thermal adhesion is provided on a portion, onto which the flexible seal member 4 is adhered, of the flange portion 15 of the container main body 1 such that opening portions 141–145 are surrounded. Further, partition walls 111, 112, 113 and 114 to separate storing chambers 121, 122, 123 and 124, are protruded to the same height as the protruded stripe portion 153, and the flexible seal members 41 and 42 are adhered onto the protruded stripe portion 153.

On the protruded stripe portion 153, a cutout portion 154 (refer to FIG. 2) to release gases, generated from solid processing agents J1–J4 accommodated in storing chambers 121–125, from the container main body 1 is provided. As the position of the cutout portion 154, although it is necessary to be set at a different position depending on the solid processing agent to be used, for example, in the present example, the cutout portion is provided at a position corresponding to the storing chamber 124. The width of the cutout portion 154 is allowable when it is approximately 0.2 mm–1.0 mm, because it is used for only releasing gasses.

FIG. 6(*c*) shows the vicinity of the opening of the storing container for color paper processing agent. In this case, the storing chambers 121 and 122 are hermetically sealed by the flexible seal member 41, the storing chambers 124 and 125 are hermetically sealed by the flexible seal member 42, and the storing chamber 123 in which no solid processing agent is accommodated, is excepted because no sealing is necessary. When the flexible seal member 4 is divided and formed into flexible seal members 41 and 42 (hereinafter, generally referred to as the flexible seal member 4), the opening operation of the lid member 2 becomes easy. In also the case of color film processing agent, in the same manner as the above, storing chambers are sealed by the flexible seal member 4 except the storing chamber 122 in which no solid processing agent is accommodated.

When a protruded stripe portion for thermal adhesion (hereinafter, referred to as the protruded stripe portion) 153 is provided on a portion, onto which the flexible seal member 4 is adhered, of the flange portion 15 such that opening portions 141–145 are surrounded, the strength of the flange portion 15 is increased, thereby, the shock-proof property and recycle aptitude of the storing container are increased and the thin walled and thick walled formation is possible.

Further, as shown in FIG. 2(*b*), the height H of the protruded stripe portion 153 is 0.4–1.2 mm, the width W of the protruded stripe portion 153 is 0.3–3.0 mm, the protrusion angle $\theta_1$–$\theta_3$ is 5–30°, the flatness of the protruded stripe portion 153 is not more than 0.3 mm, and the peeling force of the flexible seal member 4 (to polyolefin) is 0.5–5.0 kg.

By pushing the flexible seal member 4 to the surface of the protruded stripe portion 153 of the flange portion 15 of the container main body 1 and applying heat thereto, a sealant layer of the flexible seal member 4 is fused, and adhered to the protruded stripe portion 153. That is, by providing the protruded stripe portion 153 on the flange portion 15 of the container main body 1, the flexible seal member 4 is adhered only to the portion of the protruded stripe portion 153, therefore, the desired seal property can be obtained.

It is necessary that the flatness of the protruded stripe portion 153 is not more than 0.3 mm. Because heat is applied at the time of adhesion, a protruded portion 200 of the flange portion 15 of the container main body 1 is also crushed by the heat simultaneously with fusing of the sealant layer, thereby, uniform adhesion property can be obtained. The crushed amount is preferably not more than 0.3 mm, and when more than that value, partially over fusing occurs. Therefore, when the flexible seal member 4 is peeled, sometimes a remaining amount of the sealant layer at the time of peeling, or the peeling force is too large, thereby, there is hindrance when the accommodated processing agent is taken out. The height H of the protruded stripe portion 153 is 0.4–1.2 mm, preferably 0.6–1.2 mm. When the height H of the protruded stripe portion 153 is not more than 0.4 mm, the protruded stripe portion 153 is crushed at the time of sealing as described above, and therefore, sometimes portions other than the protruded stripe portion 153 are sealed, which is not preferable.

Further, when height H of the protruded stripe portion 153 is larger than 1.2 mm, recessed portions due to shrinkage are conspicuous on a portion of the protruded stripe portion 153, and insufficient sealing portions are partially generated, thereby, the strength/moisture-proofing property is deteriorated.

An averaged width W of the protruded stripe portion 153 is preferably 0.3–3 mm, and when it is not larger than 0.3 mm, the moisture-proofing property by sealing becomes insufficient. Further, when dropping occurs during transportation, the flexible seal member 4 is peeled, and when it is not smaller than 3 mm, the peeling force is too large to maintain the easy setting property.

An important matter in the easy setting is initial and final peeling operations, and that is attained by selecting the protrusion angle $\theta_1$–$\theta_3$ to be 5–30°. When the protrusion angle $\theta_1$–$\theta_3$ is not larger than 5°, the peeling force becomes too large, and when the protrusion angle $\theta_1$–$\theta_3$ is not smaller than 30°, a dimension of the flange portion 15 becomes too large, thereby, the compactness of the system is disadvantageously influenced. When the peeling force of the flexible seal member 4 is set to 0.5–5 kg corresponding to the flexible seal member 4, the height of the protruded stripe portion, the width of the protruded stripe portion, and the angle of the protruded stripe portion, the storing container in which easy setting property is maintained and the adhering strength is excellent, can be provided, and the sealing property with the excellent moisture-proofing property and stability, can be obtained.

In the flexible seal member 4, the structure of the seal material is as follows: PET (polyethylene terephthalate)/Al (aluminum)/PE (polyethylene)/sealant; NY(direct chain aliphatic polyamide, Nylon)/Al/PE/sealant, PET/Al/PET/sealant, or NY/Al/PET/sealant. The stiffness of the seal member is 10–40 g, and the seal member has the excellent pinhole-proofing property and moisture-proofing property, and has no unnecessary thermal adhering portion except the protruded portion, and the excellent conveying property in the machine. The thickness of the sealant is preferably 20–100 $\mu$m, in consideration of the sealing property and moisture-proofing property. Here, in the present invention, the stiffness was measured by the loop stiffness tester manufactured by Toyo Seiki Seisakusho.

The storing container is structured as follows: the solid processing agents (J1–J4 or J'1–J'3) are accommodated from opening portions 141–145 of the container main body 1, and the flexible seal member 4 seals the storing container such that the inside of the storing container is under a little vacuum condition at normal temperature of 23° C.

As a method in which the inside of the storing container is in a little vacuum condition at normal temperature of 23° C., there is a method, which is attained by the following: sealing is conducted under a little vacuum environment, or under the condition that temperature of the air inside the storing chamber at the time of sealing is 50–60° C. According to the above description, the flexible seal member 4 of the storing container is always pushed against the storing container under the normal environment, thereby, peeling of the seal member due to the air expansion in the storing chamber is prevented even under the high temperature environment, and deterioration of the processing agent by the entry of fine dusts of different kinds of solid processing agents and gasses generated from the solid processing agents, is prevented.

Of course, the container main body 1 and the cap member 3 are hermetically attached to each other.

When the lid member 2 is attached onto the container main body 1, the flexible seal member 4 is formed loop-like in such a manner that the seal member 4 winds around the lid member 2. Accordingly, the flexible seal member 4 is structured such that it is peeled from the protruded stripe portion 153 as the lid member 2 is slidingly moved.

Next, relating to the assembly of the storing container and accommodation of the solid processing agent J, the case of the color film processing agent will be detailed.

(1) Initially, engagement grooves 31–34 of the inside of the cap member 3 are made to respectively engage with partition walls 111–113, and the outer wall of the container main body 1; a hot-melt adhesive agent is coated; and on the rear end side of the container main body 1, the cap member 3 is attached by engaging the protruded portion (engagement claw portion) 101 provided on the container main body 1 with the recessed portion (claw receiving hole) 39 provided on the cap member 3, and the cap member 3 covers the opened rear end side of the container main body 1.

(2) The solid processing agent J1 for color development is accommodated from the opening portion 141 in the storing chamber 121 in a column (FIG. 6(*a*)).

(3) When the solid processing agent J1 of 10 tablets has been accommodated, other solid processing agents J2–J4 are respectively accommodated from opening portions 143–145 in storing chambers 123–125 in each column (FIG. 6(*b*)).

(4) When all of solid processing agents J2–J4 have been accommodated in storing chambers 123–125, the flexible seal member 4 is sealed around the opening portions 141–145 (on the front end surface of the flange portion 15 and the front end surface of the partition walls 111–114) in such a manner that the end portion of the belt-like flexible seal member 4 is positioned on the upper side of the front end surface of the flange portion 15 (the upper side in FIG. 6(*c*)), (refer to FIG. 6(*c*)).

In this case, the leading edge of the flexible seal member 4, which is to be peeled, (the lower side in FIG. 6(*c*)) is sealed in a hill-like form. In this connection, in FIG. 6(*c*), a slanting line portion shows a sealing portion of the flexible seal member 4 on the protruded stripe portion 153.

In the present example, the thickness of the partition wall 112 is made larger so that the flexible seal member 4 can be sufficiently sealed.

(5) When all of opening portions 141–145 are sealed with the flexible seal member 4, the engagement portion 21 of the lid member 2 is made to engage with both side end portions 151 of the flange portion 15 of the container main body 1, and while being guided, the lid member 2 is made to slide down from above the container main body 1.

In the manner as described above, by sliding the lid member 2, the lid member 2 covers opening portions 141–145 through the flexible seal member 4 (refer to FIG. 6(*d*)). Then, the other end of the first flexible seal member 41, and the other end of the second flexible seal member 42 are fixedly adhered onto the surface on the side opposite to the front end surface (the rear end surface) of the flange portion 15, and the flexible seal members 41 and 42 wind around the lid member 2 and are formed like a loop (refer to FIG. 7(*a*)).

(6) After that, the label 5 which is a member to be adhered and formed of the same material as the container main body 1, is adhered onto the upper surface of the outer wall of the container main body 1, and thus the assembly of the storing container and accommodation of the solid processing agent J are completed.

In the case where the solid processing agent J is delivered from the storing container, when the operation member 29 is pushed once toward the direction of the front end side, and then, pushed upward, the lid member 2 is slid upward. In this case, because the other end of the flexible member 4 is fixedly adhered onto the flange portion 15, as the lid member is slid upward, the flexible seal member 4 wound around the lid member 2 is moved by being pulled by the lid member 2, and the sealing portion is peeled (refer to FIG. 7(*b*)). Thus, opening portions 141–145 are released, and solid processing agents J1–J4 can be delivered from the opening portions 141, 143, 144 and 145.

As described above, in the present example, the flexible seal member 4 to seal the opening portions 141–145 is provided, thereby, contamination can be prevented, and further, the flexible seal member 4 is peeled following the slide of the lid member, thereby, the operability is improved when the solid processing agent J is delivered.

In this connection, in the present example, the opening portions 141–145 of all of storing chambers 121–125 are sealed by the flexible seal member 4, however, at least, only the opening portion 141 of the storing chamber 121, in which the solid processing gent J1 for color development having a large contamination problem is accommodated, may be sealed.

Further, in the present example, the lid member is structured such that the lid member 2 covers opening portions 141–145 through the flexible seal member 4, thereby, the force from the outside is prevented by the lid member 2, and breakage of the flexible seal member 4 or damage of the solid processing agent J by the force from the outside can be prevented.

Further, in the present example, the flexible seal member 4 is formed into a loop, thereby, the seal member is peeled following the slide of the lid member 2, and further, when the lid member 2 is closed again, the flexible seal member 4 is moved following the lid member 2, and covers the opening portions 141–145.

Accordingly, when the solid processing agent J is accommodated, although fragments or powders of the solid processing agent J generated during transportation adhere to the flexible seal member 4, the fragments or powders adhered to the flexible seal member 4 are not scattered to the outside when the lid member 2 is closed again.

Incidentally, in the present example, because the flexible seal member 4 is formed loop-like, both ends of the belt-like flexible seal member 4 are respectively fixedly adhered (or sealed) onto the front end surface and the rear end surface of the flange portion 15, however, both ends may be fixedly adhered (or sealed) onto either one of the front end surface or the rear end surface of the flange portion 15 and formed loop-like, and further, may be formed into a perfect loop in which both ends of the flexible seal member 4 are fixedly adhered to each other.

Although, in the present example, the flexible seal member 4 is formed loop-like such that it surrounds the lid member 2, the present invention is not limited to that, but this system may be structured such that the seal of the flexible seal member 4 is peeled following the slide of the lid member 2.

Further, in the present example, the solid processing agent J1 for color development processing is accommodated in the storing chamber 121 from the opening portion 141, and other solid processing agents J2–J4 are accommodated in respective storing chambers 123–125, therefore, powders of other solid processing agents J2–J4 do not enter into the storing chamber 121 in which the solid processing agent J1 for color development, which causes a conspicuous contamination problem, is accommodated.

Figure 11:
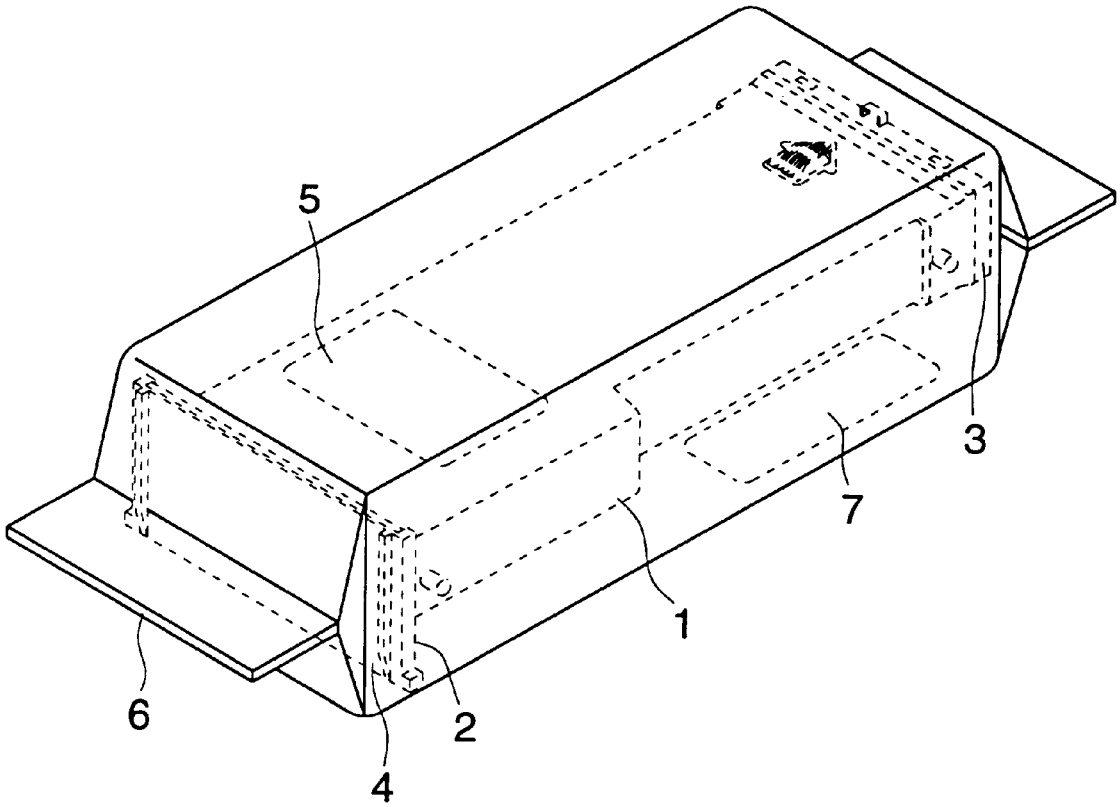
FIG. 11 is a perspective view showing a packing form of the storing container.

Further, as described above, in order to remove gasses generated from the solid processing agent, absorbents are put in a paper bag or cloth bag, and a package as shown in FIG. 11 may be formed. FIG. 11 is a perspective view showing a form of a package of the storing container.

In FIG. 11, numeral 6 is a package body (barrier bag) in which the storing container is hermetically sealed for the moisture-proof, and numeral 7 is an absorbent bag in which an absorbent is accommodated in the package body 6 together with the storing container.

The package body 6 is formed of a laminated material of an aluminium foil and film-like resins (polyethylene terephthalate, polyamide, polyethylene, etc.), or a laminated material of a plurality of kinds of resin films, and is formed of a thin film material having the moisture-proofing property, chemical resistance, and necessary strength.

As an example of materials used for the package body 6, a laminated material structured of a polyethylene terephthalate layer, an aluminimum foil layer, a polyamide layer, and an adhesive agent layer, is used.

Further, as a moisture-proofing material which is used for the package body 6 and easily opened, a 5-layer composition film, composed of a stretching nylon (polyamide) layer, a polyethylene layer, an aluminium foil layer, a polyethylene layer, and a linear low density polyethylene layer, is preferable. As another example of a moisture-proofing material which is used for the package body 6 and easily opened, a 5-layer composition film, composed of a stretching nylon (polyamide) layer, an adhesive agent layer, an alumina oxide type vacuum evaporation polyethylene terephthalate layer, a polyethylene layer, and a linear low density polyethylene layer, is preferable.

As an absorbent enclosed in the absorbent bag 7, a commonly used absorbent such as active carbon, silica gel, zeolite, etc., can be used. For example, as an absorbent sold in the market, Secard D, k-3, k-1, OW, H-15, KW, BW, BMW, SP, BK-3, etc., by Shinagawa Chemical Co., may be used.

Figure 12:
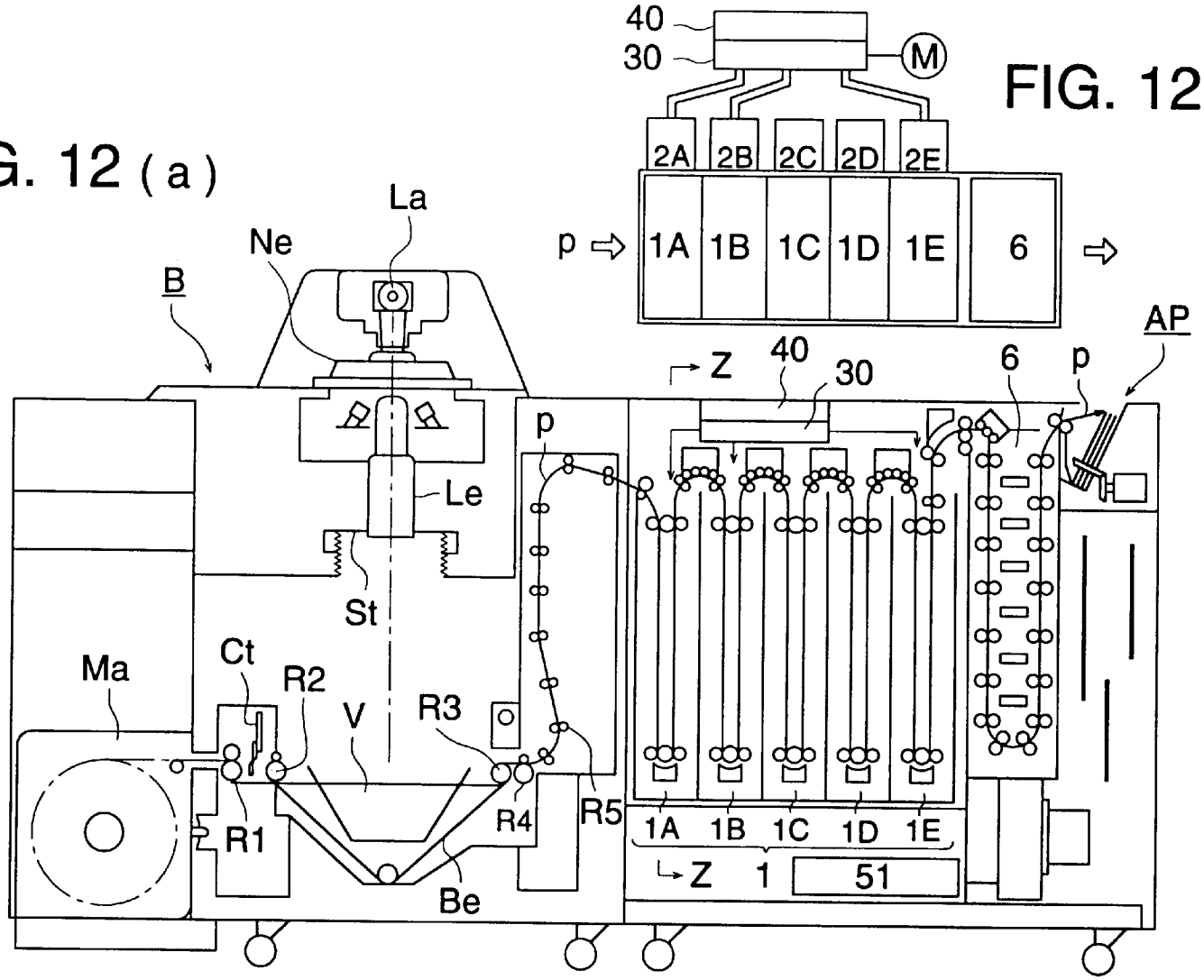
FIG. 12(*a*) is a front-side view of an overall structure of the photosensitive material processing device according to the present invention, and FIG. 12(*b*) is a plan view of the structure.

Next, referring to the drawings, an example of an automatic developing device (hereinafter, simply called also automatic processor) to which the above cited solid processing agent storing container of the present invention can be applied, will be described. FIG. 12(*a*) is a front side overall structural view of a silver halide photographic photosensitive material processing device (printer processor) in which the automatic processor AP and a photographic printing machine B are integrally structured.

In FIG. 12(*a*), a magazine Ma, in which roll-like printing paper (color paper) which is an unexposed silver halide photographic photosensitive material, is accommodated, is set in the left lower portion of the photographic printing machine B. The printing paper in the magazine Ma is pulled out by a predetermined length by a feed roller R1, cut by a cutter section Ct into a predetermined size, and formed into sheet-like printing paper p. The sheet-like printing paper p is conveyed by a feed roller R2, and moved to a exposure position while being sucked by a rotating conveying belt Be and a vacuum means V provided lower the conveying belt Be, stops and stands by.

An original image is exposed on the sheet-like printing paper p through a negative film set on a negative film carrier Ne by a light source section La, a lens Le, and a shutter St. When the exposure has been completed, the sheet-like printing paper p is conveyed again by the conveying belt Be, further conveyed by the feed rollers R3, R4 and plural pairs of feed rollers R5, and introduced into the automatic processor AP.

In the automatic processor AP, the sheet-like printing paper p is successively conveyed in a color development tank 1A, bleaching and fixing tank 1B, and a stabilizing tanks 1C, 1D, 1E, which are respectively processing tanks, (practically, a 3-tank composition processing tank 1) by a roller conveying means (with no reference symbol), and respectively color development processed, bleaching and fixing processed, and stabilizing processed. The sheet-like printing paper p processed as described above, is dried in a drying section 6, and delivered outside the processor.

Further, the sheet-like printing paper p is introduced into the automatic processor AP in a form of a cut sheet, however, the printing paper may be introduced into the automatic processor in a belt-like form.

Of course, the automatic processor AP according to the present invention may be integrally structured with the photographic printing machine B, or may be structured by only the automatic processor AP itself. Further, the present invention is described about the automatic processor AP having practically the processing tank 1 of 3-tank composition composed of the color development tank 1A, bleaching and fixing tank 1B and the stabilizing tanks 1C, 1D, 1E, as a description, however, the present invention is not limited to that, but the present invention can be applied also to an automatic processor having a processing tank of a practically 4 or more tank composition composed of the color development tank, the bleaching tank, the fixing tank, and stabilizing tank, in which exposed negative film is processed.

FIG. 12(*b*) is a structural plan view of the automatic processor AP. Auxiliary tanks 2A, 2B, 2C, 2D, 2E are connected to the processing tanks of the color development tank 1A, bleaching and fixing tank 1B and the stabilizing tank 1E. Solid processing agents are supplied from the solid processing agent replenishing device (hereinafter, referred to as the replenishing device) to the auxiliary tanks 2A, 2B, and 2E. Numeral 40 is the solid processing agent storing container (cartridge, hereinafter referred to as storing container) which is detachably mounted to the replenishing device 30.

Numeral 51 is a replenishing water tank to supply replenishing water to the color development tank 1A and the stabilizing tank 1E.

Figure 13:
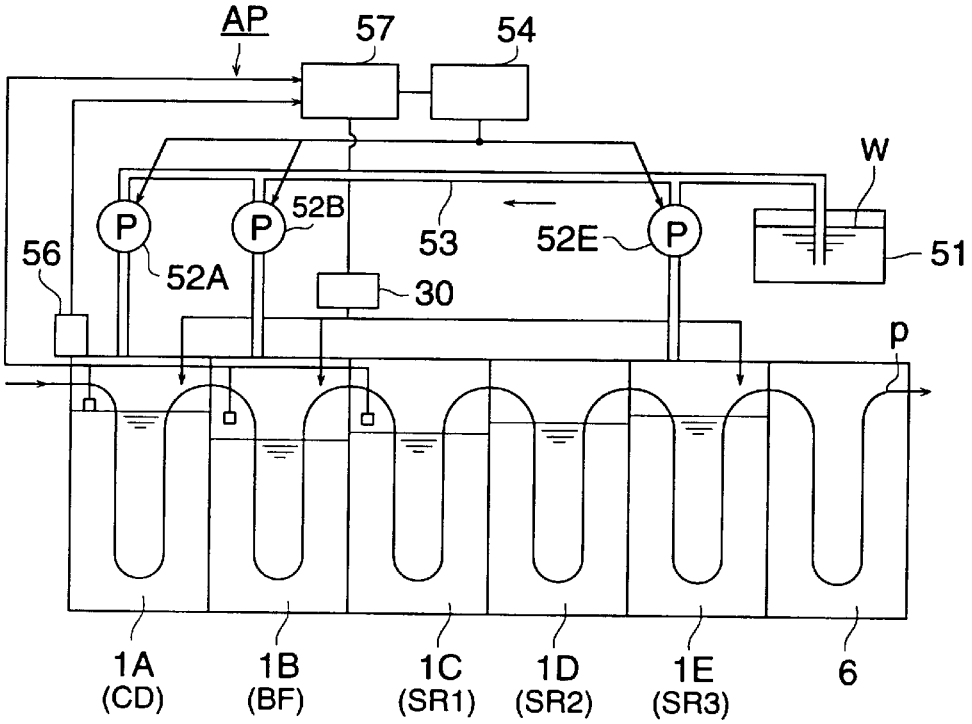
FIGS. 13(*a*) and 13(*b*) are views of the structure of an automatic processor.
Figure 13:
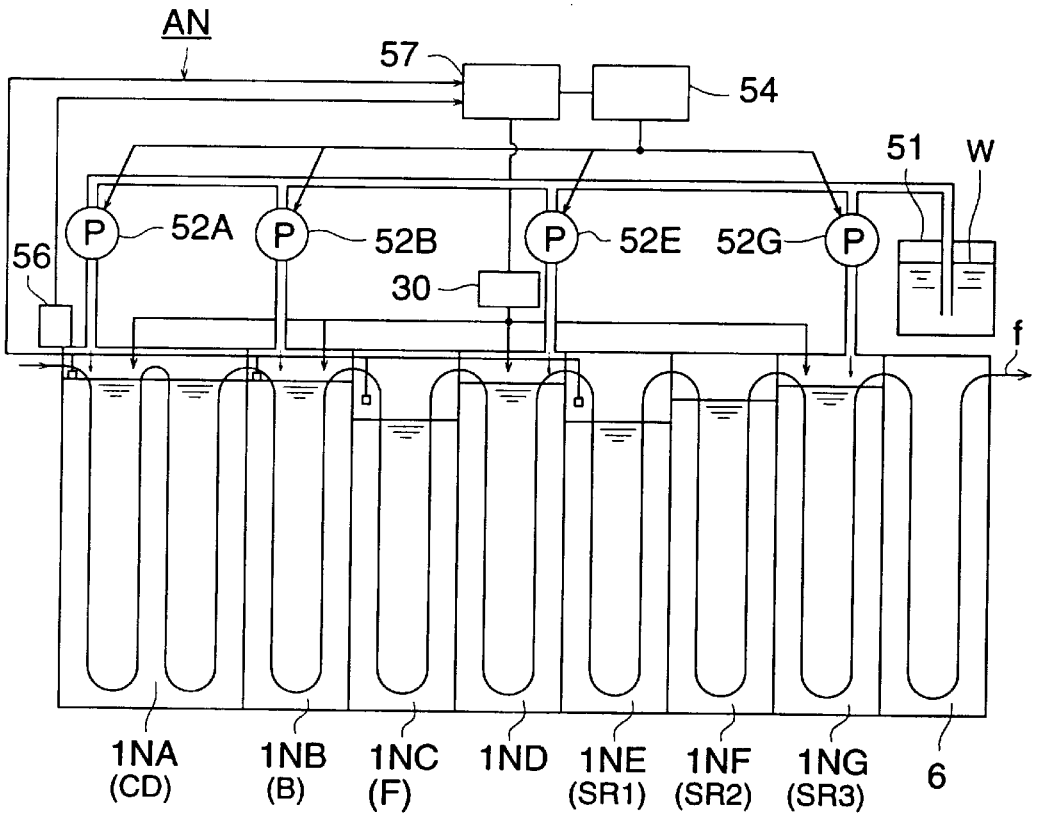

FIG. 13(*a*) is a structural view of an automatic processor AP for sheet-like printing paper development processing. In the automatic processor AP, the sheet-like printing paper p is dried by the drying section 6 after being processed by each processing solution (CD, BF, SR1–3) in the color development tank 1A, bleaching and fixing tank 1B, and stabilizing tanks 1C, 1D, 1E. Each solution level of the stabilizing tanks 1C, 1D, and 1E is successively higher than that of the bleaching and fixing tank 1B. Accordingly, this system has such a structure (counter current system) that the overflow solution from the tank 1E flows successively to tanks 1D, 1C, and 1B by the gravity. Numeral 51 is a replenishing water tank, numeral 52 is a feed water pump, numeral 53 is a water pipe, and numeral 54 is a replenishing water supply control means. Numeral 56 is a processing amount information detecting means for detecting the processing amount of the printing paper, and numeral 57 is a solid processing agent supply control means for timely replenishing a predetermined amount of solid processing agent according to the processing amount information.

FIG. 13(*b*) is a structural view of an automatic processor AN for negative film development processing. In the automatic processor AN, the negative film f is dried by the drying section 6 after being processed by each processing solution (CD, BF, SR1–3) in the color development tank 1NA, bleaching tank 1NB, fixing tanks 1NC, 1ND and stabilizing tanks 1NE, 1NF, 1NG, which are processing solution tanks. A replenishing device 30 to supply the solid processing agent is respectively provided in each of the color development tank 1NA, bleaching tank 1NB, fixing tank 1ND and stabilizing tank 1NG. Incidentally, the same symbols as those in FIG. 13(*a*) are given to parts having the same functions as those of the automatic processor AP.

Figure 14:
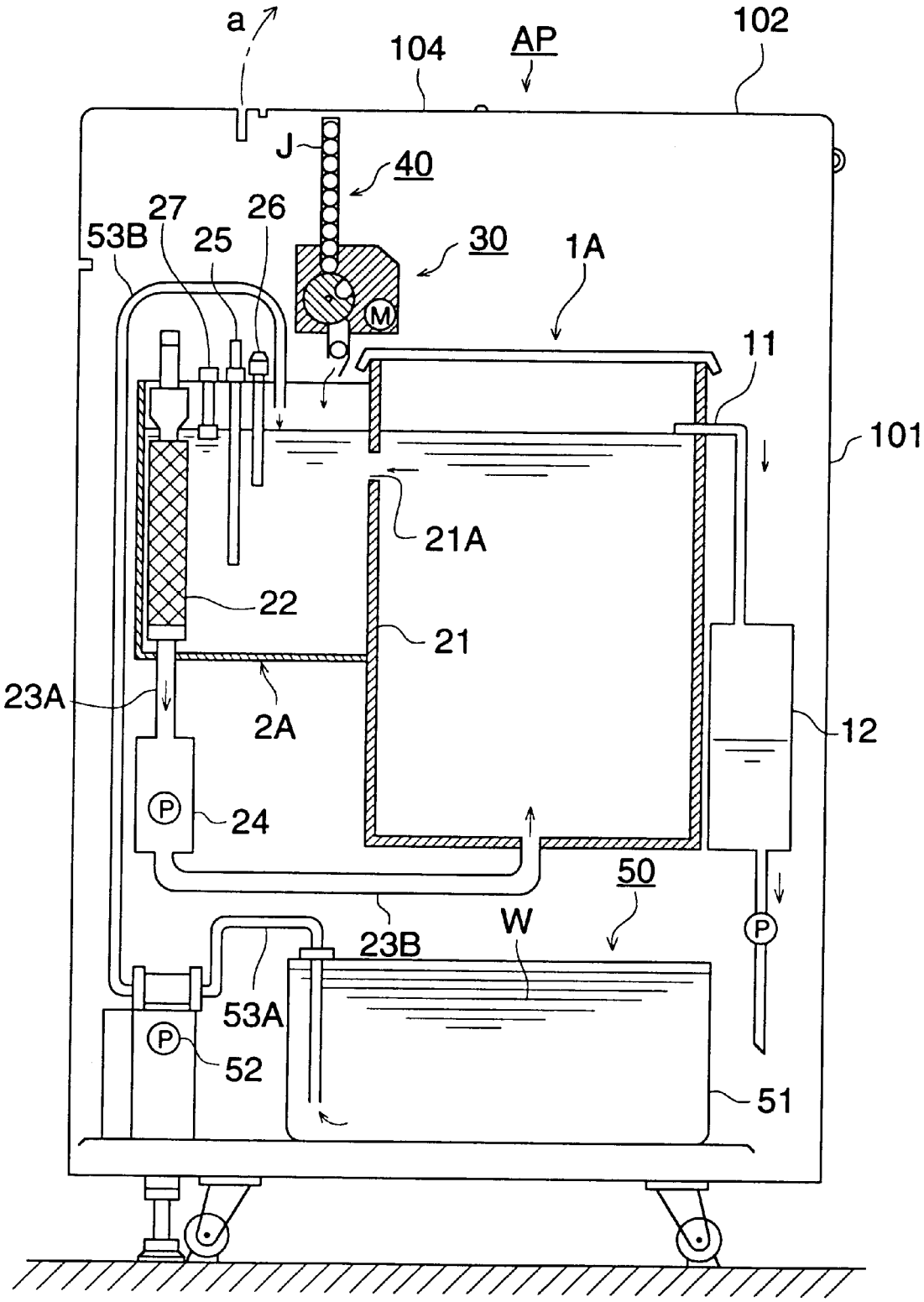
FIG. 14 is a sectional view of the automatic processor.

FIG. 14 is a sectional view of the color development tank 1A which the processing tank, auxiliary tank (dissolution tank) 2A and replenishing device 30, in the section Z—Z of the automatic processor AP in FIG. 12. The bleaching and fixing tank 1B and the stabilizing tank 1E also have almost the same structure as those in this view, therefore, hereinafter, the color developing tank 1A will be described as the representative of these tanks.

In this connection, in the drawing, for easy understanding of the structure, the conveying means for conveying the photosensitive material, and the like, are omitted. Further, in the present example, a case in which the tablet type solid processing agent J is sued as the solid processing agent, will be described, however, the present example can also be applied to the granular solid processing agent.

The processing tank 1A to process the photosensitive material (p or f) has an auxiliary tank (dissolution tank) 2A integrally provided on the outside of the partition wall 21 forming the processing tank 1A. The processing tank 1A and the auxiliary tank 2A are separated by the partition wall 21, on which an intercommunication window 21A is formed, and the processing solution can flow to each other. A filter 22, a heater 25, a temperature sensor 26 and a liquid level sensor 27 are provided in the auxiliary tank 2A. The inside of the filter 22 intercommunicates to the suction side of a circulation pump 24 (circulation means) through a circulation pipe 23A provided penetrating the lower wall of the auxiliary tank 2A. Another end of the circulation pipe 23B intercommunicated to the delivery side of the circulation pump 24, penetrates the outer wall of the processing tank 1, and intercommunicates to the processing tank 1. According to the structure described above, when the circulation pump 24 is operated, the processing solution is sucked from the auxiliary tank 2A, delivered into the processing tank 1A, the processing solution is mixed with the processing solution in the processing tank 1A, and enters into the auxiliary tank 2A again, and thus, the circulation is repeated. Numeral 11 is an overflow pipe, and numeral 12 is a waste solution tank.

A replenishing water supply means 50 for supplying the replenishing water W into the auxiliary tank 2A, is composed of a replenishing water tank 51, a feed water pump 52, water pipes 53A and 53B, and an appropriate amount of replenishing water W is replenished at appropriate time by a replenishing water supply control means 54.

The replenishing device 30 is composed of a processing amount information detecting means 56, a solid processing agent supply control means 57 (refer to FIG. 13 for the these two means), a storing container 40 in which the tablet type solid processing agent J is accommodated, and a replenishing device 30. The replenishing device 30 is driven by a motor M. A lid 104 is swingably hinged on a portion of the upper surface of the upper cover 102 of the automatic processor AP, and by opening the lid 104 in the direction of one-dotted chain line a shown in the drawing, the storing container 40 is loaded or replaced, and the tablet type solid processing agent J is replenished.

Figure 15:
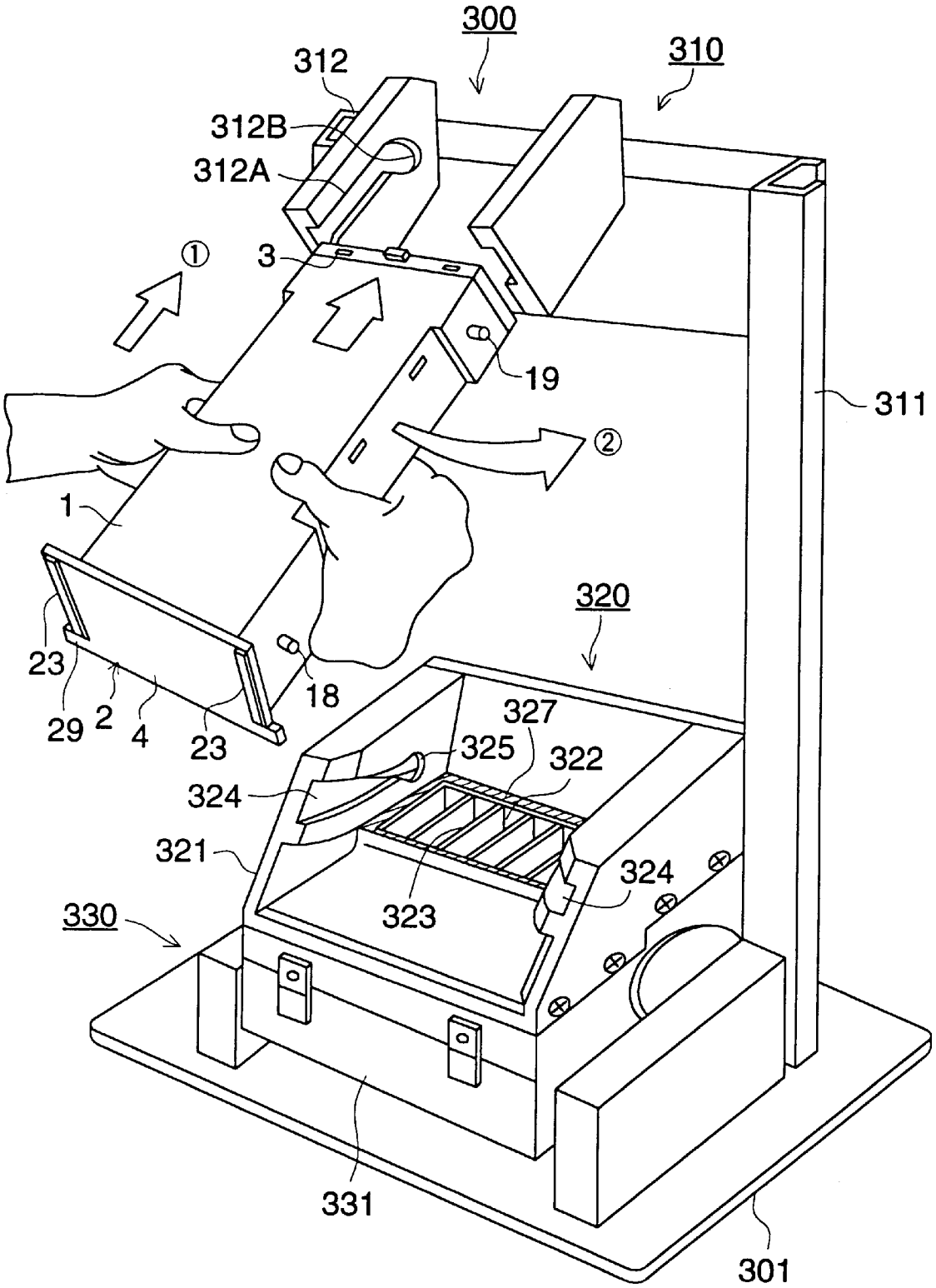
FIG. 15 is a perspective view showing an mounting operation of the storing container into a replenishing device.
Figure 16:
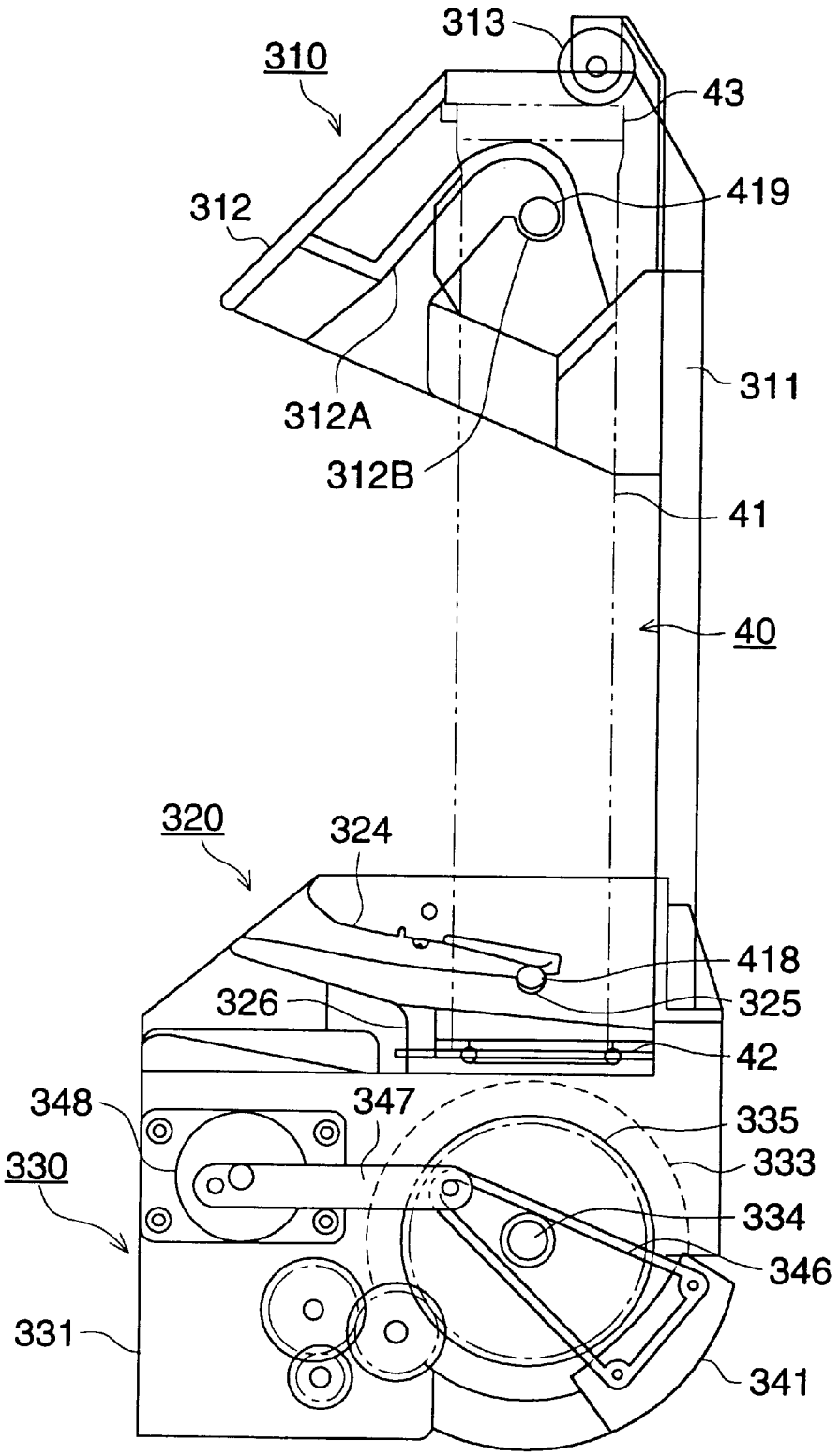
FIG. 16 is a front view showing a replenishing condition after the storing container has been mounted into the replenishing device.

FIG. 15 is a perspective view showing a mounting operation of the storing container 40 into the replenishing device 30, and FIG. 16 is a front view showing a replenishing condition in which the storing container 40 is mounted into the replenishing device 30.

The storing container 40 is almost vertically mounted to the mounting portion of the replenishing device 30 with the lid member 42 facing downward.

Protruded members 18 and 19, by which the storing container 30 is amounted into the replenishing device 30 and engaged with the device, are integrally protruded on both sides of the outer wall of the container main body 41. Two protruded members 18 near the lid member 42 are engaged in a cam groove provided on the lower mounting portion of the replenishing device 30, and positioned and fixed. When the storing container 40 is mounted into the replenishing device 40, the lid member 42 is opened as shown in FIG. 7(*b*). At the time of mounting of the storing container 40, two protruded members 19 near the cap member 42 are engaged in a cam groove provided on the upper mounting portion of the replenishing device 30, and positioned and fixed.

The replenishing device 30 is composed of an upper supporting portion to support the cap member 3 side of the storing container (pressing-side loading unit) 310, a mounting portion to support the lid member 2 side of the storing container and receive a plurality of solid processing agents J in the storing container(supplying-side loading unit) 320, and a processing agent supplying portion 330 to supply the received solid processing agents into a plurality of processing solution tanks.

The upper supporting portion 310 is composed of a support 311, a supporting member 312, and a pressing member (setting direction forcing means) 313. The support 311 stands upright and is fixed on a base plate 301. The supporting member 312 is fixed to the upper portion of the support 311. A guide groove portion 312A by which the identifying protrusion 19 of the storing container can be introduced, and a holding recessed portion 312B of the end of the guide groove 312A are provided on the inside of the supporting member 312. The pressing member 313 presses the cap member 3 of the upper portion of the storing container when the storing container is mounted in the upper supporting portion 310. The pressing member 313 is a forcing member such as a roller supported by a leaf spring or coil spring, a leaf spring, or the like.

A supply guide opening portion 322 to receive a plurality of solid processing agents in the storing container 40 is provided in an upper main body (upper housing) 321 of the mounting portion 320. The opening portion 322 is divided by a plurality of partition walls (ribs) 323, and formed into a plurality of opening separation chambers. These plural opening separation chambers respectively correspond to storing chambers 121–125 of the container main body 1.

Figure 21:
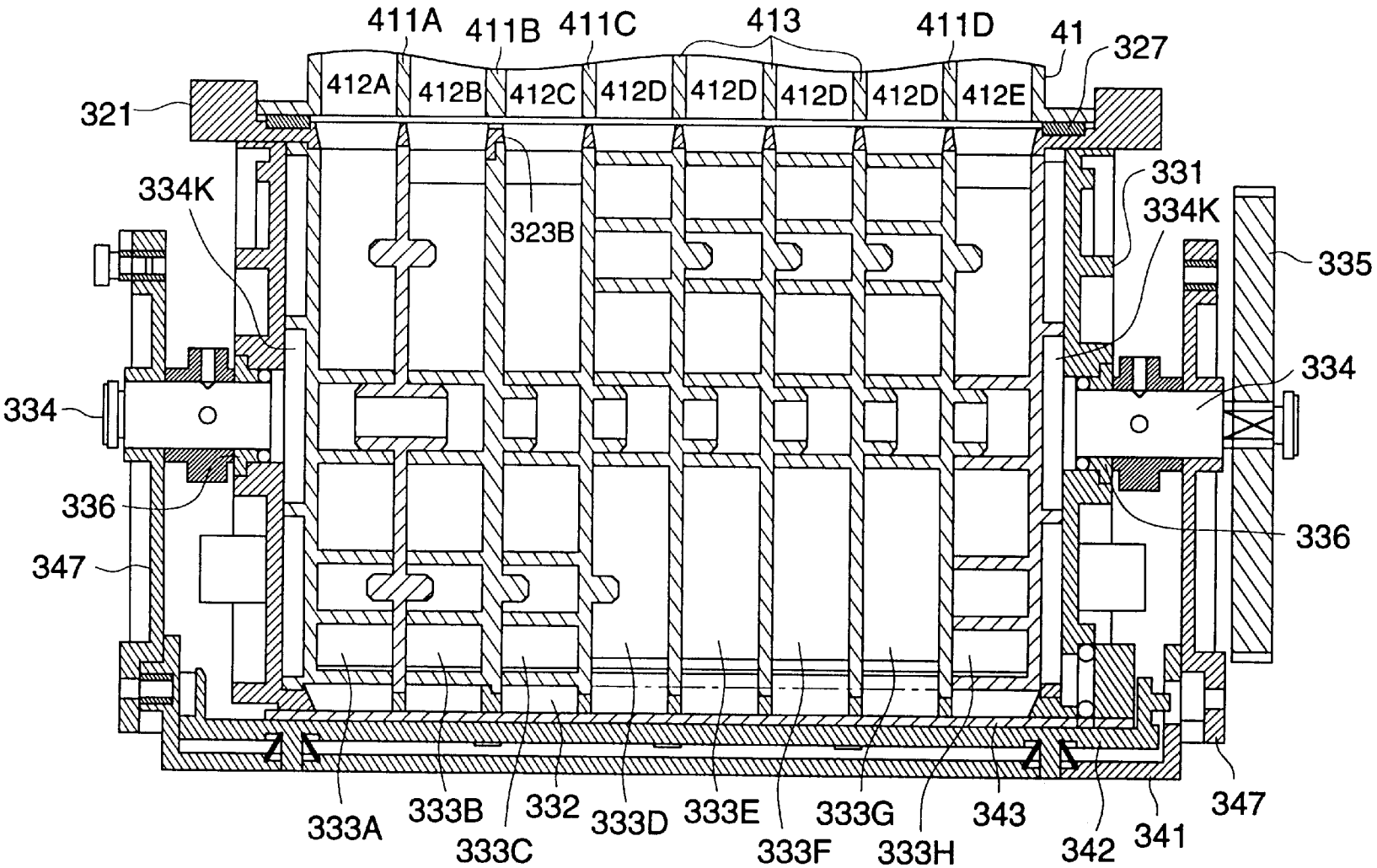
FIG. 21 is a vertical sectional view of the mounting portion and the processing agent supplying portion in the direction parallel to the rotational axis.

Herein, as shown in FIG. 21, in a plurality of separation walls 323, specifically the partition wall 323B, opposed to the partition wall to separate the storing chamber 412B from the storing chamber 412C of the container main body 41, is protruded to the container main body 41 side compared to other partition walls 411, and when the storing container 40 is loaded into the mounting portion 320, the partition wall 323B approaches or is in contact with the front end portion of the partition wall 411B of the container main body 41. In such the manner, when the partition wall 323B approaches or is in contact with the front end portion of the partition wall 411B, specifically, powders or granules of the solid processing agents accommodated in the storing chambers 412B and 412C in the storing chambers 412 (A–E), are prevented from entering and mixing into the opening separation chambers adjoining to the opening separation chambers to which the supply guide opening portion 322 corresponds (contamination is prevented).

As shown in FIG. 15, a packing member 327 is adhered onto the periphery of the upper surface of the supply guide opening portion 322. When the storing container is loaded into the mounting portion 320, the packing member 327 is in close contact with the flange portion 15 of the container main body 1, and the air is prevented from entering into the opened storing container. By such the hermetic sealing, the solid processing agent is prevented from swelling by entering of the air, specifically, the highly humid air, into the storing container.

Figure 17:
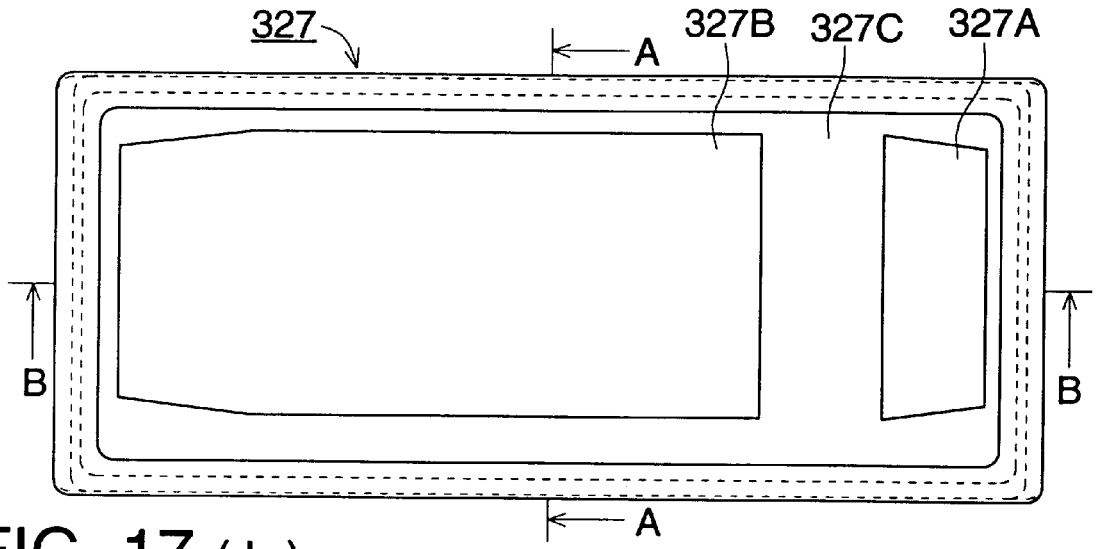
FIG. 17(*a*) is a plan view of a packing member, FIG. 17(*b*) is a bottom view of the packing member, FIG. 17(*c*) is an enlarged sectional view taken on line A—A in FIG. 17(*a*), and FIG. 17(*d*) is an enlarged sectional view taken on line B—B in FIG. 17(*a*).
Figure 17:
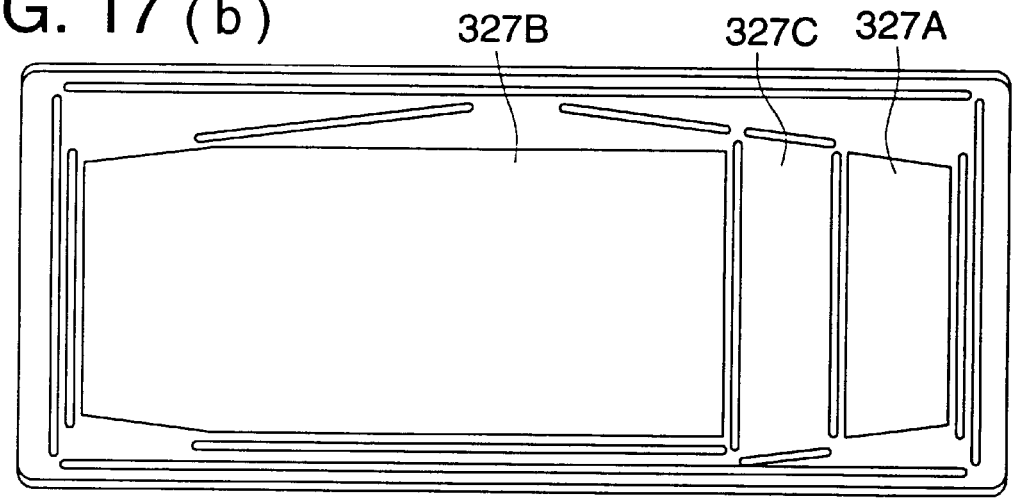
Figure 17:
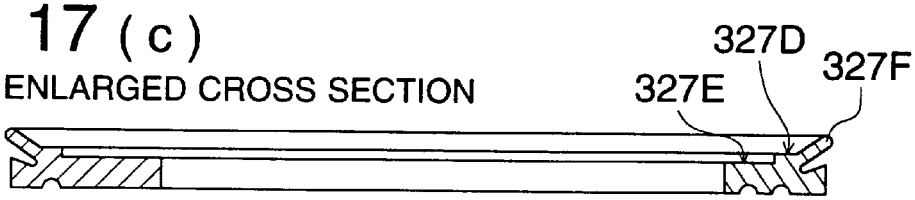
Figure 17:
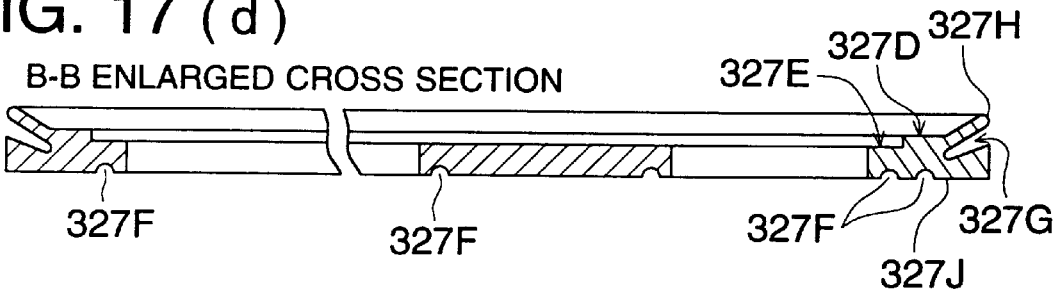

FIG. 17 shows a packing member 327 for a replenishing device 30N, and FIG. 17(*a*) is its plan view, FIG. 17(*b*) is its bottom view, FIG. 17(*c*) is its enlarged sectional view taken on line A—A in FIG. 17(*a*), and FIG. 17(*d*) is its enlarged sectional view taken on line B—B in FIG. 17(*a*).

The packing member 327 is an elastic rubber member formed of a plate material, and made of excellent chemical resistant materials such as a single layer body of, for example, nitrile butadiene rubber (NBR), styrene butadiene rubber (SBR), chloroprene rubber (CR), silicon rubber (Q), fluorine rubber (FKM), or a lamination layer body of any of these materials and other materials.

The packing member 327 is formed to have opening portions 327A and 327B which are penetrated corresponding to the opening portion 322 of the mounting portion 320 of the replenishing device 30. The opening portion 327A is an opening to supply the solid processing agent JN1 in the storing container 40 into a pocket portion 333A of a drum member 333 in the processing agent supply portion 330. The opening portion 327B is an opening to supply the solid processing agent JN2 in the storing container 40 into a pocket portion 333C of the drum member 333, the solid processing agent JN3 into pocket portions 333D, 333E, 333F, 333G, and the solid processing agent JN4 into pocket portions 333H. The opening portion 327A and the opening portion 327B are separated by a bridge portion 327C.

The bottom surface side of the packing member 327 is adhered onto the periphery of the opening portion 322 of the mounting portion 320. The bottom surface side of the bridge portion 327C is adhered onto the vicinity of the partition wall 323B of the opening portion 322, thereby, floating and loosening are prevented. When the bridge portion 327C of the packing member 327 is provided at a position opposite to an empty chamber 412B of the storing container 40, solid processing agents JN1 and JN2 accommodated in storing chambers 412A and 412C on both sides of the empty chamber 412B do not chemically react on each other, and are securely separated and accommodated. Further, when there is no bridge portion, the packing member is easily deformed, and an area of the peripheral portion on which the packing member 327 can be adhered onto the mounting portion 320, is small, therefore, there is a possibility that the packing member 327 is hardly attached thereto and easily peeled off. However, when the packing member 327 is provided with the bridge portion 327C, the packing member is not deformed, and has larger contact surface, thereby, the attaching operability of the packing member 327 is improved and peeling can also be prevented.

The first flat surface portion 327D with which the flat surface portion of the flange member 415 comes into contact, and the second flat surface portion 327E with which the protruded portion 415C protruded from the flat surface portion of the flange portion 415 are formed on the upper surface side of the packing member 327. The first flat surface portion 327D and the second flat surface portion 327E are parallel surfaces with a step between them, and the height of the step is almost the same as that of the protrusion of the protruded portion 415C. Thereby, the gap is prevented from occurring between the flange portion 415 and the packing portion 327 when the packing member 327 is pushed by the protruded portion 415C.

A plurality of groove portions 327F are provided on the periphery of the opening portions 327A and 327B on the rear surface side of the packing member 327. When the groove portion 327F is formed on the rear surface side, a portion, which is heavily pressed, of the packing member 327 is easily recessed, and therefore, the packing member 327 is flexibly deformed and follows the shape of the flange portion 415, thereby, the sealing property of the packing member 327 is maintained even when the flatness of the flange portion 415 of the storing container 40 is slightly bad.

Further, a V-shaped groove portion 327G is provided on 4 outer peripheral surfaces on the side surfaces of the rectangular packing member 327. The groove portion 327G is composed of softly elastically-deformable one-sided tongue portions 327H, which protrude obliquely upward, and gently slanting portions 327J thereunder.

When the flange portion 415 presses the packing member 327 fixed on the mounting portion 320 at the time of mounting of the storing container, the flat surface portion of the flange member 415 presses the first flat surface portion 327D of the packing member 327 and elastically deforms also the one-sided tongue portion 327H, and then, the one-sided tongue portion 327H on the upper side is approximately in contact with the gently slanting portion 327J. Under such the pressed condition, the one-sided tongue portion 327H and the first flat surface portion 327D form the same horizontal surface.

In the conventional V-shaped packing, there exists a gap on the front end in the horizontal condition, therefore, the degree of close adhesion of the packing member is not good, however, when a gap between the container mounting portion and the front end of the packing member is eliminated, the degree of close adhesion is improved.

Further, at this pressing time, the front end portion of the protruded portion 415C protruded from the flat surface portion of the flange portion 415, is brought into contact with the second flat surface portion 327E on the upper surface side of the packing member 327.

Even when the flatness or evenness of the flat surface portion of the flange portion 415 and the flat surface portion of the front end portion of the protruded portion 415C are slightly incorrect, the upper surface side of the packing member 327 pressed by the flange portion 415 is elastically deformed and in close contact with the flange portion 415, thereby, the air or gas is securely prevented from entering into the container 40.

Figure 18:
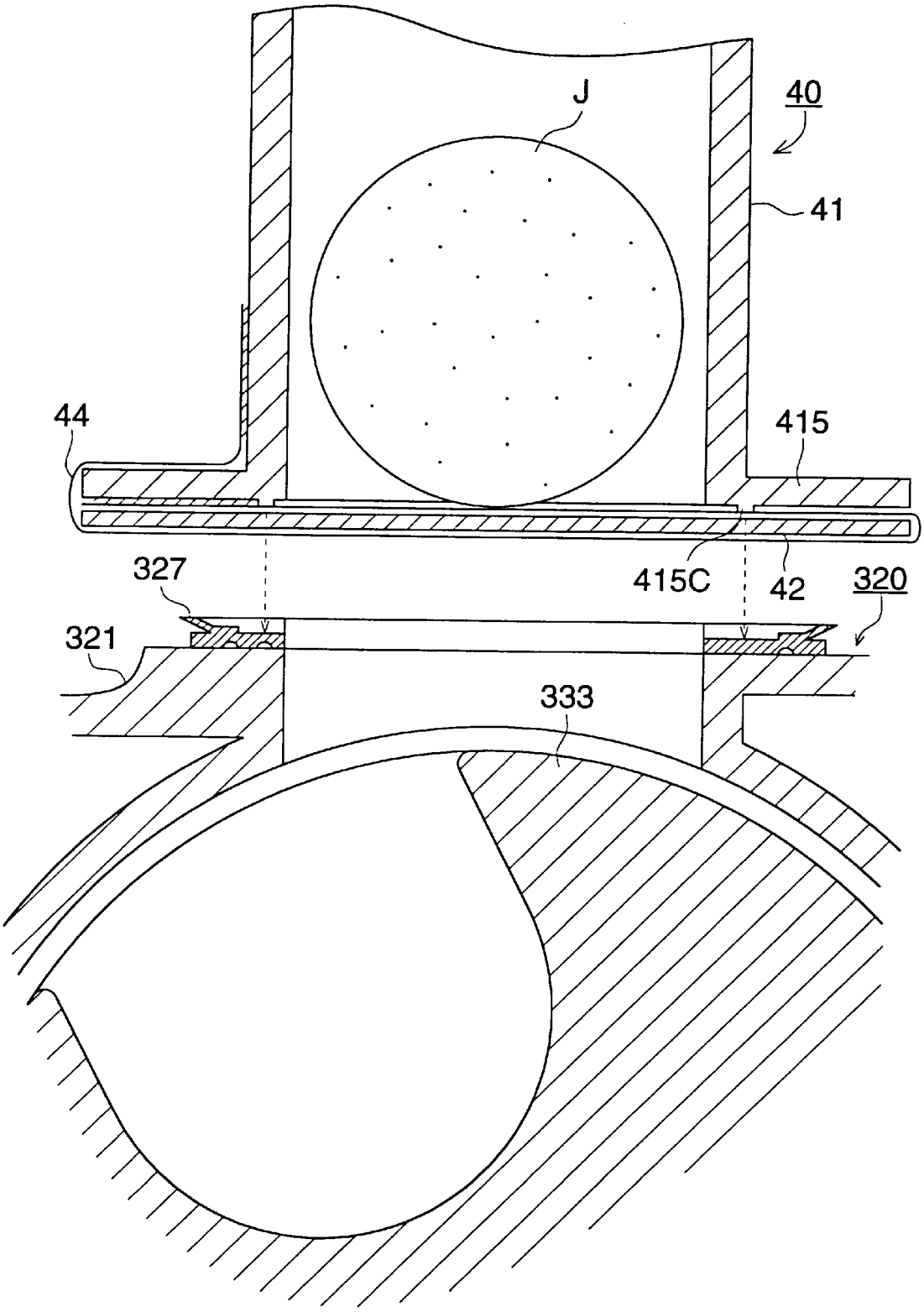
FIG. 18 is a partially enlarged sectional view showing a condition before the storing container is mounted in the mounting portion of the replenishing device.
Figure 19:
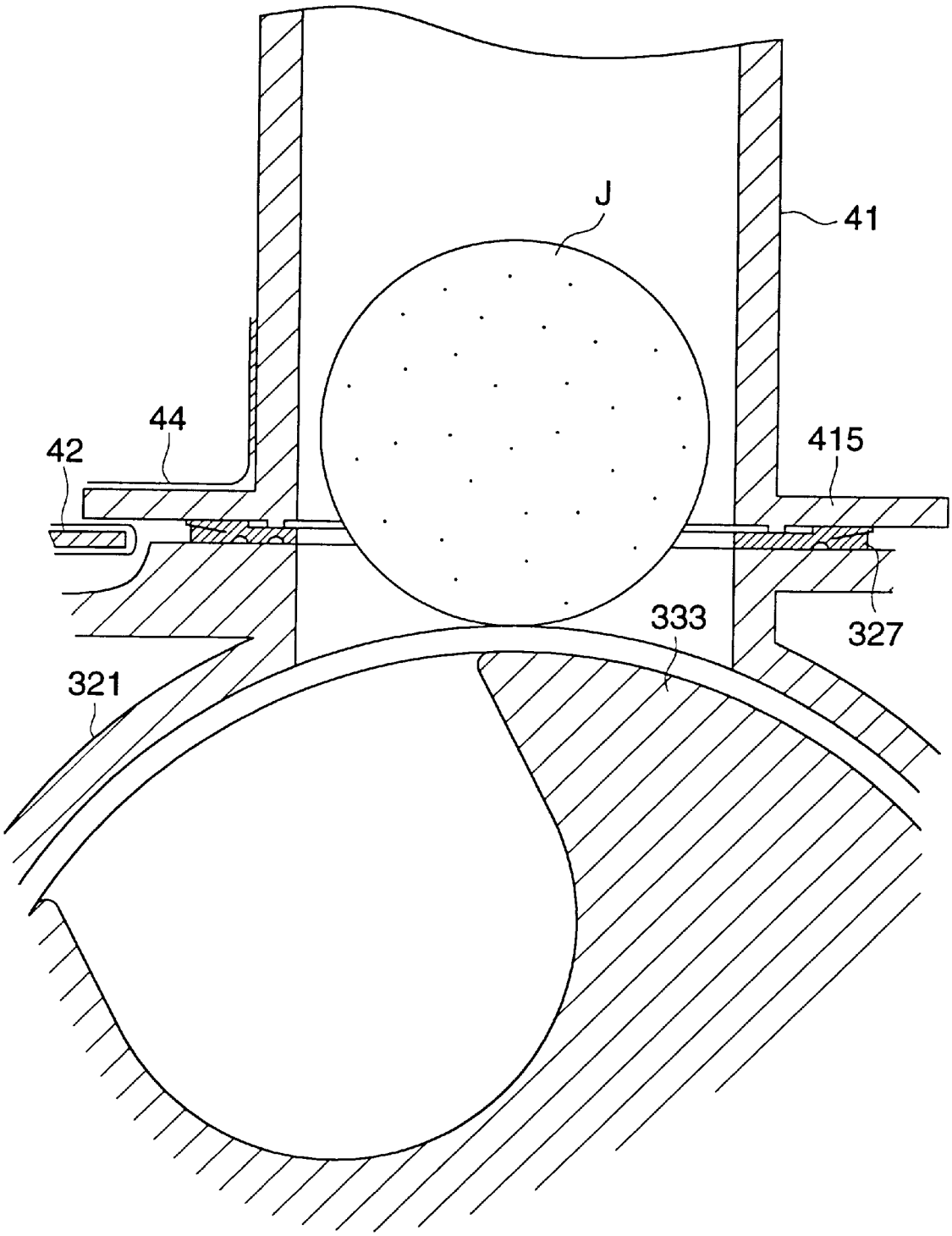
FIG. 19 is a partially enlarged sectional view showing a condition after the storing container is mounted in the mounting portion of the replenishing device.

FIG. 18 is a partially enlarged sectional view showing a condition before the storing container 40 is mounted into the mounting portion 320 of the replenishing device 30. FIG. 19 is a partially enlarged sectional view showing a condition that the storing container 40 is mounted into the mounting portion 320 of the replenishing device 30.

Further, as shown in FIG. 15, grooved cam portions 324 are provided on the insides of both side walls of the upper main body 321. When the storing container is mounted into the mounting portion 320, the protruded portion 18 of the storing container is inserted into and engaged with the grooved cam portion 324, and the lid member 2 is moved and opened. Further, when the storing container is removed from the mounting portion 320, the opening portion of the storing container is closed by the lid member 2.

The operation process to mount the storing container into the mounting portion 320 will be described below.

(1) The storing container is held in such a manner that the lid member 2 faces downward, the identifying protrusion 19 is moved along the guide groove portion 312A of the support member 312, and the storing container is inserted into the support member 312 from the slant downward direction to the slant upward direction (in the direction (1) in FIG. 15). The guide groove portions 312A provided left and right are provided to have each different groove width, and each outer diameter of the left and right identifying protrusions 19 is set to meet the guide groove 312A, therefore, the storing container can not be reversely inserted into the support member 312 (mis-mounting prevention).

(2) After the identifying protrusion 19 has been engaged with the holding recessed portion 312B, when the storing container is oscillated around the holding recessed portion 312B (in the direction (2) in FIG. 15), both operation members 29 on both ends of the lid member 2 are brought into contact with engagement members and the movement is prevented, and when the storing container is further moved, only container main body 1 is moved, and supply opening portions 141–145 are gradually opened.

(3) When the flange portion 15 of the container main body 1 comes into contact with the stopper, the protruded portion 18 near the lid member 2 of the storing container is engaged in the grooved cam portion 324, come into the recessed portion 325, and stops in the condition being pressed by the leaf spring (guiding direction forcing means) 326. At that time, the supply opening portions 141–145 are fully opened, and the solid processing agent J in the container main body 1 drops into the opening portion 322 of the mounting portion 320.

Incidentally, in the present example, the storing chambers are integrally sealed, however, these may be divided for each kind of processing agent and sealed. In this case, no contamination occurs for each solid processing agent, and the performance of the processing agent can be strictly maintained, therefore, this method is preferable.

Figure 20:
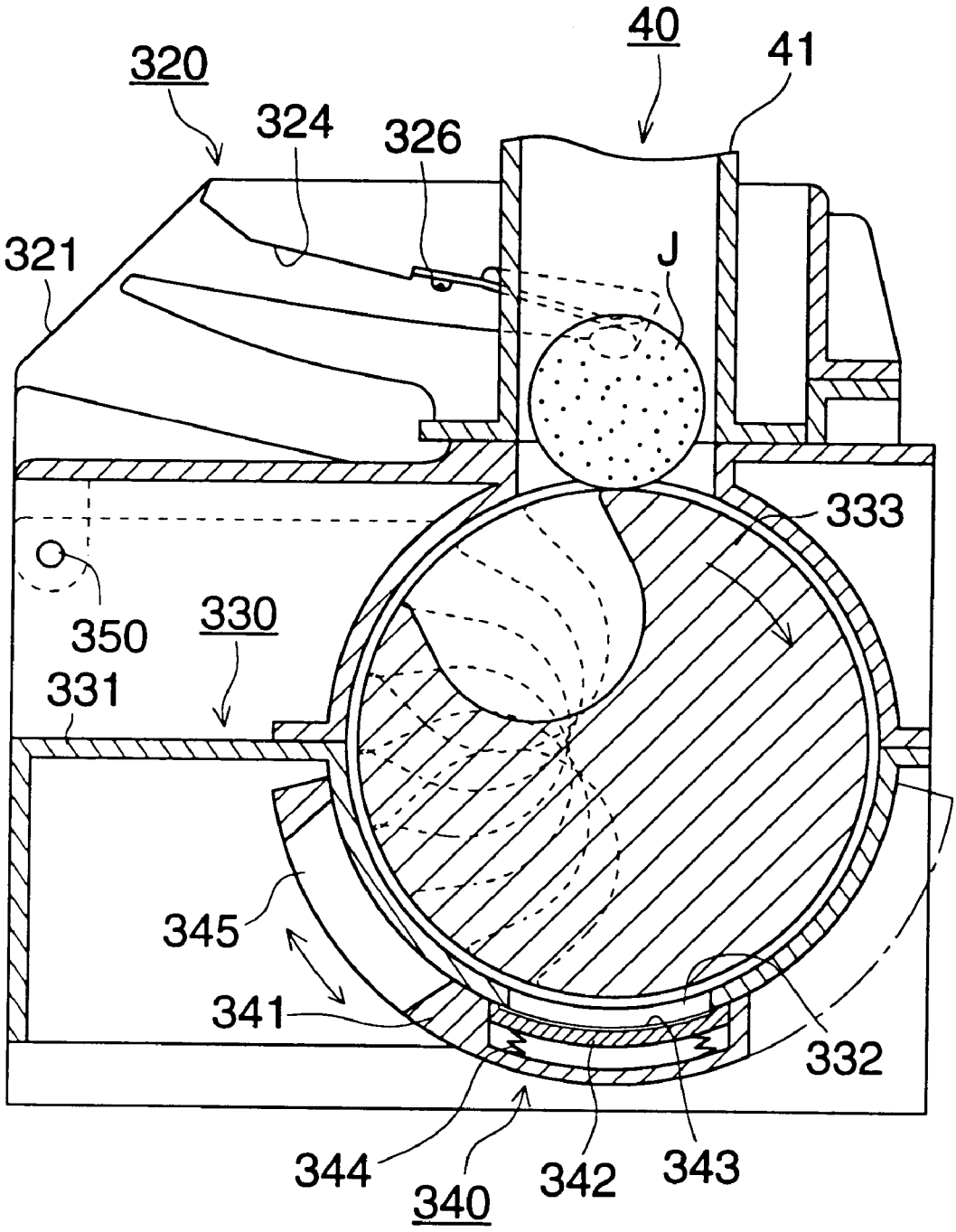
FIG. 20 is a sectional view of the mounting portion and a processing agent supplying portion in the direction perpendicular to the rotational axis.

FIG. 20 is a sectional view in the direction perpendicular to the rotation shaft of the mounting portion 320 and the processing agent supply portion 330, and FIG. 21 is a vertical sectional view in the direction parallel with the rotation shaft of the mounting portion 320 and the processing agent supply portion 330.

The processing agent supply portion 330 below the mounting portion 320 is composed of a lower main body (lower housing) 331, drum member 333 and driving means. A shutter means 340 is supported snch that it can be oscillated, in the lower portion of the lower main body 331.

An opening portion (processing agent supply port) 332 to drop and replenish the solid processing agent J, is provided below the lower main body 331. The opening portion 332 is closed by a shutter means 340 except during replenishment. The shutter member 341 is oscillated along the cylindrical surface of the lower surface of the lower main body 331. A pressing member 342, elastic member 343, and spring 344 are housed in a recessed portion inside the shutter member 341. The elastic member 343 adhered on the upper surface of the pressing member 342 is forced by the spring 344, and presses and closes the lower opening portion 332 of the lower main body 331. In the other portion of the shutter member 341, a penetrated opening portion 345 having a plurality of partition walls is provided, and the solid processing agent J can pass and drop through the opening portion 345. Partition walls to array and drop the solid processing agents of 8 rows are provided in the opening portion 345.

The shutter member 341 is integrated with an oscillating plate 346. The oscillating plate 346 is rotatably supported by the rotation shaft to drive the drum member 333, which will be described later, and the other end is connected to a crank 347. The crank 347 is connected to an eccentric disk 348 rotated by the driving source, and is eccentrically moved, and oscillates the oscillating plate 346 and the shutter member 341. The opening portion 332 is opened and closed by the oscillation of the shutter member 341.

The shutter member 341 opens the opening portion 332 only during replenishment of the solid processing agent by the eccentric oscillation mechanism, and except during the replenishment, the opening portion 332 is kept closed. When the opening portion 332 is closed by the shutter member 341 except during the replenishment, the vapor of the processing solution rising from the processing tank below the replenishing device 30 is prevented from entering into the device main body, thereby, the moisture-proofing effect is enhanced.

The rotation shaft 334 is rotatably supported by both side surfaces of the lower main body 331 through bearings 336. A gear 335 is fixed on one shaft end of the rotation shaft 334. The gear 335 is rotated by the driving source and drive transmission gear train shown in FIG. 16.

Cutout disk-shaped protruded coupling portions 334K are protruded inside each rotation shaft 334. The protruded coupling portion 334K is engaged with recessed coupling portions 333K provided on both end surfaces of the drum member 333, and transmits the driving rotation to the drum member 333.

The drum member 333 is composed of a plurality (8 in the drawing) of cylindrical portions. These cylindrical portions are positioned and integrated by bosses in the central portions and pins in the radial direction.

Figure 22:
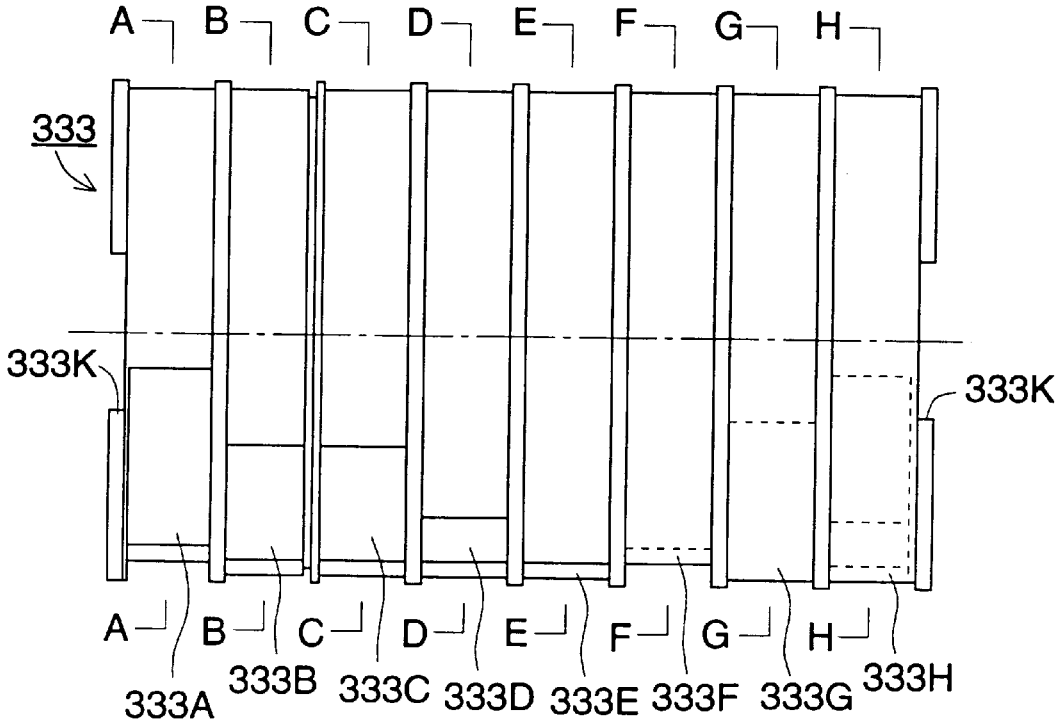
FIG. 22(*a*) is a side view of a drum member, and FIG. 22(*b*) is a perspective view of the drum member.
Figure 22:
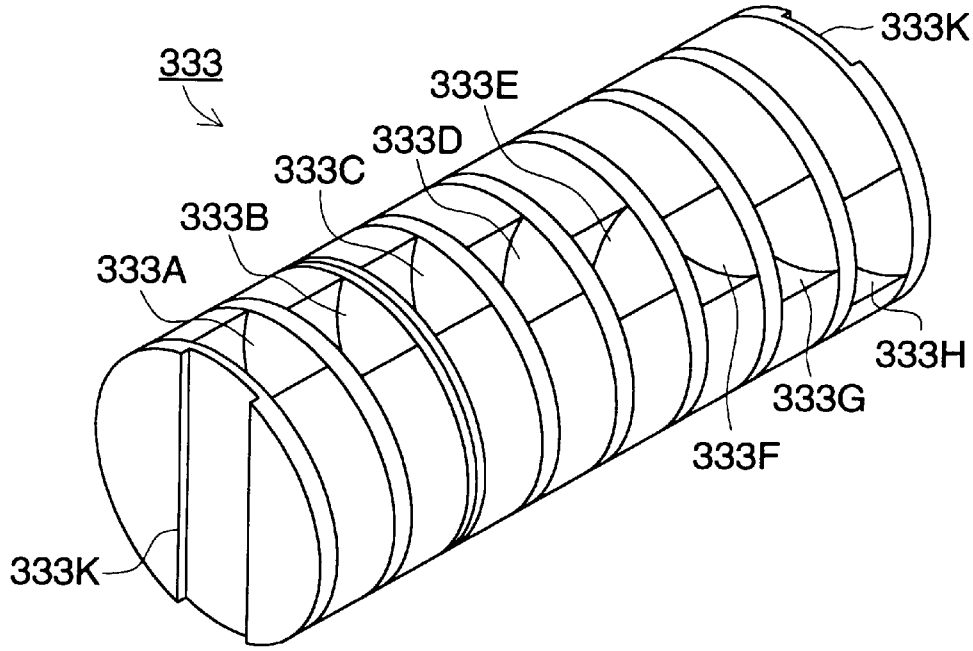
Figure 23:
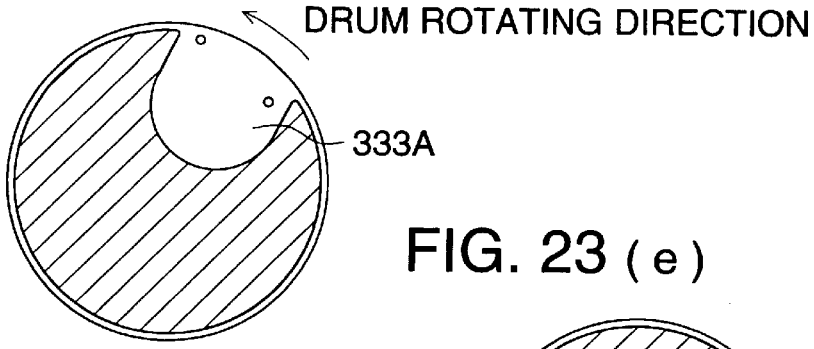
FIGS. 23(*a*) to 23(*g*) are respective sectional views of the drum member.
Figure 23:
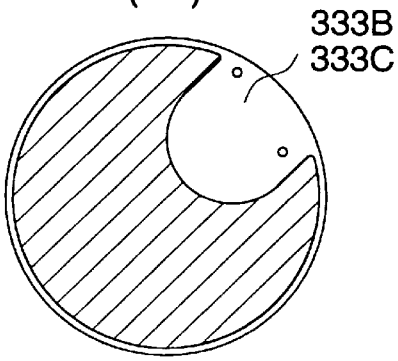
Figure 23:
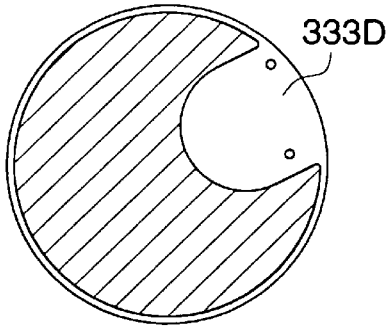
Figure 23:
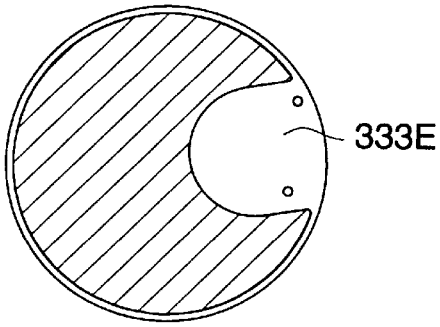
Figure 23:
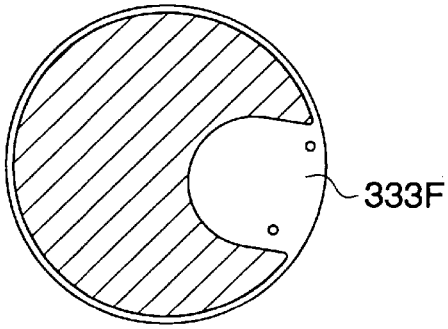
Figure 23:
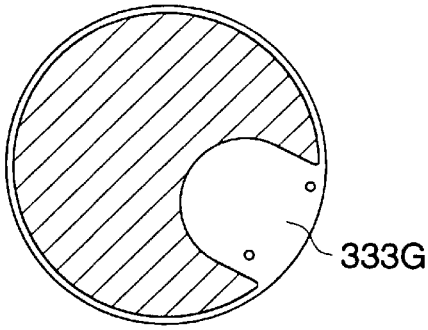
Figure 23:
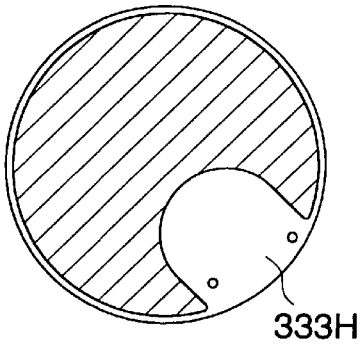

FIG. 22(*a*) is a side view of the drum member 333, and FIG. 22(*b*) is a perspective view of the drum member 333. FIG. 23 is each sectional view taken on lines A—A, B—B, C—C, D—D, E—E, F—F, G—G, and H—H of the drum member 333 in FIG. 22(*a*).

Cylindrical members in 8 rows are provided in the drum member 333 such that phases of angles of them are respectively shifted, corresponding to separated chambers in 8 rows of the storing container 40. Each of solid processing agent receiving portions (pocket portions) 333A, 333B, 333C, 333D, 333E, 333F, 333G, 333H, which can respectively receive one solid processing agent J, is provided in each cylindrical member such that phases of angles of them are respectively shifted in the rotational direction.

The solid processing agent JN1 for color development is supplied into the pocket portion 333A of the first row, in the cylindrical members in 8 rows of the drum member 333 mounted in the replenishing device 30N of the automatic processor AN. The pocket portion 333B of the second row is an empty chamber, and the solid processing agent JN2 for bleaching is supplied into the pocket portion 333C of the third row. The solid processing agent JN3 for fixing is supplied into the pocket portions 333D, 333E, 333F, 333G of the 4th–7th row. The solid processing agent JN4 for stabilization is supplied into the pocket portion 333H of the 8th row.

The solid processing agent JP1 for color development is supplied into the pocket portions 333A and 333B of the first row and the second row, in the cylindrical members in 8 rows of the drum member 333 mounted in the replenishing device 30P of the automatic processor AP. The pocket portion 333C of the third row is an empty chamber, and the solid processing agent JP2 for bleaching and fixing is supplied into the pocket portions 333D, 333E, 333F, 333G of the 4th–7th row. The solid processing agent JP3 for stabilization is supplied into the pocket portion 333H of the 8th row.

In these solid processing agents, solid processing agents JN1 and JN2 whose contamination should be specifically prevented, are separated from each other through the empty chamber 333B. However, there is a possibility that powders of the solid processing agents enter and are mixed in the inside from a gap formed between the front end portion of the partition wall portion to partition each pocket portion, and the inner wall of the upper housing 321 and the lower housing 331.

In the same manner, solid processing agents JP1 and JP2 whose contamination should be specifically prevented, are separated from each other through the empty chamber 333C. However, there is a possibility that powders of the solid processing agents enter and are mixed in the inside from a gap formed between the front end portion of the partition wall portion to partition each pocket portion, and the inner wall of the upper housing 321 and the lower housing 331.

Because the storing container 40N and the storing container 40P are formed into the same shape, a zigzag protrusion 333Z is formed on the front end portion of the partition wall between the pocket portion 333B of the second row and the pocket portion 333C of the third row, and a protruded portion to engage with the protrusion 333Z is formed on the front end portion of the inner wall of the upper housing 321 and the lower housing 331, and these are formed into a convex-concave engagement labyrinth structure. By the existence of the convex-concave engagement and the empty chamber, mixing of the solid processing agent JN1 with the solid processing agent JN2, or mixing of the solid processing agent JP1 with the solid processing agent JP2 is securely prevented, and the drum member 333 is rotated without any trouble. In this connection, the above cited convex-concave engagement labyrinth structure can also be provided on other partition walls.

Further, a small gap is provided between the outer peripheral surface of the flange portion to partition the pocket portions (A–H) of 8 rows of the drum member 333, and the inner wall of the upper housing 321 and the lower housing 331. The small gap is set to 0.2–0.3 mm. When the gap is smaller, powders of the solid processing agent entering into the gap hinder the rotation of the drum member 333. When the gap is larger, powders of the solid processing agent enter into the gap from adjoining pocket portions.

Figure 24:
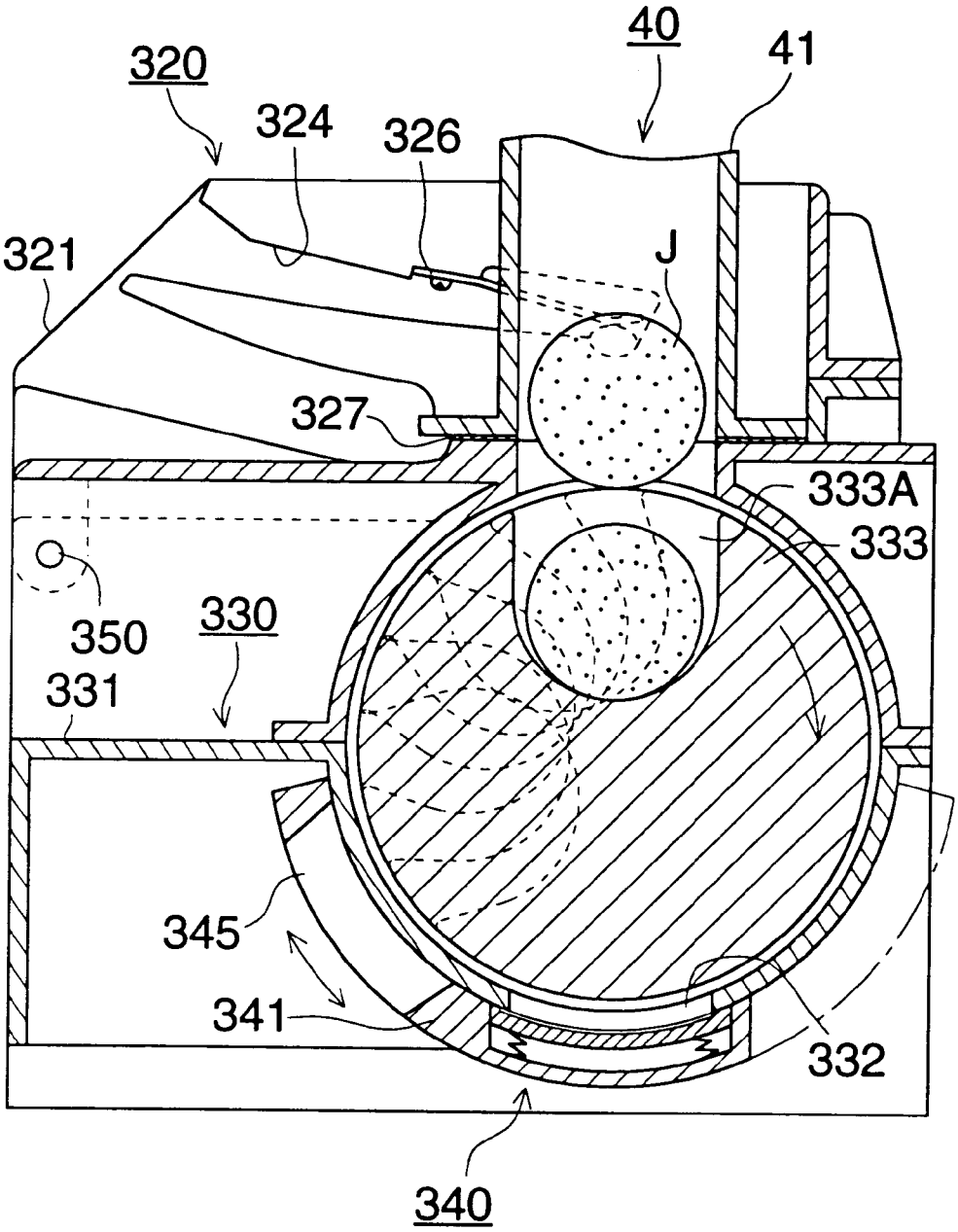
FIG. 24 is a sectional view of the replenishing device showing a condition that the solid processing agent in the storing container is supplied to a pocket portion of the drum member.
Figure 25:
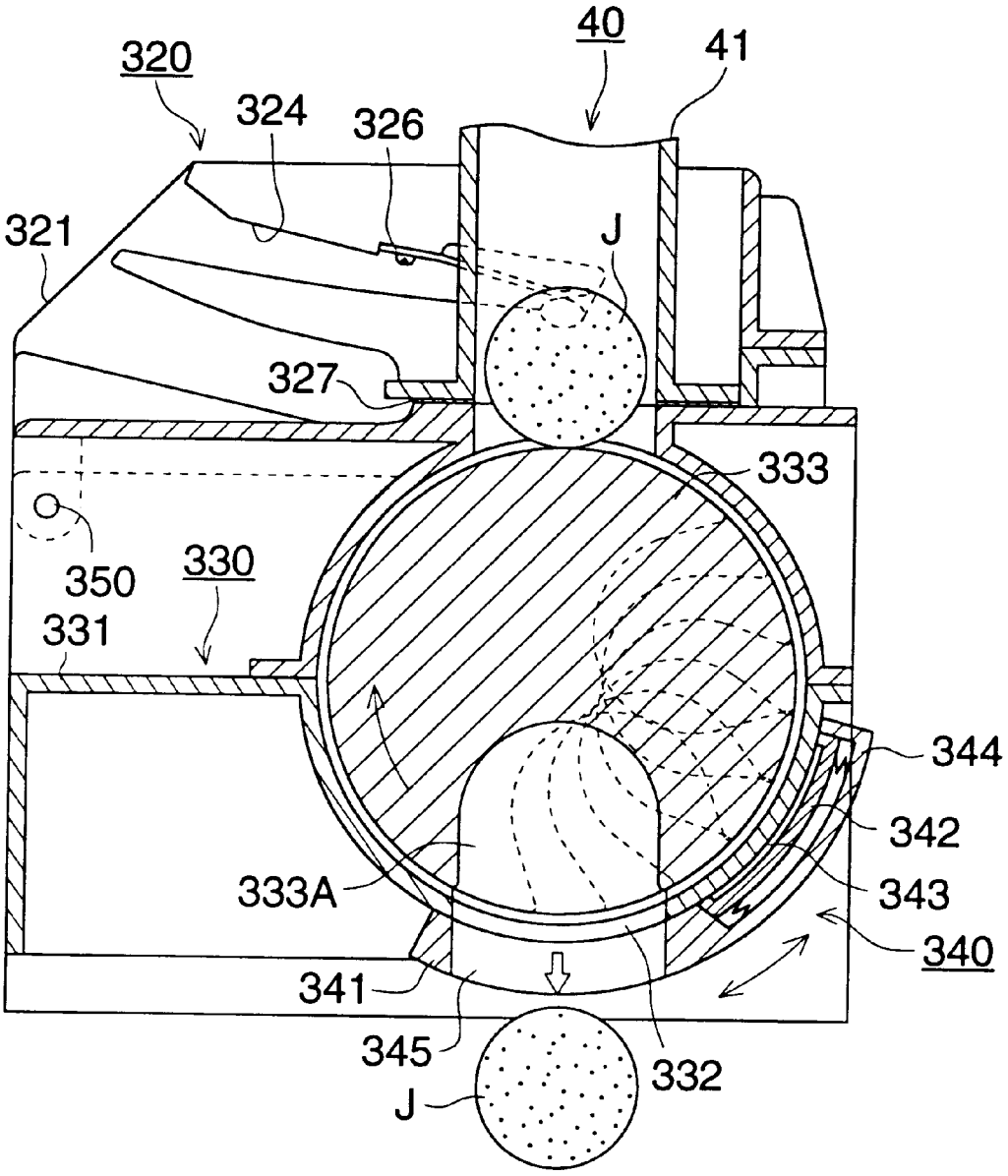
FIG. 25 is a sectional view of the replenishing device showing a condition that the solid processing agent is supplied from the pocket portion of the drum member into a processing solution tank.

FIGS. 24 and 25 are sectional views of the replenishing device 30 showing the process in which the solid processing agent J is dropped from the pocket portion 333A of the drum member 333. That is, FIG. 24 is a sectional view of the replenishing device 30 in the condition that the solid processing agent J in the storing container 40 is dropped into the pocket portion 333A of the drum member 333, and FIG. 25 is a sectional view of the replenishing device 30 in the condition that the solid processing agent J is dropped from the pocket portion 333A of the drum member 333 into the process solution tank.

By the replenishment start signal of the solid processing agent, the eccentric disk 348 shown in FIG. 16 is rotated by the driving means, and the crank 347 oscillates the oscillation plate 346 around the rotation shaft 334. The shutter member 341 integrated with the oscillation plate 346 is oscillated, and when the opening portion 345 of the shutter member 341 meets the opening portion (processing agent supply port) in the lower portion of the lower housing 331, the oscillation of the shutter member 341 is stopped.

After the oscillation movement of the shutter member 341 has been completed, the drum member 333 is rotated by another driving means in the arrowed direction in the drawing, the solid processing agent is received in the drum 333, conveyed by the rotation, drops passing through the opening portion 332 and the opening portion 345 of the shutter member 341, and replenished into the lower processing tank.

The solid processing agent replenishment process by the rotation of the drum member 333 will be described below.

(1) When the storing container 40 is mounted in the mounting portion of the replenishing device 30, the lid member 42 is automatically opened, and the supply opening portion 414 (A–E) is opened, the top solid processing agents JN1–JN4 in the container main body 41 are brought into contact with the outer peripheral surface of the stopped drum member 333, and maintained in the initial stop condition.

(2) When the rotation of the drum member 333 is started, initially, the processing agent JN1 is supplied from the supply opening portion 414 (A–E) in the container main body 41 into the pocket portion 333A in the first row, next, the processing agent JN2 is supplied into the pocket portion 333C in the third row, then, the processing agent JN3 is supplied into the pocket portions 333D–333G in the fourth–seventh rows, and further, the processing agent JN4 is supplied into the pocket portion 333H in the eighth row.

(3) Succeedingly, by the rotation of the drum member 333, when pocket portions 333A, 333B, 333C, 333D–333G, and 333H arrive at the position coinciding with the lower opening portion 332 of the lower main body 331, four kinds of solid processing agents JN1, JN2, JN3 and JN4, respectively accommodated in the pocket portions, successively drop, pass through the lower opening portion 332 and the opening portion 345 of the shutter member 341, and are replenished in the lower processing tank.

(4) In the manner described above, by one rotation of the drum member 333, the solid processing agent for color development JN1 (1 tablet), the solid processing agent for bleaching JN2 (1 tablet), the solid processing agent for fixing JN3 (4 tablets), and the solid processing agent for stabilization JN4 (1 tablet), are respectively replenished.

Figure 26:
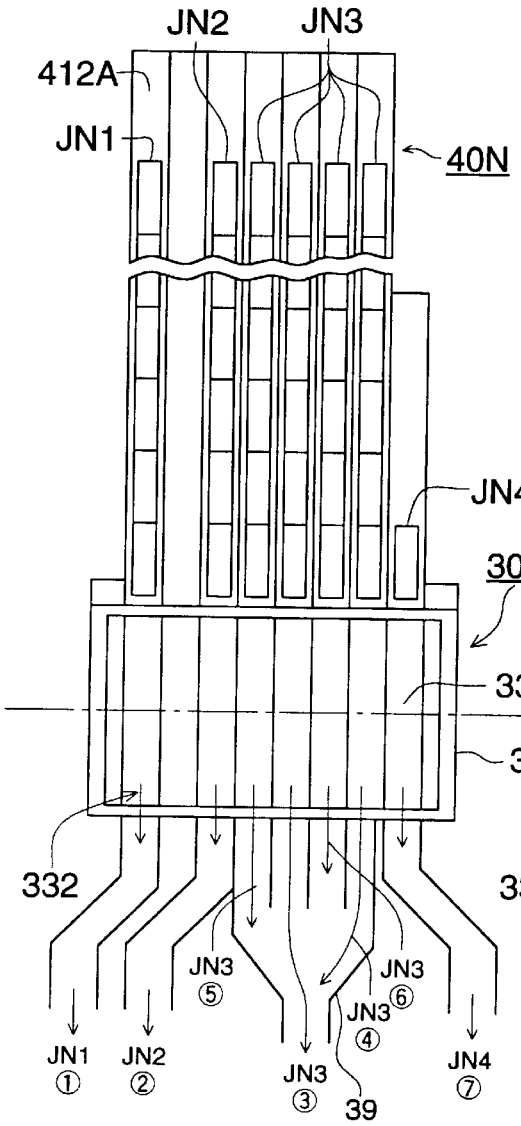
FIGS. 26(*a*) and 26(*d*) are typical views showing supplying paths of the solid processing agents.
Figure 26:
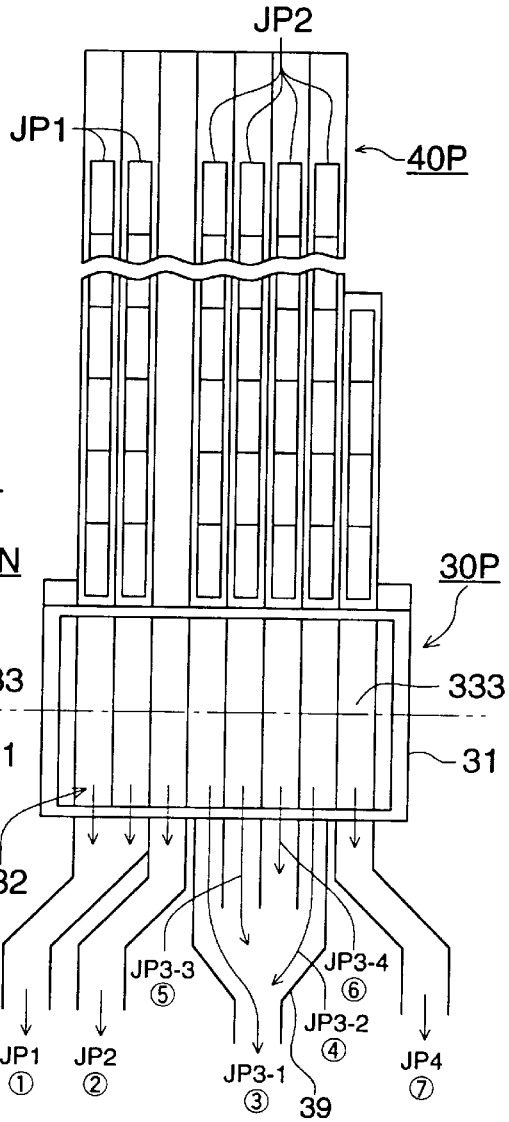
Figure 26:
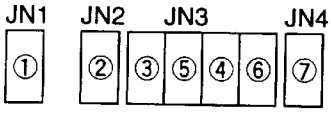
Figure 26:
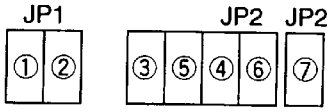
Figure 26:
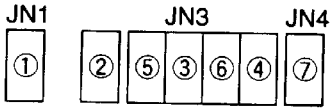
Figure 26:
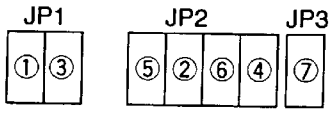

FIG. 26(*a*) is a typical view showing the conveying paths along which plural kinds of solid processing agents JN1–JN4 in the storing container 40N are replenished from the lower delivery opening portions 332 into corresponding processing tanks through the lower replenishing device 30N. Hereinafter, the supplying sequence of the solid processing agents JN1–JN4 will be described.

(1) The processing agent JN1 in the storing chamber 412A in the first row of the storing container 40N is supplied into the pocket portion 333A of the rotating drum member 333 and conveyed, and is replenished from the lower delivery opening portion 332 into the corresponding processing tank 1NA.

(2) The processing agent JN2 in the storing chamber 412C in the third row of the storing container 40N is supplied into the pocket portion 333C of the rotating drum member 333 and conveyed, and is replenished from the lower delivery opening portion 332 into the corresponding processing tank 1NB.

(3) The processing agent JN3 in the storing chamber 412D in the fourth row of the storing container 40N is supplied into the pocket portion 333D of the rotating drum member 333 and conveyed, and is replenished from the lower delivery opening portion 332 into the corresponding processing tank 1ND.

(4) The processing agent JN3 in the storing chamber 412F in the sixth row of the storing container 40N is replenished from the pocket portion 333F into the lower processing tank 1ND.

(5) The processing agent JN3 in the storing chamber 412E in the fifth row of the storing container 40N is replenished from the pocket portion 333E into the lower processing tank 1ND.

(6) The processing agent JN3 in the storing chamber 412G in the sixth row of the storing container 4QN is replenished from the pocket portion 333G into the lower processing tank 1ND.

(7) The processing agent JN4 in the storing chamber 412H in the eighth row of the storing container 40N is supplied into the pocket portion 333H of the rotating drum member 333 and conveyed, and is replenished from the lower delivery opening portion 332 into the corresponding processing tank 1NG.

The solid processing agents JN3 accommodated in the storing chambers 412D–G in the fourth–seventh row of the storing chamber 40N are successively supplied into the corresponding pocket portions 333D–G of the drum member 333 and conveyed, successively delivered from the lower delivery opening portion 332, pass through the supplying path in a common guide member 39 and replenished into the lower processing tank 1ND.

The upper portion of the guide member 39 faces the delivery opening portions 332 in four rows and is connected to them, has chute plates to partition the opening portions in four rows, the lower portion of the guide member 39 is closed tight and gradually narrowed, and a path portion through which one solid processing agent JN3 can pass after being arrayed, is formed. The narrow path portion has the minimum cross-sectional area so that gasses evaporated from the lower processing tank 1ND do not rise up and affect ill-influence on the solid processing agent JN3 in the upper replenishing device 30N and storing container 40N.

When a plurality of solid processing agents JN3 are supplied into the narrow path of the guide member 39 at almost the same time, these processing agents interfere with each other in the vicinity of the narrow path portion, cause choking, resulting in poor replenishment. In order to prevent that, a time difference is set as described above, and the solid processing agent JN3 is supplied. Further, when the solid processing agents JN1–4 are supplied by one rotation of the drum member 333, the solid processing agents in adjoining rows are adjusted not to be continuously supplied.

FIG. 26(*b*) is an illustration showing the order(1)–(7) to supply the solid processing agents JN1–4 from the delivery opening portion. When the solid processing agents JN3 are supplied in the order of (3) the fourth row, (4) the sixth row, (5) the fifth row, and (6) the seventh row, it is solved that the solid processing agents in adjoining rows interfere with each other. Incidentally, although (3) the fourth row and (5) the fifth row are adjoined, these are located in the central portion of the guide member 39, and therefore, the solid processing agents JN3 pass through the chute plate and arrive at the path portion without any trouble.

FIG. 26(*c*) is an illustration showing another preferable example of the order (1)–(7) to supply the solid processing agents JN1–4 from the delivery opening portion. When the solid processing agents JN3 are supplied in the order of (3) the fifth row, (4) the seventh row, (5) the fourth row, and (6) sixth row, it is solved that the solid processing agents in adjoining rows interfere with each other. In this supplying sequence, the solid processing agents in adjoining rows are not continuously supplied, thereby, the interference of the solid processing agents in four rows is not caused.

FIG. 26(*d*) is a typical view showing the conveying path to replenish the solid processing agents JP1–JP3 in the storing container 40P from the lower delivery opening portion into the corresponding processing tanks through the lower replenishing device 30P.

FIG. 26(*e*) is an illustration showing the order (1)–(7) to supply the solid processing agents JP1–3 from the delivery opening portion. The supplying order of the solid processing agent JP2 is the same as that of the above cited solid processing agent JN3.

FIG. 26(*f*) is an illustration showing another preferable example of the order(1)–(7) to supply the solid processing agents JP1–3 from the delivery opening portion. When the solid processing agents JP1 is supplied in the order of (1) the first row, (3) the second row, and the solid processing agents JP2 is supplied in the order of (2) the fifth row, and(4) the seventh row,(5) the fourth row, and(6) the sixth row, it is solved that the solid processing agents in adjoining rows interfere with each other.

Figure 27:
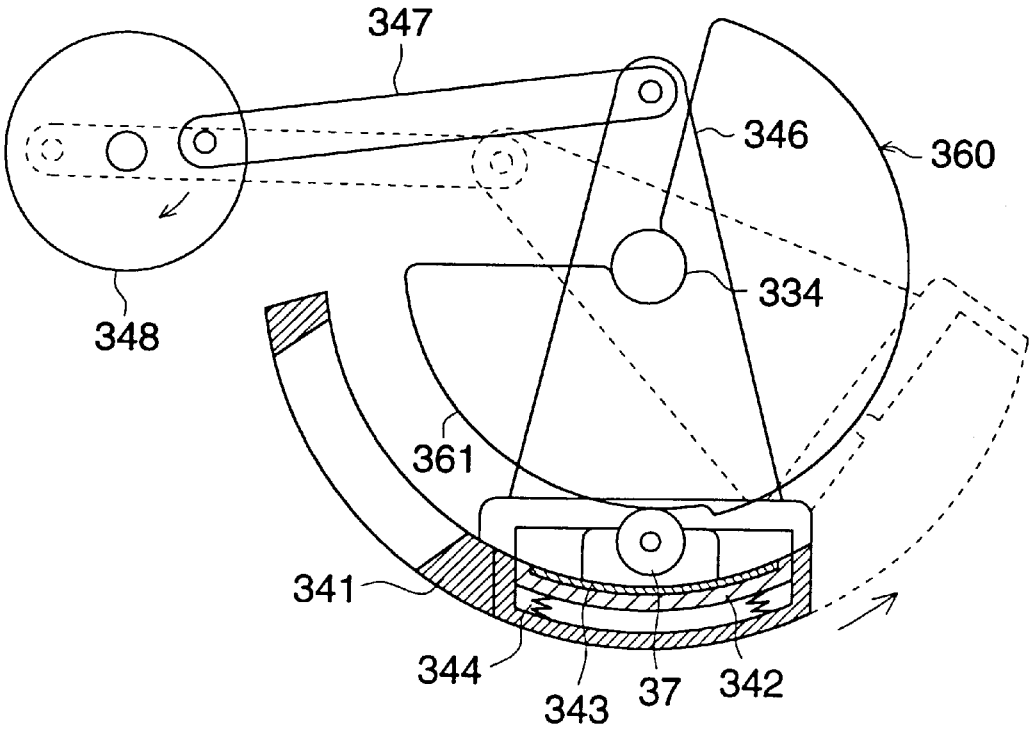
FIG. 27(*a*) is a sectional view showing a driving condition of a shutter means under a closed condition of a delivery opening portion, and FIG. 27(*b*) is a sectional view showing a driving condition of a shutter means under an opened condition of a delivery opening portion.
Figure 27:
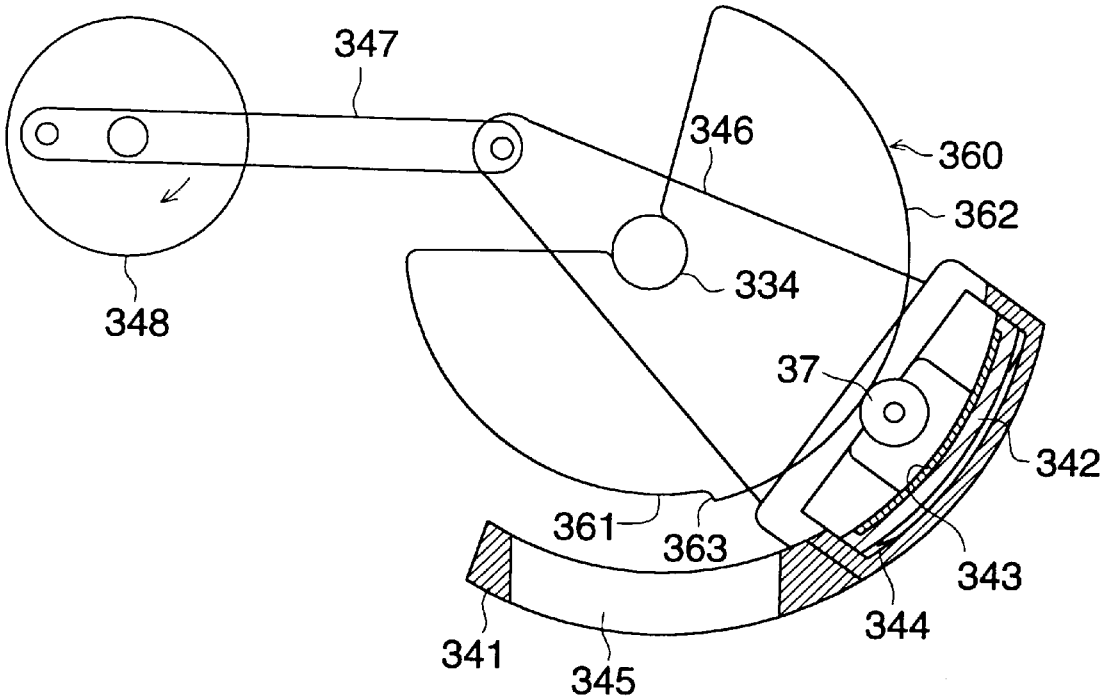

FIG. 27 is a sectional view showing the drive of the shutter means 340, FIG. 27(*a*) shows a condition that the shutter member 341 closes the delivery opening portion 332 of the lower main body 331, and FIG. 27(*b*) shows a condition that the shutter member 341 opens the delivery opening portion 332 of the lower main body 331.

A plate cam 360 is fixed on the outside of both side surfaces of the lower main body 331. The plate cam 360 is formed of a small cam surface 361 having the small radius of curvature, a large cam surface 362 having the large radius of curvature, and a gently curved inclined cam surface 363 to connect the small cam surface 361 to the large cam surface 362.

A pressing member 342 is forced by a spring member 344 and movably supported in a recessed portion provided on the inner surface side of the shutter member 341. An elastic packing member (elastic member) 343 is adhered on the surface of the pressing member 342. A cam follower 37 is rotatably supported at the central portion on the upper surface side of the pressing member 342.

In a condition before the shutter member 341 starts the oscillation, as shown in FIG. 27(*a*), the roller-like cam follower 37, rotatably held on both end portions of the pressing member 342, is engaged with the small cam surface 361 of the plate cam 360, and the elastic packing member 343 adhered onto the surface of the pressing member forced by the spring member 344, closes the delivery opening portion 332 of the lower main body 331, and the opening portion is in completely closed condition.

When shutter member 341 starts the oscillation, the cam follower 37 held by the pressing member 342 is gently pushed up and moved along the inclined cam surface 363, from the small cam surface 361 of the plate cam 360, and runs on the large cam surface 362. At the time of the movement onto the large cam surface 362, the pressing member 342 and the elastic packing member 343 which are integrated with the cam follower 37, are moved backward against the activation of the spring member 344, from the center of the plate cam 360 toward the outside of the normal line direction.

The shutter member 341 stops when it arrives at the position shown in FIG. 27(*b*), and the delivery opening portion 332 of the lower main body 331 is fully opened. While the shutter member 341 is moved from its wholly closed condition to the full open condition, the elastic packing member 343 is separated from the outer wall surface of the lower main body 331, thereby, the shutter member 341 is smoothly oscillated without having any sliding resistance.

Figure 28:
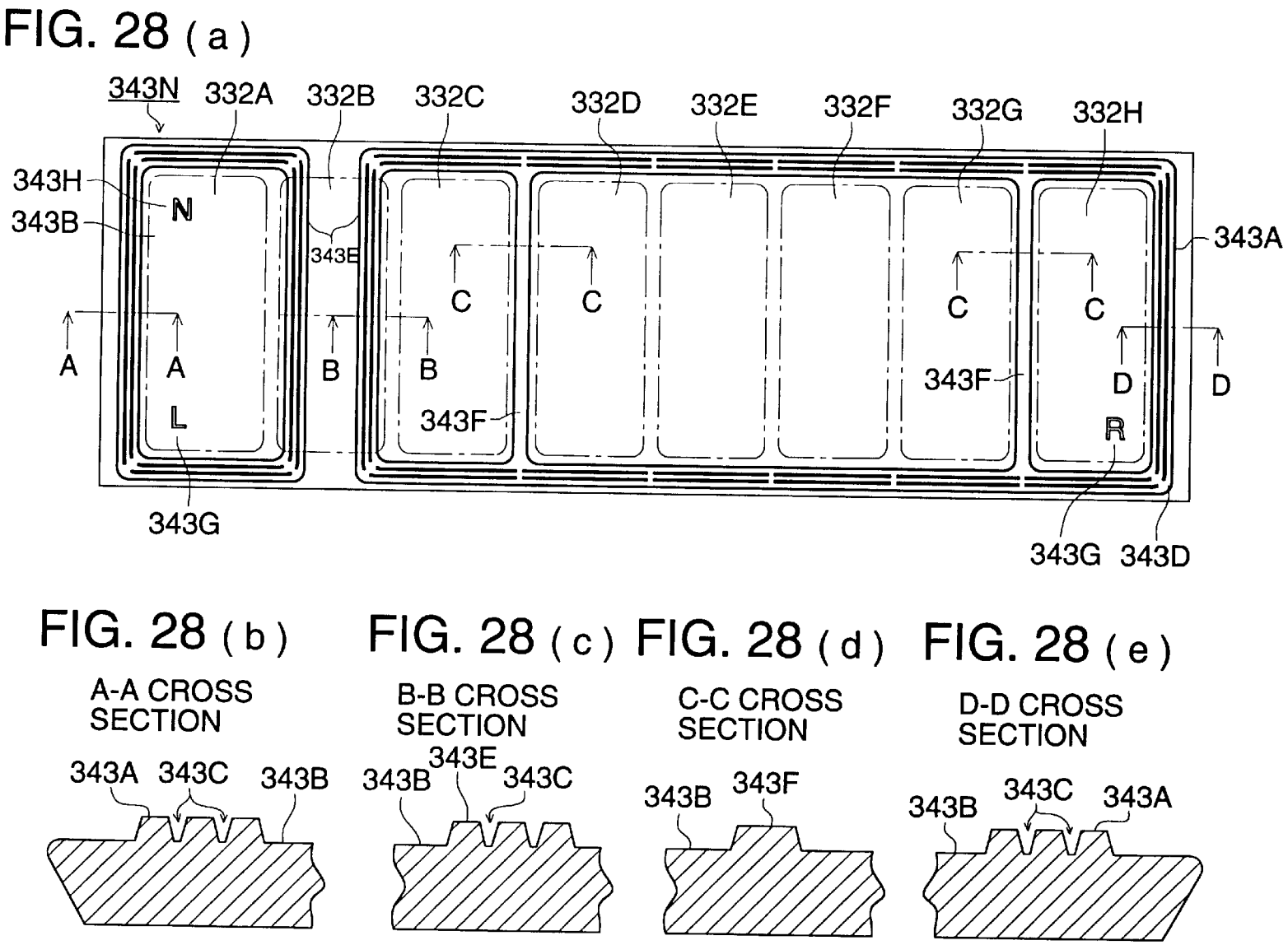
FIG. 28(*a*) is a development plan view of an elastic packing member of a replenishing device for a negative color film automatic processor, FIG. 28(*b*) is an enlarged sectional view taken on line A—A, FIG. 28(*c*) is an enlarged sectional view taken on line B—B, FIG. 28(*d*) is an enlarged sectional view taken on line C—C, and FIG. 28(*e*) is an enlarged sectional view taken on line D—D, respectively in FIG. 28(*a*).
Figure 29:
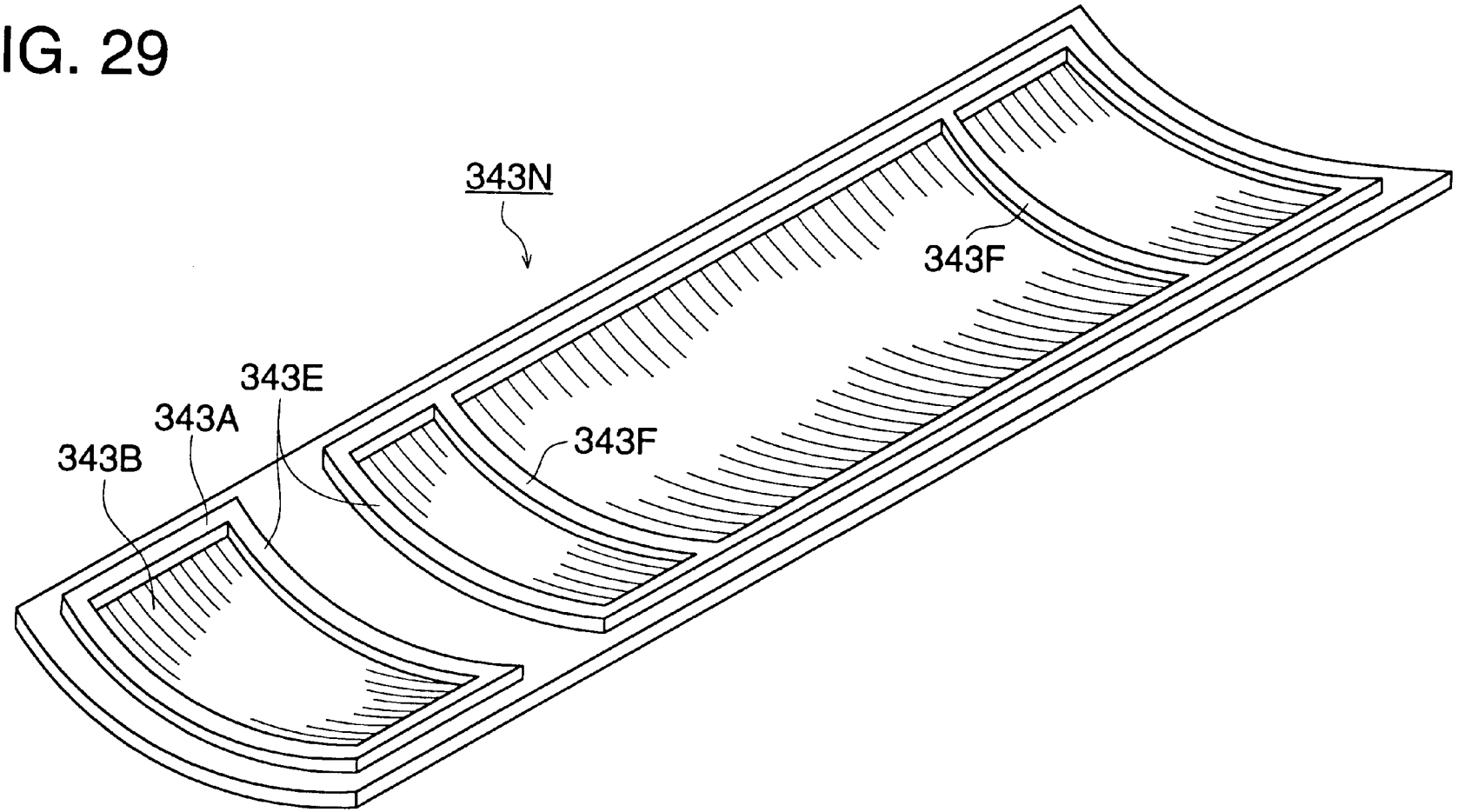
FIG. 29 is a perspective view of th e elastic packing member.

FIG. 28 shows an elastic packing member 343N of the shutter means 340 of the replenishing device 30N, FIG. 28(*a*) is a developed plan view of the elastic packing member 343N, FIG. 28(*b*) is an enlarged sectional view, taken on line A—A in FIG. 28(*a*), of the elastic packing member 343N, FIG. 28(*c*) is an enlarged sectional view, taken on line B—B in FIG. 28(*a*), FIG. 28(*d*) is an enlarged sectional view, taken on line D—D in FIG. 28(*a*), and FIG. 28(*e*) is an enlarged sectional view, taken on line D—D in FIG. 28(*a*). FIG. 29 is a perspective view of the elastic packing member 343N showing the shape when it is attached onto the surface of the pressing member 342.

The rear surface side of the elastic packing member 343N is adhered onto the pressing member 342, and the front surface side of the elastic packing member 343N presses the peripheral surface of the delivery opening portion 332 of the lower portion of the replenishing device main body 31.

The elastic packing member 343N is formed plate-like which has protruded portions 343A and recessed portions 343B. The surface portion of the elastic packing member 343N, which pressure-contacts with the periphery of the delivery opening portion 332, is formed into a thick protruded portion 343A, and the surface portion of the elastic packing member 343, which does not contact with the periphery of the delivery opening portion 332, is formed into a thin recessed portion 343B.

Groove portions 343C are formed on the thick protruded portion 343A of the surface portion of the elastic packing member 343N, and when the protruded portion 343A pressure-contacts with the periphery of the delivery opening portion 332, groove portions 343C are elastically deformed flexibly. Further, break portions 343D, which have partially no protruded portion 343A, are formed on linear portions and corner portions of the protruded portion 343A, and the protruded portion 343A is formed intermittently closed loop-like.

The periphery of the delivery opening portion 332 in the lower portion of the replenishing device main body 31 is formed into the cylindrical surface shape, and the periphery of the pressing member 342 is also the almost same cylindrical surface shape. The elastic packing member 343N, which is flexibly adhered onto the cylindrical surface of the pressing member 342 and is formed cylindrical surface-like, flexibly pressure-contacts with the cylindrical surface of the periphery of the delivery opening portion 332, and hermetically seals the delivery opening portion 332.

As shown in FIG. 28, the delivery opening portion 332 is partitioned into a plurality of delivery opening portions 332A–332H. The delivery opening portion 332B through which the solid processing agent J does not pass, is an empty chamber provided so that powders of chipped portions of the solid processing agent JN1 passing through the delivery opening portion 332A and those of the solid processing agent JN2 passing through the delivery opening portion 332C are not mixed into each other. In the vicinity of the delivery opening portion 332, hermetically sealing of the delivery opening portions 332A and 332C by the elastic packing member 343 is specifically necessary. In order to maintain the hermetic seal property, two protruded portions 343E are provided near the delivery opening portion 332B, and a lift of the elastic packing member 343N is prevented thereby.

A protruded portion 343F is protruded bridge-like also on the surface of the elastic packing member 343, which pressure-contacts with the front end portion of the partition wall provided between the delivery opening portion 332C through which the solid processing agent JN2 passes, and the delivery opening portion 332D through which the solid processing agent JN3 passes, thereby, the hermetic seal property is increased. In the same manner, a protruded portion 343F is protruded bridge-like also on the surface of the elastic packing member 343N, which pressure-contacts with the front end portion of the partition wall provided between the delivery opening portion 332G through which the solid processing agent JN3 passes, and the delivery opening portion 332H through which the solid processing agent JN4 passes, thereby, the hermetic seal property is increased.

As shown in FIG. 29, in the elastic packing member 343N, protruded portions 343E and 343F are formed asymmetrically in the left and right. An identifying mark 343G (shown by L) is integrally formed near the left end of the protruded portion 343B of the elastic packing member 343N, and an identifying mark 343G (shown by R) is integrally formed near the right end. When L and R of the identifying mark 343G are visually confirmed and the elastic packing member is adhered onto the pressing member 342, incorrect mounting on the left and right is prevented.

The elastic packing member 343 is formed of a member which is formed of chemical resistant material such as acrylonitrile-butadiene rubber (NBR), or the like. The elastic packing member 343 is formed of elastic material having the rubber hardness of 35–40°.

Figure 30:
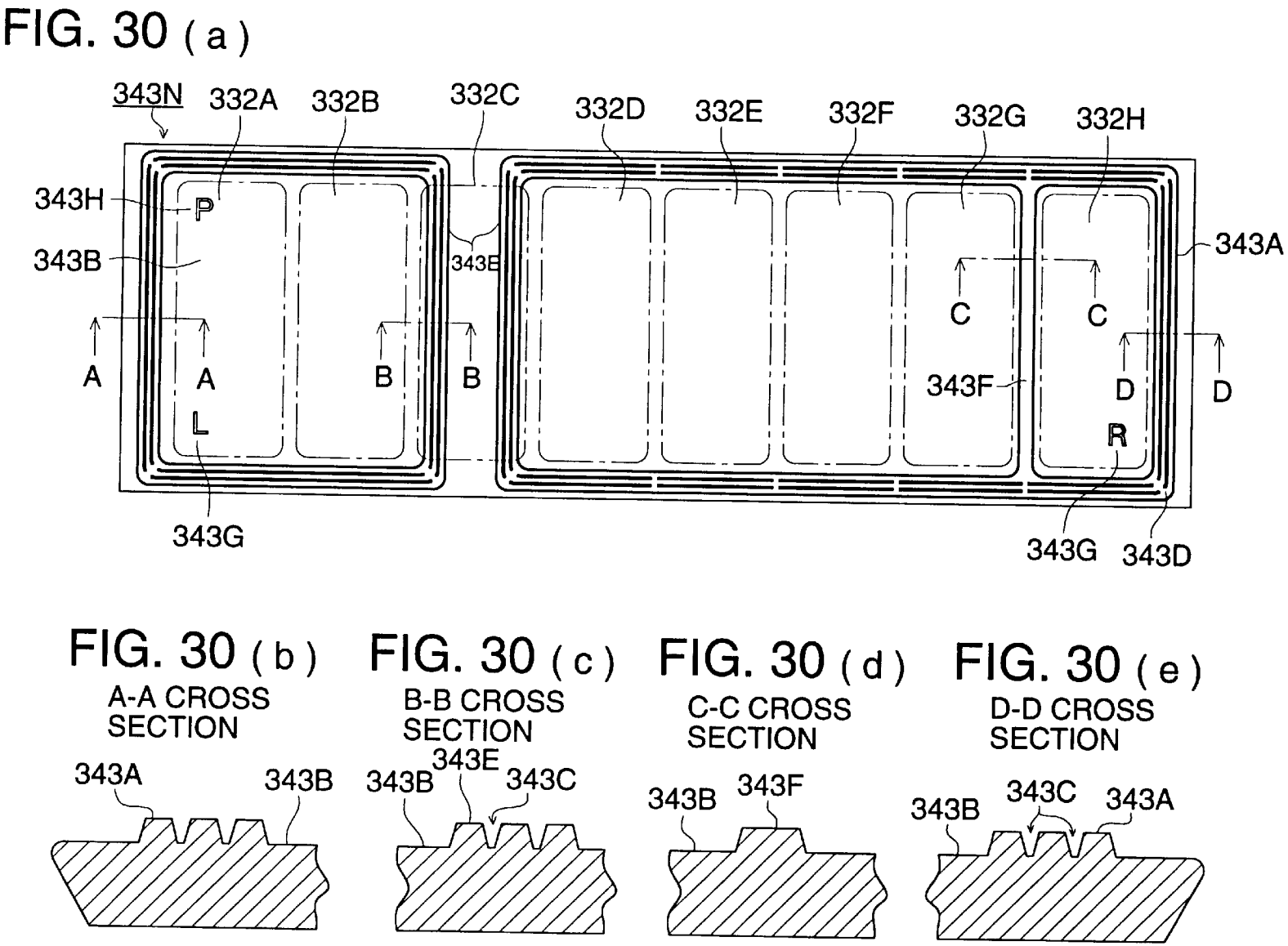
FIG. 30(*a*) is a development plan view of an elastic packing member of a replenishing device for a color printing paper automatic processor, FIG. 30(*b*) is an enlarged sectional view taken on line A—A, FIG. 30(*c*) is an enlarged sectional view taken on line B—B, FIG. 30(*d*) is an enlarged sectional view taken on line C—C, and FIG. 30(*e*) is an enlarged sectional view taken on line D—D, respectively in FIG. 30(*a*).

FIG. 30 shows the elastic packing member 343P of the shutter means 340 of the replenishing device 30P. FIG. 30(*a*) is a developed plan view of the elastic packing member 343P, FIG. 30(*b*) is an enlarged sectional view taken on line A—A in FIG. 30(*a*) of the elastic packing member 343P, FIG. 30(*c*) is an enlarged sectional view taken on line B—B in FIG. 30(*a*) of the elastic packing member 343P, FIG. 30(*d*) is an enlarged sectional view taken on line C—C in FIG. 30(*a*) of the elastic packing member 343P, and FIG. 30(*e*) is an enlarged sectional view taken on line D—D in FIG. 30(*a*) of the elastic packing member 343P.

The elastic packing member 343P has almost the same shape as that of the elastic packing member 343N, and accordingly, the name and symbol of each portion are denoted by the same as those of the elastic packing member 343N, and the detailed description is omitted.

A different point of the elastic packing member 343P from the elastic packing member 343N is only the located position of protruded portions 343E and 343F. The protruded portion 343E is provided opposite to the delivery opening portion 332C to separate the solid processing agent JP1 in the second row from the solid processing agent JP2 in the fourth row. The protruded portion 343F is provided only at a portion opposite to the partition wall to separate the solid processing agent JP2 in the seventh row from the solid processing agent JP3 in the eighth row.

Incidentally, the elastic packing member 343N used for the replenishing device for negative film 30N has the shape similar to that of the elastic packing member 343P used for the replenishing device for color paper 30P, therefore, identifying symbols are integrally formed on the elastic packing members so that these elastic packing members are not erroneously mounted when the replenishing device is assembled or subjected to the maintenance operation.

That is, in FIG. 28, the identifying symbol 343H is provided in the vicinity of the left upper portion in the drawing of the recessed portion 343B of the elastic packing member 343N. Further, in FIG. 30, the identifying symbol 343H is provided in the vicinity of the left upper portion in the drawing of the recessed portion 343B of the elastic packing member 343P.

Figure 31:
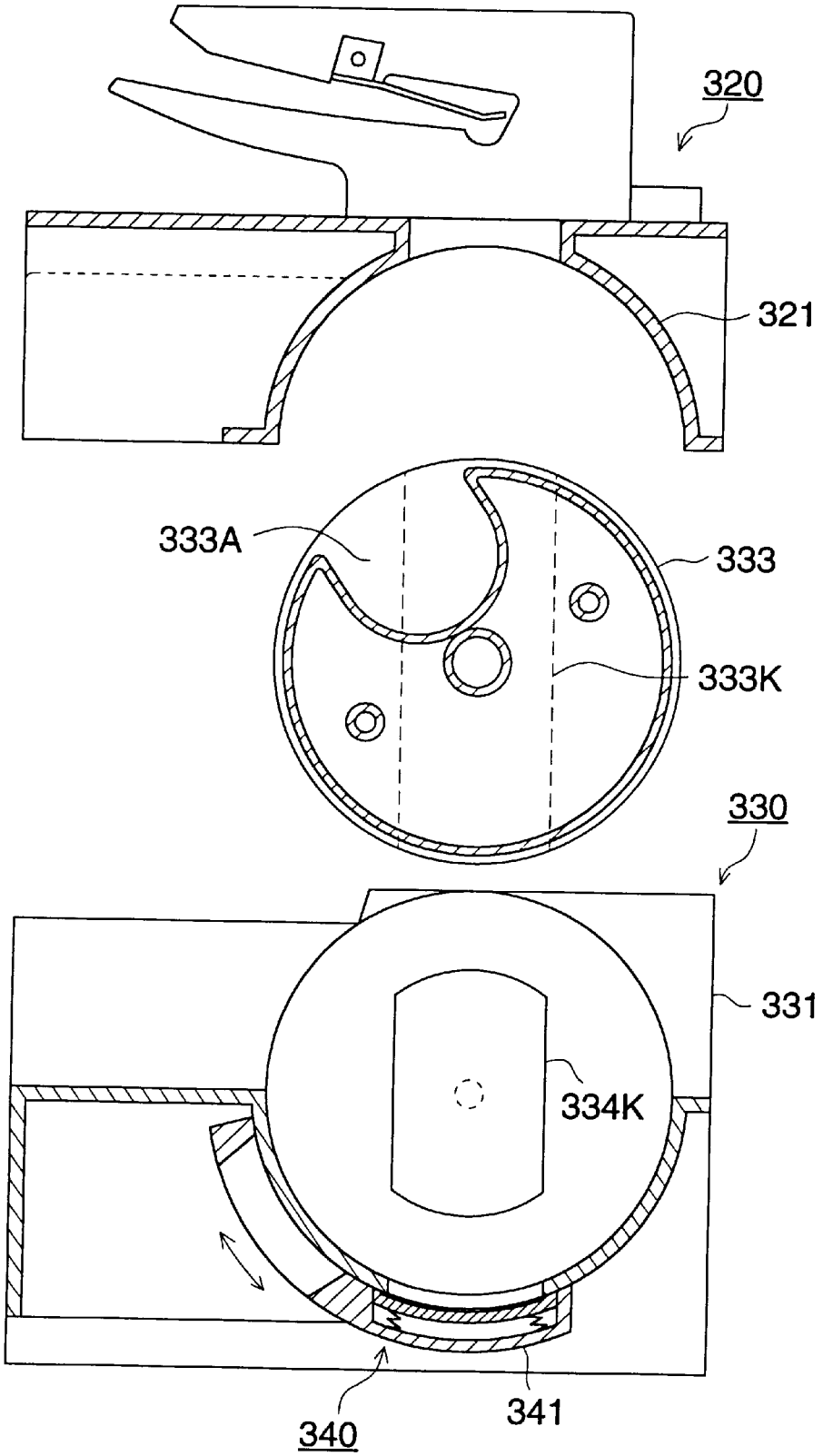
FIG. 31 is an exploded sectional view showing a condition that the drum member is taken out after the mounting portion has been removed from the processing agent supplying portion.

FIG. 31 is an exploded sectional view showing a condition that the drum member 333 is taken out after the mounting portion 320 is disassembled from the processing agent supply portion 330.

In this disassembled condition, powders or small lumps of the solid processing agent J, fixedly adhered onto the inner surface of the upper main body 321, the inner surface of the lower main body 331, or the outer peripheral surface of the drum member 333, can be easily cleaned and removed. Further, the drum member 333 is easily separated from, or assembled to the drive portion of the lower main body 331, thereby, the maintenance operation can be easily and quickly conducted. When the cleaning operation has been completed, after the concave coupling portion 333K of the drum member 333 is engaged with the convex coupling portion 334*k* of the lower main body 331, the upper main body 321 is attached to a predetermined position, and fixed by a well known clamp means.

Figure 32:
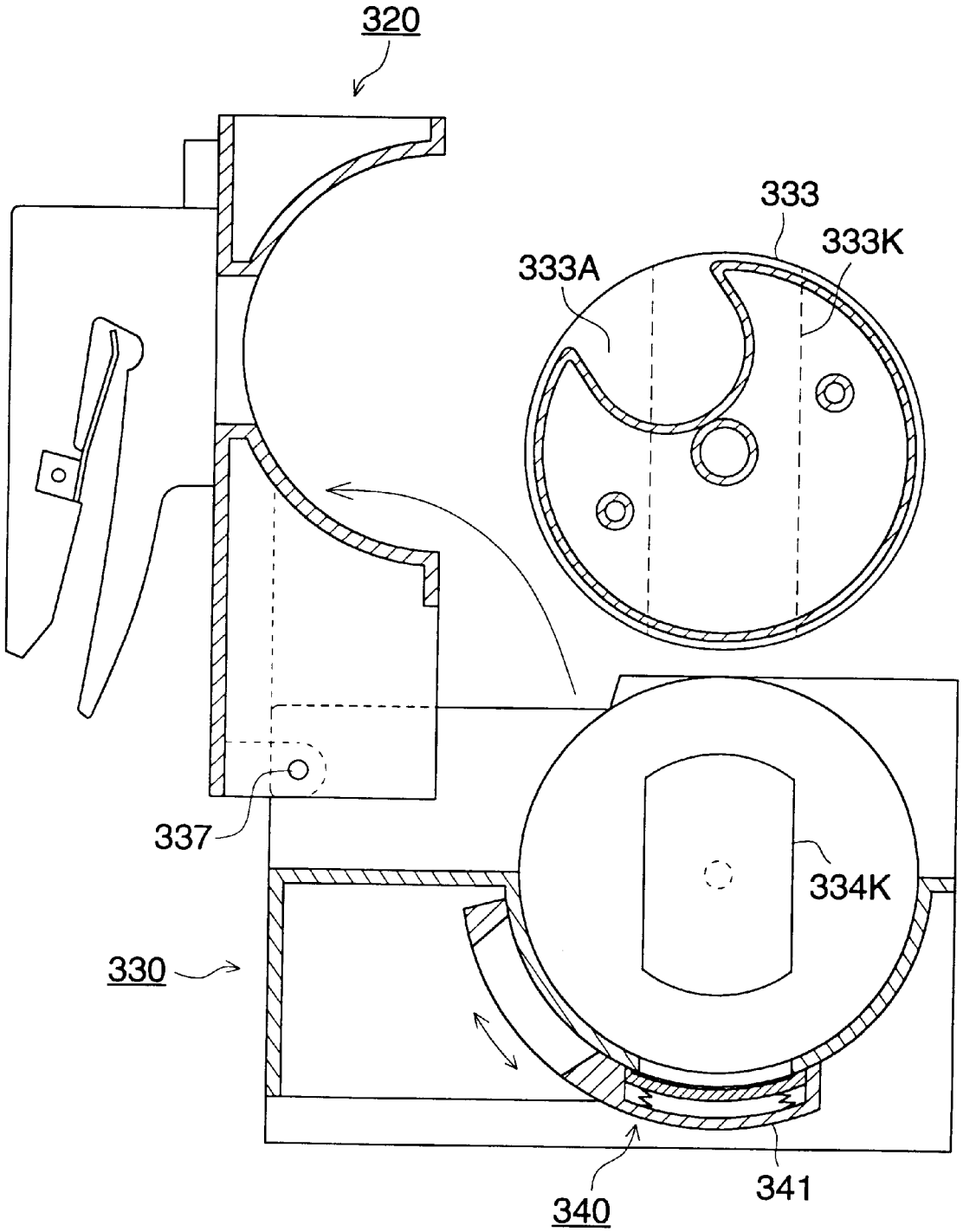
FIG. 32 is an exploded sectional view showing an example in which the drum member is taken out after the mounting portion has been oscillated around a fulcrum axis of the processing agent supplying portion and opened.

FIG. 32 is an exploded sectional view showing an example in which the drum member 333 is taken out after the mounting portion 320 is oscillated around a fulcrum shaft 337 of the processing agent supply portion 330 and opened.

When the upper main body 321 and the lower main body 331 are connected by the fulcrum shaft 337 in such a manner that these can be oscillated, the clamp of the upper main body 321 is released and the upper main body 321 is oscillated in the arrowed direction as shown in the drawing and opened, and then, the drum member 333 is taken out, the inside portions of the upper main body 321 and the lower main body 331 are exposed, thereby, cleaning is easy. Further, the opening operation of the upper main body 321 is also easy and safe.

Incidentally, the above cited example relates to the replenishing device for the tablet type solid processing agent, in which a predetermined amount of solid processing agents in the storing container is supplied by one rotation of the drum member 333, and further, the storing container can be collectively changed, however, the solid processing agent replenishing device of the present invention can also be applied to a constant amount replenishment of small particle-like solid processing agents, or granular solid processing agents.

As described above, the solid processing agent replenishing device for photosensitive material processing of the present invention has the following excellent effects.

(1) The replenishing device of the present invention has a processing agent supply portion formed as a unit to supply a plurality of solid processing agents, and a storing container, in which a plurality of solid processing agents are accommodated, can be loaded in the processing agent supply portion, and an installation space of the device can be easily secured, and the storing container can be easily replaced and handled.

(2) In the case where a maintenance operation is conducted for the processing tank, when the upper main body is removed and the solid processing agent supply portion is opened, the upper portion of the processing tank is opened, thereby, the easiness of the maintenance operation is increased.

(3) When different kinds of a predetermined amount of solid processing agents are supplied into each processing solution tank, dimensions and amounts of different kinds of solid processing agents to be supplied at one time are previously set, and by one rotation of the drum member of the solid processing agent replenishing device, the different kinds of a predetermined amount of solid processing agents can be easily and securely supplied equally in time. Accordingly, the drive means of the replenishing device becomes simple, and the replenishment control of the solid processing agent is carried out easily and securely.

(4) Further, when one rotation of the drum member is completed, no solid processing agent remains in all pocket portions of the drum member, and by closing storing container by the lid member, the solid processing agent in the storing container can be collected.

(5) Further, when a plurality of container main bodies to accommodate each solid processing agent are structured as an integrated unit, and the whole accommodated amounts of the solid processing agents in each container main body are set such that the remaining amount of each solid processing agent after consumption becomes zero at the same time, the replacement and mounting of the storing container, formed as a unit, are easy.

(6) In addition to the moisture-proofing, prevention of contamination, and secure replenishing operation of the solid processing agent, stable photographic performance can be obtained.

Concretely, the following effects are attained.

Entering of the air is prevented by the packing member according to the present invention provided on the contact portion of the solid processing agent storing container with the storing container mounting portion of the replenishing device.

Entering of the air is prevented at a gap formed between the rotation shaft of the rotatable drum member by which the solid processing agents in the storing container are received and conveyed, and supplied into a plurality of processing solution tanks, and the housing to house the drum member and rotatably support it.

When a joint portion to joint divided portions of the replenishing device main body is formed into the convex and concave shape and, in addition to that, a packing member is inserted, entering of the gas or air is prevented at the joint portion.

What is claimed is:

1. A container for storing plural different kinds of photosensitive material processing agents, comprising:

a first storing room in which a first processing agent is stored, the fist storing room having a first opening;

a second storing room in which a second processing agent different in kind from the first processing agent is stored, the second storing room having a second opening;

a third storing room in which a third processing agent different in kind from both the first processing agent and the second processing agent is stored, the third storing room having a third opening;

the second storing room located between the first storing room and the third storing room so that a first distance is provided between the first storing room and the second storing room and a second distance is provided between the second storing room and the third storing room, wherein the first distance is made larger than the second distance;

a first flange section provided so as to enclose the periphery of the first opening;

a second flange section provided so as to enclose the periphery of both the second opening and the third opening; and a cover member to cover the first opening, the second opening and the third opening.

2. The container of claim 1, further comprising:

an empty room in which no processing agent is stored, the empty room located between the first storing room and the second storing room.

3. The container of claim 2, wherein the empty room has a fourth opening.

4. The container of claim 3, wherein the empty room has the same size as that of one of the first storing room and the second storing room.

5. The container of claim 1, further comprising:

a sealing member provided to the cover member such that the sealing member opens or closes the first opening, the second opening and the third opening in synchronization with the movement of the cover member to open or close the first opening, the second opening and the third opening.

6. The container of claim 5, wherein the sealing member is divided into a first sealing member to seal the first opening and a second sealing member to seal the second opening and the third opening.

7. The container of claim 5, wherein the sealing member has a structure of PET/AL/PE/sealant, Nylon/AL/PE/sealant, PET/AL/PET/sealant, or Nylon/AL/PET/sealant, and has a the stiffness of 10 to 40 g.

8. The container of claim 5, wherein the sealing member is pasted to both the first flange section and the second flange section on the condition that the pressure in the first storing room, the second storing room and the third storing room is reduced.

9. The container of claim 1, wherein the first flange section and the second flange section are provided with a protrusion protruding in a direction vertical to the plane of the first opening, the second opening and the third opening.

10. The container of claim 1, wherein the first flange section and the second flange section are provided with a protrusion protruding in a direction vertical to the plane of the first opening and the second opening.

11. A container for storing plural different kinds of photosensitive material processing agents, comprising:

a first storing room in which a first processing agent is stored, the fist storing room having a first opening;

a second storing room in which a second processing agent different in kind from the first processing agent is stored, the second storing room having a second opening;

an empty room in which no processing agent different is stored, the empty room located between the first storing room and the second storing room and has an opening;

a first flange section provided so as to enclose the periphery of both the first opening and the empty room;

a second flange section provided so as to enclose the periphery of the second opening; and a cover member to cover the first opening and the second opening.

12. The container of claim 11, wherein the empty room has a third opening.

13. The container of claim 11, wherein the empty room has the same size as that of one of the first storing room and the second storing room.

14. The container of claim 11, further comprising:

a sealing member provided to the cover member such that the sealing member opens or closes the first opening, the second opening and the third opening in synchronization with the movement of the cover member to open or close the first opening and the second opening.

15. The container of claim 14, wherein the sealing member is divided into a first sealing member to seal the first opening and the third opening and a second sealing member to seal the second opening.

16. The container of claim 14, wherein the sealing member has a structure of PET/AL/PE/sealant, Nylon/AL/PE/sealant, PET/AL/PET/sealant, or Nylon/AL/PET/sealant, and has a the stiffness of 10 to 40 g.

17. The container of claim 14, wherein the sealing member is pasted to both the first flange section and the second flange section with heat on the condition that the pressure in the first storing room, the second storing room and the third storing room is reduced.

* * * * *